US009387683B2

(12) United States Patent
Iwamuro et al.

(10) Patent No.: US 9,387,683 B2
(45) Date of Patent: Jul. 12, 2016

(54) LIQUID STORAGE CONTAINER

(71) Applicant: Seiko Epson Corporation, Tokyo (JP)

(72) Inventors: Takeshi Iwamuro, Matsumoto (JP); Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/927,188

(22) Filed: Oct. 29, 2015

(65) Prior Publication Data

US 2016/0046129 A1 Feb. 18, 2016

Related U.S. Application Data

(63) Continuation of application No. 14/012,248, filed on Aug. 28, 2013, now Pat. No. 9,216,585.

(30) Foreign Application Priority Data

Aug. 31, 2012 (JP) ..... 2012-192657
Nov. 12, 2012 (JP) ..... 2012-248728

(51) Int. Cl.
*B41J 2/175* (2006.01)

(52) U.S. Cl.
CPC ..... *B41J 2/1752* (2013.01); *B41J 2/17513* (2013.01); *B41J 2/17523* (2013.01); *B41J 2/17543* (2013.01); *B41J 2/17546* (2013.01); *B41J 2/17553* (2013.01)

(58) Field of Classification Search
CPC .... B41J 2/1752; B41J 2/17513; B41J 2/7523; B41J 2/17543; B41J 2/17546; B41J 2/17553
USPC ..... 347/85, 86
See application file for complete search history.

(56) References Cited

U.S. PATENT DOCUMENTS

2002/0105565 A1 8/2002 Suda et al.
2003/0054709 A1 3/2003 Yomo et al.
2012/0038719 A1 2/2012 Shimizu et al.

FOREIGN PATENT DOCUMENTS

JP 2008-254395 A 10/2008
JP 2012-051307 A 3/2012

*Primary Examiner* — Stephen Meier
*Assistant Examiner* — Alexander D Shenderov

(57) ABSTRACT

A liquid storage container supplies ink to a printer which consumes the ink, and includes a liquid storage body which includes a liquid lead-out port communicating with the printer and a filler port formed to pour the liquid to the liquid storage container, an auxiliary holding member which is mounted to be slidable to a side in which the filler port is formed, and a memory unit holding member which is detachably configured to the auxiliary holding member and includes a memory unit.

20 Claims, 27 Drawing Sheets

LIQUID STORAGE CONTAINER

This application is a continuation of, and claims priority under 35 U.S.C. §120 on, U.S. application Ser. No. 14/012,248, filed Aug. 28, 2013, which priority is claimed under 35 U.S.C. §119 to Japanese Application Nos. 2012-192657 filed on Aug. 31, 2012 and, No. 2012-248728 filed on Nov. 12, 2012. The content of each application identified above is incorporated by reference herein in its entirety.

BACKGROUND

1. Technical Field

The present invention relates to a liquid storage container which stores liquid to be supplied to a liquid consumption apparatus.

2. Related Art

In the related art, as a type of liquid consumption apparatus, an ink jet type printer is known which ejects ink (liquid) from a liquid ejecting head to a target such as paper and thus, performs printing (recording). Moreover, in the printer, if a relatively large amount of ink is consumed while the printing is performed, in order to supply the ink to the liquid ejecting head continuously and stably, a configuration which supplies ink from a liquid storage container having a relatively large ink storage capacity to the liquid ejecting head is known (for example, JP-A-2012-51307 and JP-A-2008-254395).

In this printer, the liquid storage container is separately provided to the printer and is detachably disposed to a side surface or the like of the printer. Moreover, when the ink is poured into the liquid storage container, the liquid storage container is removed from the side surface of the printer so as to expose a filler port of the ink, and thus, pouring of the ink is possible. Alternatively, the separate liquid storage container (ink reservoir) is accommodated in the printer in a state where the liquid storage container is disposed in a storage case provided in a leg portion of the printer. Moreover, when the ink is poured into the liquid storage container, the liquid storage container is drawn out from the storage case and is moved to a place where a pouring operation of the ink is easily performed, and the pouring operation of the ink is performed.

However, in the printers having the configurations disclosed in JP-A-2012-51307, JP-A-2008-254395, or the like, since a user moves the liquid storage container during the pouring of the ink, the liquid storage container may fall or drop while the user moves the liquid storage container. Accordingly, there is a concern that the liquid storage container may be damaged or the ink remaining in the liquid storage container may be spilled.

Moreover, the above-described problems become common in the liquid storage container which stores the liquid to be supplied to the liquid consumption apparatus consuming the liquid, and includes a liquid storage body separately formed from the liquid consumption apparatus, and in which a filler port for pouring the liquid is provided in the liquid storage body.

SUMMARY

An advantage of some aspects of the invention is to provide a liquid storage container that can suppress damage during a pouring operation of liquid or spill of the liquid remaining in the liquid storage container.

Advantages of the present invention are achieved in a liquid ejecting apparatus adapted to eject liquid onto a medium, the liquid ejecting apparatus comprising: a housing section; a medium discharge port configured and arranged to discharge the medium, the medium discharge port being disposed on a front side of the housing section and defining an opening of the front side of the housing section through which the medium is discharged outside of the housing section; an operation panel disposed on the housing section; and a liquid holding body disposed on the front side of the housing section, wherein in a state where the liquid holding body is mounted to the liquid ejecting apparatus, the liquid holding body includes an inlet port section configured and arranged to introduce the liquid from outside the liquid holding body into the liquid holding body, and at least a part of the inlet port section is disposed at a position lower than a position of the operation panel.

This embodiment may further include a cover member configured and arranged to cover the inlet port section, the cover member being openable and closable relative to the inlet port section.

In this case, the cover member is preferably configured and arranged to freely rotate such that an axis which extends along a short side direction of the liquid holding body is the center of rotation.

Alternatively, the cover member may be configured and arranged to be displaced from a closed lid position to an open lid position by moving in parallel with regard to the liquid holding body in a longitudinal direction.

The above embodiment may further include a covering body configured to contact and cover the inlet port section and arranged detachably to the inlet port section; wherein the cover member is configured and arranged to cover the inlet port section and the cover body when the cover body contacts and covers the inlet portion section.

The present advantages may also be achieved in a liquid ejecting apparatus adapted to eject liquid onto a medium, the liquid ejecting apparatus comprising: a housing section; a medium discharge port configured and arranged to discharge the medium, the medium discharge port being disposed on a front side of the housing section and defining an opening of the front side of the housing section through which the medium is discharged outside of the housing section; an operation panel disposed on the housing section; and a liquid holding body disposed on the front side of the housing section; wherein in a state where the liquid storage container is mounted to the liquid ejecting apparatus, the liquid holding body includes an inlet port section configured and arranged to introduce the liquid from outside the liquid holding body into the liquid holding body, and at least a part of the inlet port section is disposed at a position more forward than a position of the operation panel.

If desired, this embodiment may further include a cover member configured and arranged to cover the inlet port section, the cover member being openable and closable relative to the inlet port section.

In this case, it is preferred that the cover member be further configured and arranged to freely rotate such that an axis which extends along the short side direction of the liquid holding body is the center of rotation.

Alternatively, the cover member may be configured and arranged to be displaced from a closed lid position to an open lid position by moving in parallel with regard to the liquid holding body in a longitudinal direction.

The present embodiment may further include a covering body configured to contact and cover the inlet port section and arranged detachably to the inlet port section; wherein the cover member is configured and arranged to cover the inlet port section and the cover body when the cover body contacts and covers the inlet portion section.

Advantages of the present invention may further be achieved in a liquid ejecting apparatus adapted to eject liquid onto a medium, the liquid ejecting apparatus comprising: a housing section; a medium discharge port configured and arranged to discharge the medium, the medium discharge port being disposed on a front side of the housing section and defining an opening of the front side of the housing section through which the medium is discharged outside of the housing section; and a liquid holding body disposed on the front side of the housing section; wherein in a state where the liquid storage container is mounted to the liquid ejecting apparatus, the liquid holding body includes an inlet port section configured and arranged to introduce the liquid from outside the liquid holding body into the liquid holding body, and at least a part of the inlet port is disposed at a position more forward than a position of the medium discharge port.

This embodiment may further include a cover member configured and arranged to cover the inlet port section, the cover member being openable and closable relative to the inlet port section.

In this case, the cover member may further be configured and arranged to freely rotate such that an axis which extends along the short side direction of the liquid holding body is the center of rotation.

Alternatively, the cover member may be configured and arranged to be displaced from a closed lid position to an open lid position by moving in parallel with regard to the liquid holding body in the longitudinal direction.

This embodiment may further include a covering body configured to contact and cover the inlet port section and arranged detachably to the inlet port section; wherein the cover member is configured and arranged to cover the inlet port section and the cover body when the cover body contacts and covers the inlet portion section.

Advantages of the present invention may further be achieved in a liquid ejecting apparatus adapted to eject liquid onto a medium, the liquid ejecting apparatus comprising: a housing section; a medium discharge port configured and arranged to discharge the medium, the medium discharge port being disposed on a front side of the housing section and defining an opening of the front side of the housing section through which the medium is discharged outside of the housing section; and a liquid holding body disposed on the front side of the housing section, wherein in a state where the liquid storage container is mounted to the liquid ejecting apparatus, the liquid holding body includes an inlet port section configured and arranged to introduce the liquid from outside the liquid holding body into the liquid holding body, and at least a part of the inlet port is disposed in a lower section of the housing at one end side which is an outer side of a transport path of the medium.

This embodiment may further include a cover member configured and arranged to cover the inlet port section, the cover member being openable and closable relative to the inlet port section.

In this case, the cover member is preferably configured and arranged to freely rotate such that an axis which extends along the short side direction of the liquid holding body is the center of rotation.

Alternatively, the cover member may be configured and arranged to be displaced from a closed lid position to an open lid position by moving in parallel with regard to the liquid holding body in the longitudinal direction.

Preferably, this embodiment may include a covering body configured to contact and cover the inlet port section and arranged detachably to the inlet port section; wherein the cover member is configured and arranged to cover the inlet port section and the cover body when the cover body contacts and covers the inlet portion section.

According to an another aspect of the invention, there is provided a liquid storage container which stores liquid to be supplied to a liquid consumption apparatus consuming the liquid, and includes a liquid storage body separately formed from the liquid consumption apparatus, and in which a filler port for pouring the liquid is provided in the liquid storage body. The liquid storage body is fixed to be unmovable to the liquid consumption apparatus, and includes a first portion which is positioned outside the liquid consumption apparatus and a second portion which is positioned inside the liquid consumption apparatus in a state where the liquid storage body is fixed to the liquid consumption apparatus. In addition, the filler port is formed in the first portion.

According to this configuration, in the liquid storage container, since the filler port is formed in the first portion which is positioned outside the liquid consumption apparatus in the liquid storage body, the ink can be poured in the state where the liquid storage body is fixed to the liquid consumption apparatus. Accordingly, damage during an pouring operation of the liquid or spill of the liquid remaining inside the liquid storage body can be suppressed.

In the liquid storage container, the liquid storage container may further include an auxiliary holding member which is slidable to the liquid storage body and includes a moving portion which moves between inside the liquid consumption apparatus and outside the liquid consumption apparatus according to the sliding, and the auxiliary holding member may include a memory unit holding member, which can mount a memory unit recording relevant information related to the liquid poured into the liquid storage body, in the moving portion.

According to this configuration, in the liquid storage container, the memory unit, which records the relevant information of the liquid poured into the liquid storage body fixed to be unmovable, can move from outside the liquid consumption apparatus to inside the liquid consumption apparatus using the auxiliary holding member which slides on the liquid storage body. Accordingly, when the memory unit moves into the liquid consumption apparatus, for example, if the circuit substrate including the memory unit is designed to contact the electric terminal or the like provided in the liquid consumption apparatus, the relevant information of the ink poured into the liquid storage body can be correctly transferred to the liquid consumption apparatus.

In the liquid storage container, the filler port may be provided in an upper surface which becomes the antigravity direction in the liquid storage body fixed to the liquid consumption apparatus, and the auxiliary holding member may be provided in a state where the auxiliary holding member covers the filler port.

According to this configuration, since the filler port is covered by the auxiliary holding member, entering of foreign substances into the filler port can be suppressed without a separated cover for the filler port.

In the liquid storage container, the auxiliary holding member provided in a state where the auxiliary holding member covers the filler port may include an open-close cover which can be displaced between a closed cover position at which the filler port is covered and an opened cover position at which the filler port is exposed.

According to this configuration, even if the auxiliary holding member does not slide in the state where the auxiliary holding member covers the filler port, the filler port can be covered or exposed by the displacement of the open-close cover.

In the liquid storage container, the liquid storage body may have a shape which has a direction from the first portion toward the second portion as a longitudinal direction. In addition, the open-close cover may be rotatably and pivotally supported to the auxiliary holding member to have an axis extending along a short direction of the liquid storage body as a rotation center at a position approaching the second portion side from the filler port in a state where the open-close cover covers the filler port, may be rotated to fall toward the second portion side after a side of the open-close cover opposite to the pivotally supported side gets up, and may be displaced from the closed cover position to the opened cover position.

According to this configuration, in the state where the open-close cover is displaced from the closed cover position to the opened cover position, the open-close cover is positioned at the second portion side with respect to the filler port, that is, the liquid consumption apparatus side. Accordingly, the open-close cover does not hinder the pouring of the liquid to the filler port.

In the liquid storage container, the auxiliary holding member may include an engagement portion which positions the open-close cover at the closed cover position by engagement with the open-close cover, generates a rotation load to the open-close cover, and suppresses displacement of the open-close cover from the closed cover position to the opened cover position.

According to this configuration, since the open-close cover can be stably maintained at the closed cover position, careless opening of the open-close cover and exposure of the filler port can be suppressed.

In the liquid storage container, the memory unit holding member may include a positioning shape portion which positions the memory unit holding member in a direction intersecting a movement direction of the moving portion of the auxiliary holding member in the liquid consumption apparatus when the moving portion of the auxiliary holding member moves into the liquid consumption apparatus.

According to this configuration, since the memory unit holding member is positioned in the direction intersecting the movement direction of the moving portion in the liquid consumption apparatus, the memory unit placed on the memory unit holding member is also accurately positioned in the liquid consumption apparatus. Accordingly, since the electrical terminal included in the liquid consumption apparatus contacts the memory unit in the state where the positional displacement is suppressed, the transfer of the relevant information recorded in the memory unit to the liquid consumption apparatus is performed with high probability.

In the liquid storage container, the memory unit holding member may be inserted into the auxiliary holding member from a direction orthogonal to a sliding direction of the auxiliary holding member with respect to the liquid storage body and may be included in the auxiliary holding member, and a circuit substrate in which the memory unit is provided may be placed in the memory unit holding member in a state where the circuit substrate is inclined in the sliding direction of the auxiliary holding member.

According to this configuration, since the movement of the memory unit holding member in the sliding direction of the auxiliary holding member is suppressed, the memory unit holding member is accurately positioned in the sliding direction of the auxiliary holding member in the liquid consumption apparatus. Moreover, since the circuit substrate, which includes the memory unit placed on the memory unit holding member, is inclined in the sliding direction of the auxiliary holding member, for example, the electric terminal included in the liquid consumption apparatus moves while rubbing the memory unit and is electrically connected to the memory unit. Accordingly, reliability of electrical conduction is increased.

According to another aspect of the invention, there is provided a liquid storage container which supplies liquid to a liquid consumption apparatus, including: a liquid storage body which includes a liquid lead-out port communicating with the liquid consumption apparatus and a filler port formed to pour the liquid to the liquid storage container; an auxiliary holding member which is mounted to be slidable to a side in which the filler port is formed; and a memory unit holding member which is detachably configured to the auxiliary holding member and includes a memory unit.

According to this configuration, in the liquid storage container, the memory unit can move to inside the liquid consumption apparatus using the auxiliary holding member which slides with respect to the liquid storage body. Accordingly, in the state where the liquid storage body is mounted to the liquid consumption apparatus, the memory unit related to (the poured ink or the like) the liquid storage body can be attached and detached to be readable in the liquid consumption apparatus, only the memory unit can be removed and exchanged during the pouring of the ink, or the like, and thus, operability related to the ink pouring can be improved.

In the liquid storage container, the liquid storage body may include a first portion which is positioned outside the liquid consumption apparatus and a second portion which is positioned inside the liquid consumption apparatus in a state where the liquid storage body is mounted to the liquid consumption apparatus.

According to this configuration, when the ink is poured, it is not necessary to move the liquid storage body, and thus, operability can be improved.

In the liquid storage container, the filler port may be formed in the first portion, and the auxiliary holding member may cover the filler port.

According to this configuration, the liquid filler port is formed at the portion which is positioned outside the liquid consumption apparatus, many filler ports are configured by a portion of the auxiliary holding member, and thus, the mounting of the memory unit and covering of the filler port can be performed by a simple configuration.

In the liquid storage container, the memory unit may be positioned in a mounting direction side of the liquid storage container and the filler port may be positioned at a side opposite to the memory unit in a state where the liquid storage container is mounted to the liquid consumption apparatus and the liquid consumption apparatus and the memory unit are electrically connected to each other.

According to this configuration, since the liquid filler port and the memory unit are disposed at the positions separated from each other, occurrence of short circuit or the like due to attachment of the liquid such as ink to the terminal or the like of the memory unit during the pouring of the ink can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid storage container and an ink jet type printer (hereinafter, also referred to as a "printer") which is an example of a liquid consumption apparatus which consumes liquid supplied from the liquid storage container will be described with reference to the drawings.

Figure 1:
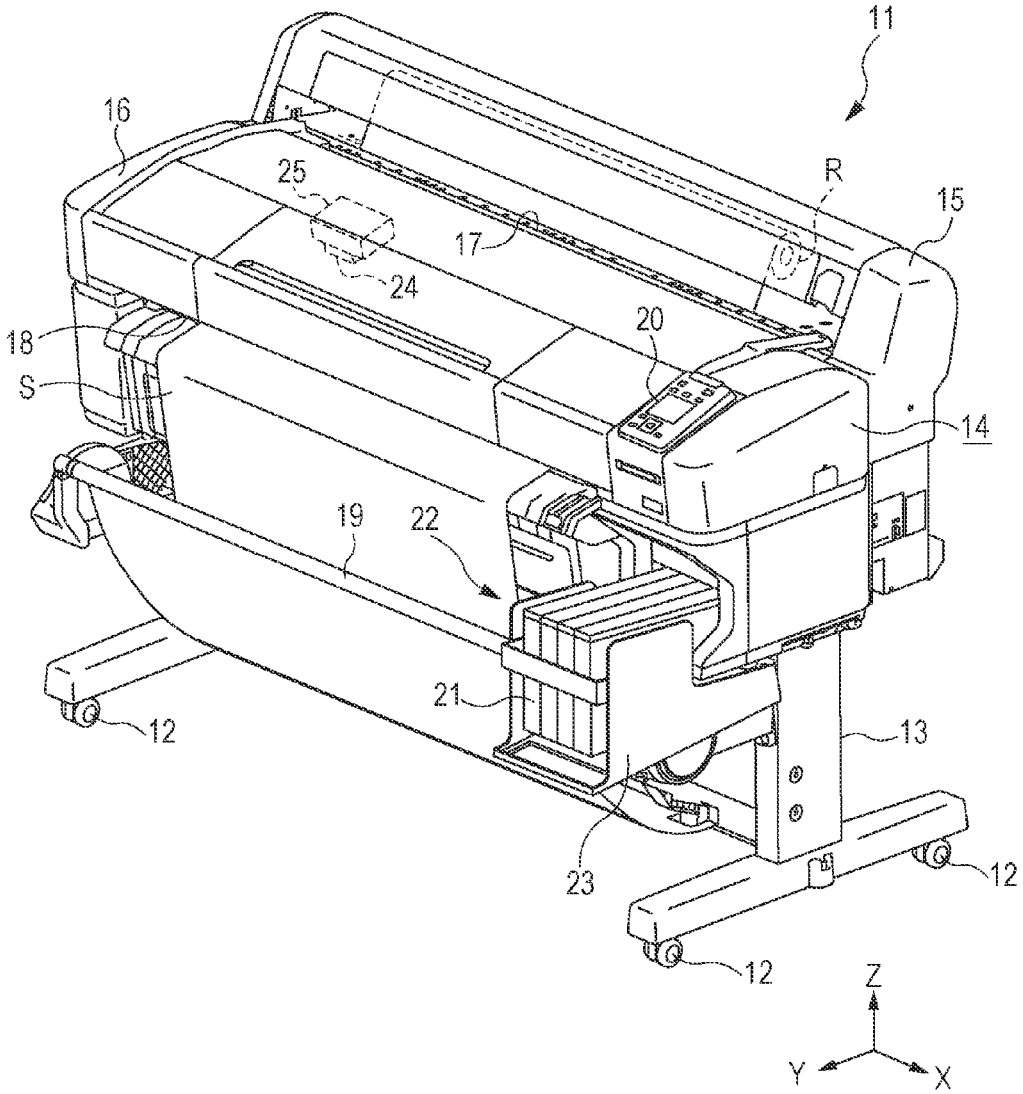
FIG. 1 is a perspective view of a printer to which a liquid storage container according to an embodiment is fixed.

As shown in FIG. 1, a printer 11 of the present embodiment includes leg portions 13 to which wheels 12 are mounted to the lower ends and an apparatus main body 14 which is assembled on the leg portions 13 and has an approximately rectangular parallelepiped shape. Moreover, in the embodiment, a direction along the gravity direction is set to an up-down direction Z, and a longitudinal direction of the apparatus main body 14 which intersects (is orthogonal in the embodiment) the up-down direction Z is set to a left-right direction X. In addition, a direction which intersects (is orthogonal in the embodiment) both of the up-down direction Z and the left-right direction X is set to a front-rear direction Y.

As shown in FIG. 1, a feeding portion 15 which protrudes upward is provided in a rear portion of the apparatus main body 14. Rolled paper R, in which paper S which is a long medium is cylindrically wound, is charged in the feeding portion 15. In a housing portion 16 which configures the exterior of the apparatus main body 14, an insertion port 17 for introducing the paper S fed from the feeding portion 15 into the housing portion 16 is formed at a position which is a front side of the feeding portion 15.

Meanwhile, a discharging port 18 for discharging the paper S outside the housing portion 16 is formed on a front surface side of the apparatus main body 14. Moreover, a medium transportation mechanism (not shown), which transports the paper S fed from the feeding portion 15 from the insertion port 17 side to the discharging port 18 side, is accommodated in the housing portion 16. In addition, a medium receiving unit 19, which receives the paper S discharged from the discharging port 18, is provided at a position below the discharging port 18 in the front surface side of the apparatus main body 14.

Moreover, in an upper portion of the apparatus main body 14, an operation panel 20 for performing a set operation or an input operation is provided in one end side (a right end side in FIG. 1) which becomes an outer side of a transport path of the paper S in the left-right direction X. In addition, in a lower portion of the apparatus main body 14, a liquid storage container 21 capable of storing ink which is an example of the liquid is fixed to the one end side (the right end side in FIG. 1) which becomes an outer side of the transport path of the paper S in the left-right direction X.

A plurality (four in the embodiment) of the liquid storage containers 21 are provided corresponding to kinds or colors of the ink. Moreover, the plurality of liquid storage containers 21 are disposed to be arranged in the left-right direction X, and thus, a liquid storage unit 22 is configured. In other words, the direction in which the plurality of liquid storage containers 21 are arranged may be the X direction. In addition, the liquid storage unit 22 includes a portion which is exposed to the front side (outer side) of the apparatus main body 14 in a state where each liquid storage container 21 is fixed to the apparatus main body 14. Moreover, the liquid storage unit 22 is covered by an arm member 23 in which both sides in the left-right direction X and the lower side in the up-down direction Z of the exposed portion are fixed to the apparatus main body 14 side and which has an approximate U shaped cross-section.

Moreover, a carriage 25, on which a liquid ejecting head 24 is mounted, is accommodated in the housing portion 16 in a state where the carriage can reciprocate in the left-right direction X which is a main scanning direction. In addition, a liquid supply mechanism (not shown) for supplying the ink stored in the liquid storage container 21 toward the liquid ejecting head 24 is accommodated in the housing portion 16. Moreover, recording (printing) is performed by ejecting ink droplets from the liquid ejecting head 24 with respect to the paper S transported by the medium transportation mechanism, and the ink in the liquid storage container 21 is consumed due to the ejecting of the ink droplets.

Figure 2:
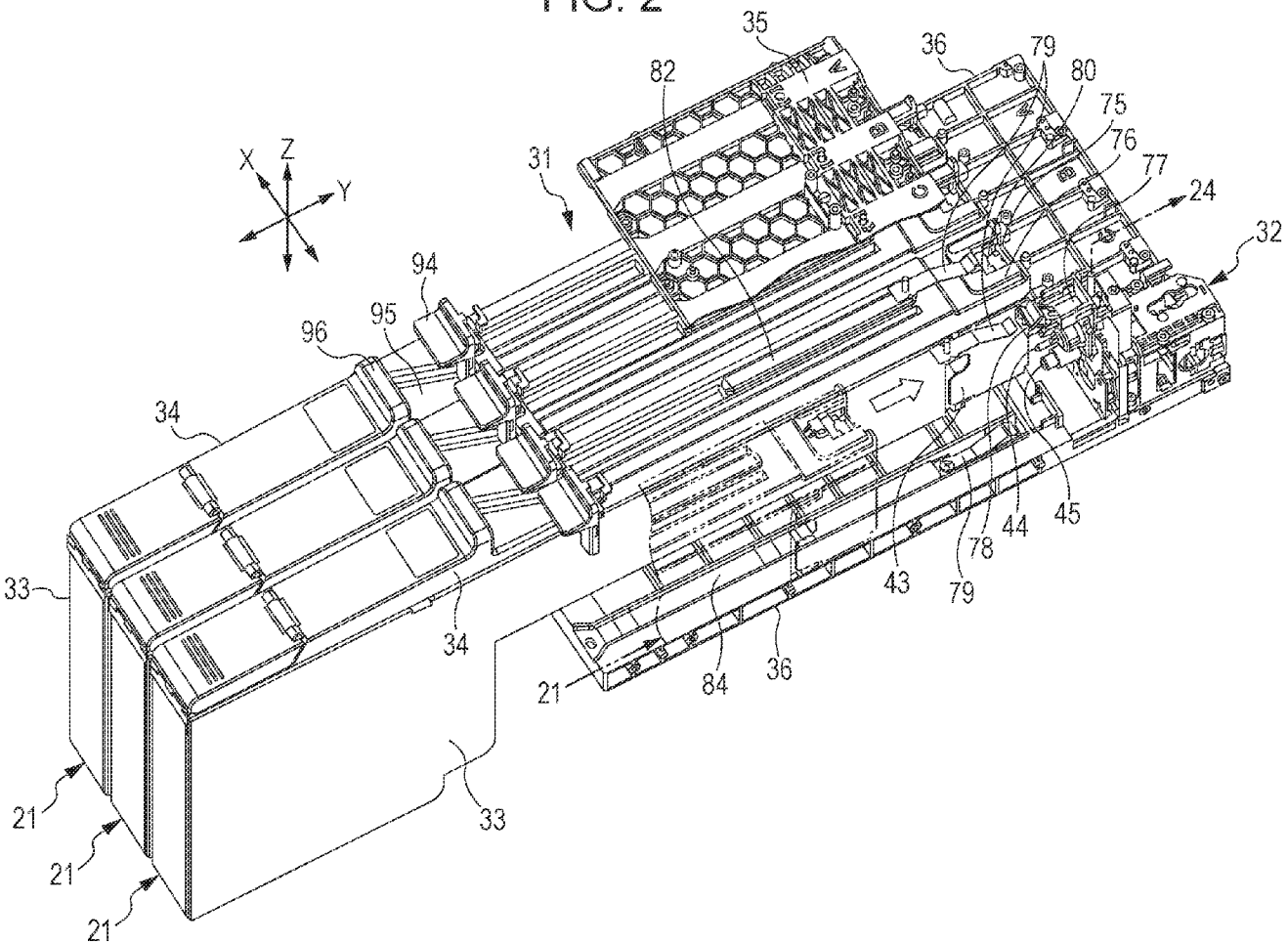
FIG. 2 is a perspective view showing a state where the liquid storage container is mounted on a mounting portion.

Next, a mounting portion 31 which mounts the liquid storage container 21 to the apparatus main body 14 in a fixed state, and the liquid storage container 21 which is fixed to the apparatus main body 14 via the mounting portion 31 will be described. Moreover, in order to avoid complication, in FIG. 2, only one supply portion 32 which is a portion of the liquid supply mechanism which supplies the ink from each liquid storage container 21 to the liquid ejecting head 24 side is shown, and a state before the liquid storage container 21 corresponding to the one supply portion 32 shown in FIG. 2 is mounted on the mounting portion 31 as shown by two-dot chain lines and a white arrow is shown. In addition, in FIG. 3, a state where a liquid storage body 33 and a slider 34 which is an example of a sub-holding member are separated from each other is shown, and the liquid storage body and the slider configure the liquid storage container 21.

As shown in FIG. 2, the mounting portion 31, which includes an upper frame 35 and a lower frame 36 which are disposed with a predetermined gap in vertical direction (the up-down direction Z), is provided in the printer 11. Moreover, the supply portion 32 which is a portion of the liquid supply mechanism is mounted on the mounting portion 31 so as to correspond to each liquid storage container 21. In addition, in FIG. 2, a state where a portion of the upper frame 35 is cut and removed in the left-right direction X is shown.

The liquid storage container 21 is fixed so as to be unmovable to the printer 11 in a state where one end side (right end side in FIG. 2) in the longitudinal direction of the liquid storage container is positioned in the mounting portion 31. Moreover, in the state where the liquid storage container 21 is fixed to the printer 11, the ink stored in the liquid storage container 21 is supplied to the liquid ejecting head 24 side by the supply portion 32 which is mounted so as to correspond to one end side of each liquid storage container 21 in the mounting portion 31. Therefore, in the embodiment, the state where the liquid storage container 21 is mounted on the mounting portion 31 of the printer 11 and is fixed so as to be unmovable to the printer 11 becomes a posture during use of the liquid storage container 21. In addition, the fixed state means a state in which a user cannot remove the liquid storage container 21 from the printer 11, and for example, there is a state where the liquid storage container 21 is screwed to the printer 11 or a state where the ink is supplied from the liquid storage container 21 to the printer 11 and the printer 11 is during performing the printing.

Figure 3:
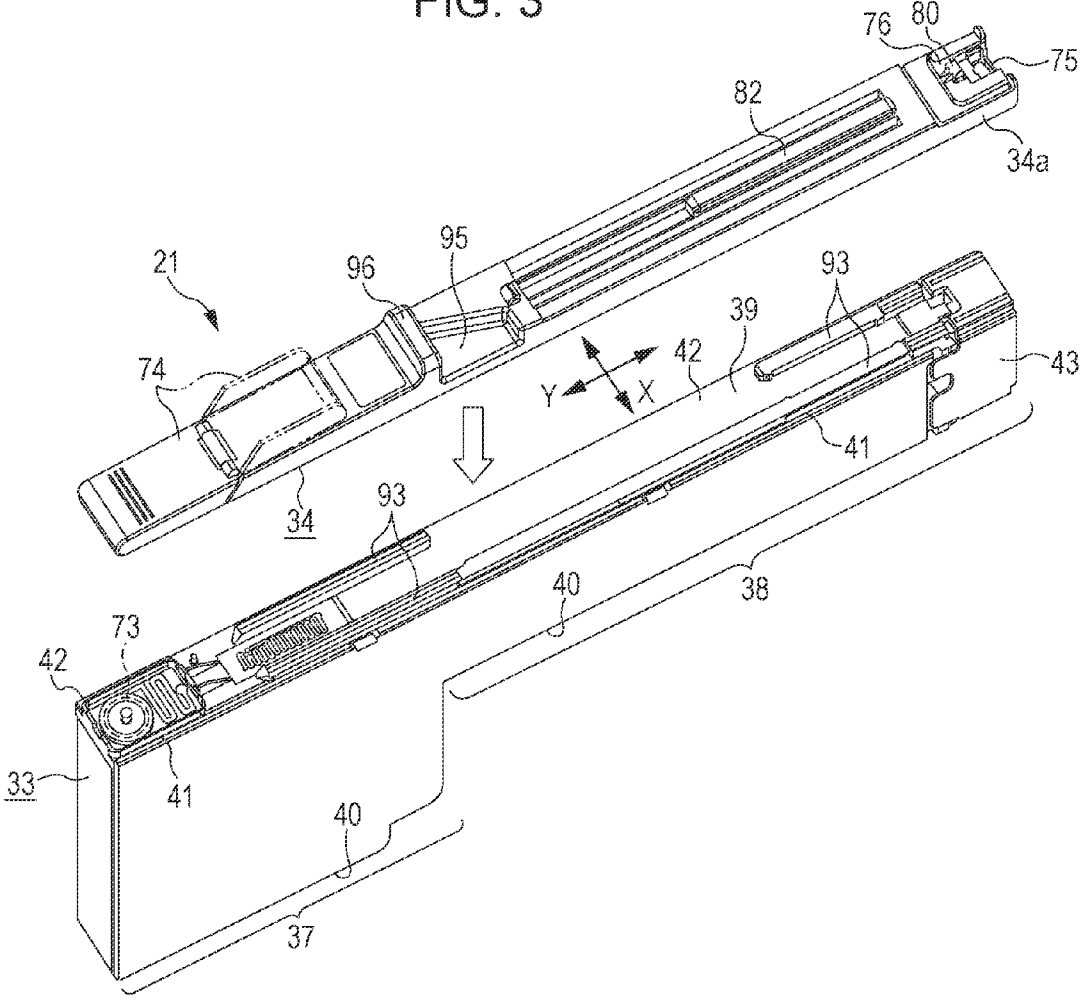
FIG. 3 is a perspective view showing a state where a slider is separated from the liquid storage container.

Then, as shown in FIGS. 2 and 3, the liquid storage container 21 of the embodiment includes the liquid storage body 33 which stores the ink, and the slider 34 which is disposed to be overlapped with the upper side becomes the antigravity direction in the vertical direction with respect to the liquid storage body 33.

In the liquid storage body 33, a direction orthogonal to the longitudinal direction of the apparatus main body 14 in the approximately horizontal direction becomes a longitudinal direction (front-rear direction Y), and the liquid storage body has a rectangular parallelepiped shape of an approximately L shape in a side view which has a constant width in a short direction (left-right direction X) orthogonal to the longitudinal direction in the approximately horizontal direction. That is, the liquid storage body 33 includes a first storage body portion 37 in which the side shape when viewed from the short direction (left-right direction X) presents an approximately square shape, and a second storage body portion 38 in which the side shape presents an approximately square shape which is long in the front-rear direction Y at the rear side of the first storage body portion 37 and in which an outlet 52 described below is formed. Moreover, on an upper surface 39 of the liquid storage body 33, flat surface portions 41 and 42, which continuously extend in the longitudinal direction (front-rear direction Y) without a step, are formed on both ends in the short direction. That is, height of an upper surface (may be also referred to as an upper portion or a top face) among the plurality of surfaces which configure the first storage body portion 37, and height of an upper surface (may be also referred to as an upper portion or a top face) among the plurality of surfaces which configure the second storage body portion 38 are the same as each other in the height direction (vertical direction). The slider 34 can slide along the flat surface portions 41 and 42. On the other hand, a lower surface 40 of the liquid storage body 33 has a shape presenting a step surface in which the first storage body portion 37 is lower than the second storage body portion 38 in the longitudinal direction (front-rear direction Y). That is, a lower surface (lower portion) among the plurality of surfaces which configure the first storage body portion 37 is positioned at a lower position in the height direction (vertical direction) than a lower surface (lower portion) among the plurality of surfaces which configure the second storage body portion 38. Moreover, volume of the first storage body portion 37 is larger than volume of the second storage body portion 38. Moreover, also in an embodiment in which the slider 34 is not used, as described in the following reasons, the height of the upper surface (may be also referred to as upper portion or top face) among the plurality of surfaces which configure the first storage body portion 37, and the height of the upper surface (may be also referred to as upper portion or top face) among the plurality of surfaces which configure the second storage body portion 38 may be or may not be the same as each other in the height direction (vertical direction). However, it is preferable that the height of the upper surface of the first storage body portion 37 from the upper surface of the second storage body portion 38 be lower than the height of the lower surface of the second storage body portion 38 from the lower surface of the first storage body portion 37.

Moreover, in the embodiment, the first storage body portion 37 is configured of at least a first surface (may be also referred to as a first side surface or a first side portion) in the mounting direction side (insertion direction side) of the liquid storage container 21 and a second surface (may be also referred to as a second side surface or a second side portion) opposite to the first surface. However, a fixed portion 37*a* (refer to FIGS. 13, 14, 20A, and 20B) provided on the first surface is screwed to a fixing portion (not shown), which is provided on the apparatus main body 14 side, using a screw 37*b* (refer to FIGS. 20A and 20B), and thus, the liquid storage container 21 is fixed so as to be unmovable to the printer 11. Moreover, in the embodiment, in a state where the liquid storage body 33 fixed by the screw is mounted to the printer 11, at least a portion of the second storage body portion 38 becomes a second portion (may be also referred to as a portion which is mounted or inserted to the printer 11 or the apparatus main body 14) which is positioned in the apparatus main body 14 of the printer 11, and a portion other than the second portion in the second storage body portion 38 and the first storage body portion 37 are positioned outside the apparatus main body 14 of the printer 11 and become a first portion which is exposed to the front side of the apparatus main body 14. Moreover, the first surface, which is a surface in the mounting direction of the first storage body portion 37, may be also referred to as the surface of the second storage body portion 38 side among the surfaces which configure the first storage body portion 37.

In addition, as described above, since the lower surface of the first storage body portion 37 is positioned at the lower position in the height direction than the lower surface of the second storage body portion 38, the lower surface (lower portion) of at least a portion of the first portion is positioned at the lower position than the lower surface (lower portion) of the second portion.

Moreover, as described above, since the volume of the first storage body portion 37 is larger than the volume of the second storage body portion 38, the volume of the first portion is larger than the volume of the second portion.

In addition, as described above, since the outlet 52 is formed in the second storage body portion 38, the outlet 52 is formed in the second portion.

Moreover, as described above, since the height of the upper surface among the plurality of surfaces which configure the first storage body portion 37, and the height of the upper surface among the plurality of surfaces which configure the second storage body portion 38 are the same as each other in the height direction (vertical direction), the upper surface among the plurality of surfaces which configure the first portion and the upper surface among the plurality of surfaces which configure the second portion are the same as each other in the height direction (vertical direction).

In addition, as described above, when the mounting direction in which the liquid storage body 33 is mounted in the mounting portion 31 is set to the longitudinal direction (front-rear direction Y), since the liquid storage body 33 has a rectangular parallelepiped shape of an approximately L shape in a side view which has a constant width in the short direction (left-right direction X) orthogonal to the longitudinal direction in the approximately horizontal direction, the length in the short direction of the first portion and the length in the short direction of the second portion are the same as each other.

In addition, the second storage body portion 38 includes a connection portion 43 in the rear end side which becomes a side opposite to the first storage body portion 37 side in the longitudinal direction, and the connection portion 43 is separately formed from a housing member (storage body case 130 shown in FIG. 13) configuring the liquid storage body 33 and is mounted to be relatively movable with respect to the second storage body portion 38. The connection portion 43 includes an ink channel which introduces the ink stored in the liquid storage body 33 to an ink supply needle 44 which is included in the supply portion 32 mounted on the mounting portion 31 side, and a transfer mechanism which transfers presence or absence of the ink in the liquid storage body 33 to an ink remaining amount detection rod 45 which is included in the supply portion 32.

Here, with reference to FIGS. 4 and 5, a configuration of the connection portion 43, in which the ink channel and the transfer mechanism are formed, will be described. Moreover, in FIGS. 4 and 5, components related to the supply needle 44 and the remaining amount detection rod 45 among the components of the supply portion 32 are shown, and other components are appropriately omitted.

Figure 4:
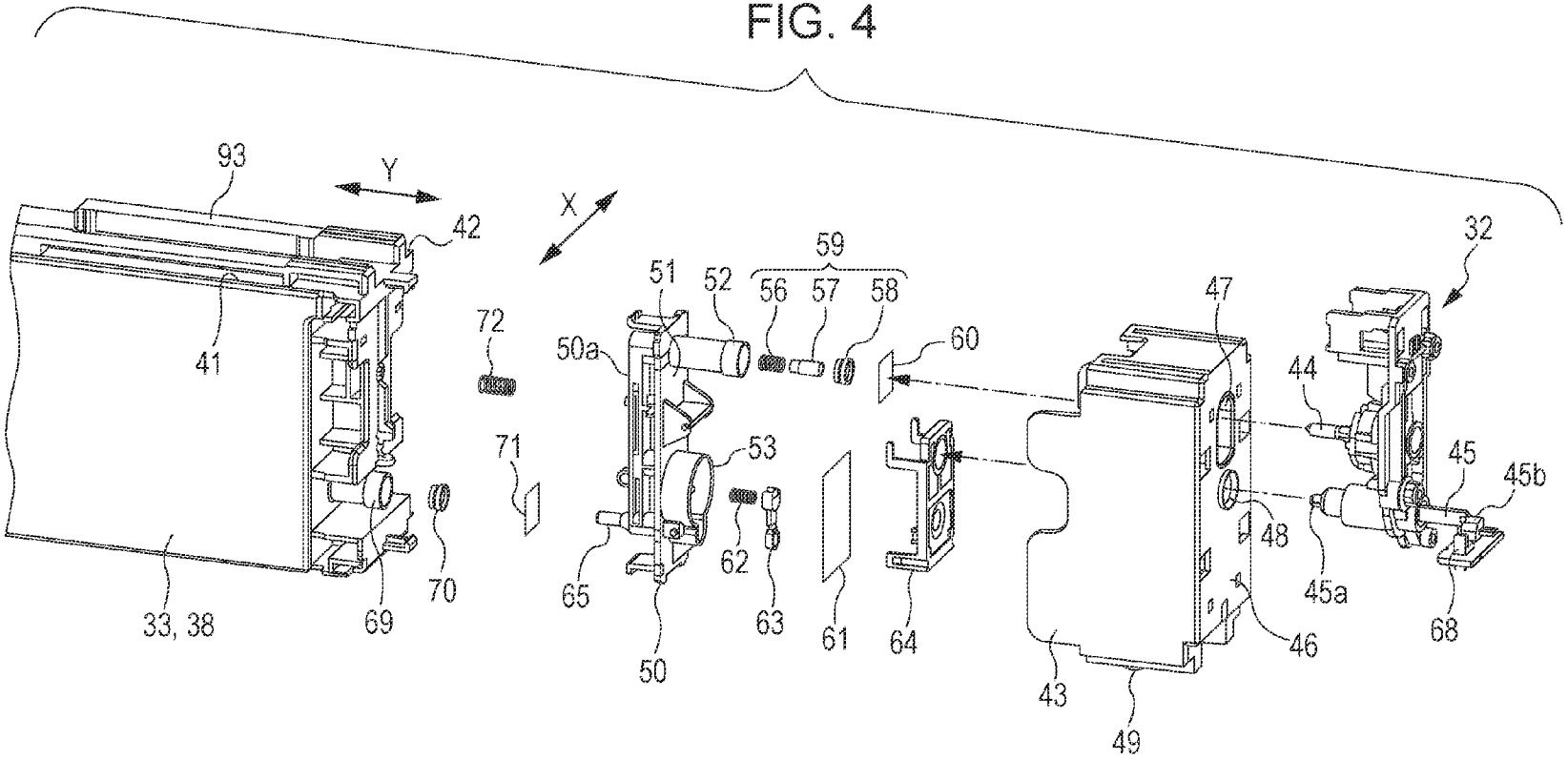
FIG. 4 is an exploded perspective view showing a configuration of a connection portion which is included in the liquid storage container.
Figure 5:
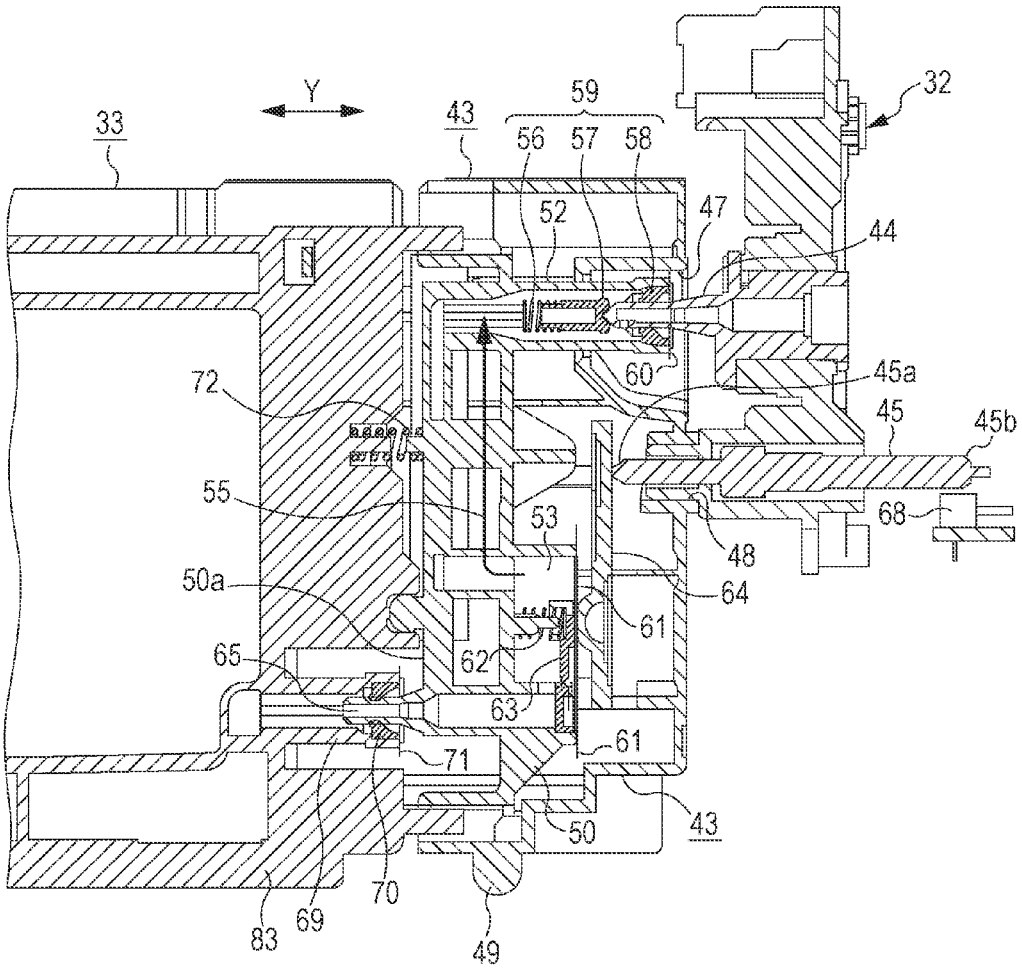
FIG. 5 is a cross-sectional view showing the configuration of the connection portion which is included in the liquid storage container.

As shown FIGS. 4 and 5, the connection portion 43 included in the second storage body portion 38 has an approximately box shaped housing having a bottom, one side of the connection portion is opened, and a bottom wall portion of the connection portion configures an end surface 46 of the supply portion 32 side in the second storage body portion 38 of the liquid storage body 33. Moreover, in the end surface 46 of the connection portion 43, a needle insertion hole 47 through which the supply needle 44 of the supply portion 32 is inserted is formed, and a rod insertion hole 48 through which the remaining amount detection rod 45 is inserted is formed at a position adjacent to the needle insertion hole 47. In addition, a protrusion portion 49 having an approximately columnar shaped surface is formed on the lower surface side of the connection portion 43.

A mounted member 50, which has a predetermined thickness in the direction in which the supply needle 44 is inserted into the needle insertion hole 47 and is formed in an approximately flat plate shape, is provided in the housing of the connection portion 43. In the mounted member 50, an approximately cylindrical outlet 52 to which the supply needle 44 is inserted via the needle insertion hole 47 and an approximately cylindrical liquid chamber 53 are formed on end surface 51 of one side which becomes the supply portion 32 side in the thickness direction of the mounted member. Moreover, as shown in a thick solid-line arrow in FIG. 5, in the mounted member 50, an outlet channel 55 which communicates the liquid chamber 53 and the outlet 52 is formed through. In addition, the mounted member 50 is mounted to be swung to the liquid storage body 33.

Since the supply needle 44 is inserted into the outlet 52 via the needle insertion hole 47, an open-close valve 59, which is configured of a spring 56, a valve member 57 and a packing 58 which suppress the ink supplied from the liquid storage body 33 side from flowing out, is built in the outlet 52. Moreover, in order to prevent the flowing out of the ink before the supply needle 44 is inserted, a seal 60 which covers the opening of the outlet 52 is provided to be welded.

In addition, a flexible film 61 is welded to the liquid chamber 53 to cover the opening of the liquid chamber 53. Accordingly, in the liquid chamber 53, the film 61 is deformed and the volume of the chamber is changed according to pressure change of the inner portion of the chamber. Moreover, a spring 62, which biases the film 61 toward the outside of the liquid chamber 53, is provided in the liquid chamber 53. In addition, a pressure receiving plate 63, which transfers the biasing force of the spring 62 to the film 61, is inserted between the spring 62 and the film 61.

Moreover, a moving member 64 is mounted on the outer surface of the liquid chamber 53 in the mounted member 50. The moving member 64 is configured so as to rotate about a predetermined rotation fulcrum which extends in a horizontal direction (left-right direction X) orthogonal to the longitudinal direction (front-rear direction Y) of the liquid storage body 33, and the moving member 64 contacts the film 61, which configures a portion of the inner surface of the liquid chamber 53, from the outside of the liquid chamber 53.

On the other hand, in an end surface 50*a* of the other side in the thickness direction of the mounted member 50, an approximately cylindrical inlet 65 is formed to protrude in the thickness direction of the mounted member 50. Moreover, an approximately cylindrical lead-out port (lead-out port portion) 69 to which the inlet 65 is inserted is provided to correspond to the inlet 65 in the liquid storage body 33 (second storage body portion 38) side. The inlet 65 is inserted into the lead-out port 69, and thus, the inner portion of the liquid storage body 33 (second storage body portion 38) and the liquid chamber 53 communicate with each other. In addition, a packing 70 which suppresses the ink stored in the liquid storage body 33 from being leaked and flowed out is built in the lead-out port 69, and a seal 71 which covers the opening of the lead-out port 69 is provided to be welded so that the ink is not flowed out from the liquid storage body 33 before the inlet 65 is inserted into the liquid storage body 33 (second storage body portion 38).

In addition, for example, the mounted member 50 is biased to the mounting portion 31 side in the connection portion 43 by a compression spring 72 inserted between the mounted member 50 and the liquid storage body 33 (second storage body portion 38) so as to stabilize the insertion of the supply needle 44 to the outlet 52 or the contacting of the remaining amount detection rod 45 to the moving member 64.

Here, the transfer mechanism will be described with reference to FIG. 5.

As shown in FIG. 5, in the connection portion 43, the film 61 of the liquid chamber 53 is configured to be pushed to increase volume of the liquid chamber 53 via the pressure receiving plate 63 by the spring 62. Accordingly, the ink in the liquid storage body 33 flows into the liquid chamber 53 through the inlet 65 according to the increase of the volume of the liquid chamber 53. Meanwhile, the ink is sucked from the outlet 52 to the supply needle 44 by the supply portion 32, and thus, the ink in the liquid chamber 53 flows out through the outlet channel 55 from the liquid chamber 53. At this time, in the embodiment, since an inner diameter of the outlet channel 55 is set so as to be larger than an inner diameter of the inlet 65, the outflow of the ink from the liquid chamber 53 is smaller than the inflow of the ink to the liquid chamber 53, and thus, the pressure inside the liquid chamber 53 becomes negative pressure. Accordingly, the film 61 is deformed to be drawn into the liquid chamber 53 against the biasing force of the spring 62. Moreover, FIG. 5 shows the state where the film 61 is drawn into the liquid chamber 53.

The ink in the liquid storage body 33 flows into the liquid chamber 53 through the inlet 65, and thus, the negative pressure generated in the liquid chamber 53 is gradually cancelled. Accordingly, the film 61 is pushed to the outside of the liquid chamber 53 by the force of the spring 62 again, and the volume of the liquid chamber 53 is restored. Therefore, after the supply of the ink to the liquid ejecting head 24 in the supply portion 32 stops and a predetermined time elapses, the state is returned to an original state before the supply of the ink to the liquid ejecting head 24 starts. Moreover, if the ink is supplied from the supply portion 32 to the liquid ejecting head 24 side again, the pressure inside the liquid chamber 53 becomes negative pressure, and thus, the film 61 is drawn into the inner side of the liquid chamber 53. Meanwhile, if the ink in the liquid storage body 33 is consumed and is not present, the ink does not flow into the liquid chamber 53 even if the pressure inside the liquid chamber 53 is negative pressure. That is, after the supply of the ink by the supply portion 32 stops and a predetermined time elapses, the negative pressure in the liquid chamber 53 is not cancelled, and thus, the state where the film 61 is drawn into the liquid chamber 53 is maintained.

A spring (not shown) which biases to press the remaining amount detection rod 45 to the moving member 64 is mounted on the remaining amount detection rod 45. Moreover, the other end 45*b* opposite to the one end 45*a* contacting the moving member 64 in the remaining amount detection rod 45 becomes a detection object portion configured of a concave sensor 68. The sensor 68 is a transmissive photosensor, and a light receiving portion and a light emitting portion (both portions are not shown) are provided to be opposite to each other. Presence or absence of the ink in the liquid storage body 33 is detected by detection signals output from the sensor 68.

That is, if the ink in the liquid storage body 33 is not present, since the ink does not flow into the liquid chamber 53 from inside the liquid storage body 33, the state where the film 61 is deformed in the direction in which the volume of the liquid chamber 53 is decreased is maintained. Accordingly, the moving member 64 is pressed by the one end 45*a* of the remaining amount detection rod 45 which is biased by a spring (not shown), the moving member 64 is rotated about the rotation fulcrum, the remaining amount detection rod 45 moves the liquid storage body 33 side, and thus, the other end 45*b* of the remaining amount detection rod 45 is inserted between the light emitting portion and the light receiving portion of the sensor 68. Accordingly, based on the fact that the light is maintained to a block state, the sensor 68 detects that the ink in the liquid storage body 33 is not present.

Next, return to FIGS. 2 and 3, the slider 34 will be described.

As shown in FIG. 3, a filler port (filler port portion) 73 which pours the ink into the liquid storage body 33 is provided on the upper surface 39 of the liquid storage body 33 in the first portion which is positioned outside the printer 11 in the liquid storage body 33. More specifically, the filler port 73 is formed at a position closer to the second surface than the above-described first surface in the first portion. In the embodiment, the first storage body portion 37 corresponds to the first portion, and the filler port 73 is provided in the first storage body portion 37. Moreover, the filler port 73 positioned outside the printer 11 is configured to be covered by the slider 34 so as not to be exposed except during the pouring of the ink.

That is, the slider 34 has an approximately rectangular shape having a longitudinal direction and is formed in an outer shape which is approximately overlapped with the upper surface 39 of the liquid storage body 33. Moreover, when the slider 34 is disposed in a state where one end side of the slider is inserted into the mounting portion 31 and the slider is approximately overlapped with the upper surface 39 of the liquid storage body 33, the upper portion of the filler port 73 of the ink provided in the liquid storage body 33 is configured to be covered by an open-close cover 74 capable being opened and closed. Specifically, the open-close cover 74, which is displaced between the position covering the filler port 73 and the position opening the filler port 73, is provided in the end in the longitudinal direction of the slider 34. Moreover, in descriptions below, unless otherwise mentioned, an "insertion direction" indicates the "insertion direction" of the slider 34 with respect to the mounting portion 31.

In the embodiment, the open-close cover 74 is rotatably and pivotally supported to the slider 34 so that an axis extending in the short direction of the liquid storage body 33 is a rotational center at the position which is positioned at the second storage body portion 38 (second portion) side from the filler port 73 in the state where the open-close cover 74 covers the filler port 73. Accordingly, as shown in two-dot chain lines in FIG. 3, if the filler port 73 is opened, a user lifts the open-close cover 74 which is the front side in the longitudinal direction of the slider 34 and can rotate the open-close cover by approximately 180° toward the printer 11 side which is the second storage body portion 38 side.

As a result, the open-close cover 74 is rotated from the covered state of the filler port 73 shown by solid lines in FIG. 3 to the opened state of the filler port 73 shown by two-dot chain lines in FIG. 3, and thus, the open-close cover can be displaced so as to be positioned at the rear side with respect to the filler port 73. Moreover, in the embodiment, the filler port 73 is positioned near the end of the front side in the first storage body portion 37 of the liquid storage body 33, and thus, the length of the open-close cover 74 in the front-rear direction Y required to cover the filler port 73 is configured so as not to be long.

In addition, in an end 34*a* of the slider 34 of the inner side in the insertion direction to the mounting portion 31, a holder 76, which is an example of a memory unit holding member capable of placing a circuit substrate 75, is provided so as to be mounted on the slider 34, and the circuit substrate 75 mounts a memory recorded with relevant information related to the ink poured from the filler port 73 to the liquid storage body 33. Moreover, when the slider 34 is inserted into the mounting portion 31 in the state where the slider 34 is overlapped with the upper surface 39 of the liquid storage body 33, the circuit substrate 75 mounted on the holder 76 can engage with the communication portion 77 provided in the mounting portion 31 side of the printer 11. Due to the engagement between the circuit substrate 75 and the communication portion 77, a contact portion which is included in a terminal formed in the circuit substrate 75 placed on the holder 76 contacts and is electrically connected to an electric terminal 78 included in the communication portion 77. As a result, the relevant information recorded in the memory mounted in the circuit substrate 75 is transferred to the printer 11 side.

Moreover, in the printer 11 of the embodiment, if the slider 34 is inserted into the mounting portion 31 of the printer 11 in the state where the slider 34 is overlapped with the upper surface 39 of the liquid storage body 33, the slider 34 is positioned in the printer 11 along with the connection portion 43 by a pair of plate springs 79 mounted on the mounting portion 31.

That is, as shown in FIG. 2, the plate springs 79 have an inclined shape in which the gap between the plate springs is narrowed in the insertion direction to the upper frame 35 and the lower frame 36 in the vertical direction, and the plate springs 79 are fixed by screws. Moreover, the plate spring 79 of the upper frame 35 abuts a protrusion portion 80 which is provided in the circuit substrate holder 76 included in the slider 34 in a state where the plate spring 79 is biased to the protrusion portion 80, and the plate spring 79 of the lower frame 36 abuts a protrusion portion 49 (refer to FIG. 5) which is provided in the connection portion 43 in a state where the plate spring 79 is biased to the protrusion portion 49. As a result, the slider 34 (circuit substrate holder 76) and the connection portion 43 is positioned by the pair of plate springs 79 in the up-down direction Z.

Moreover, the slider 34 and the second storage body portion 38 of the liquid storage body 33, which are inserted in the state of being overlapped with the liquid storage body 33, are positioned in the mounting portion 31. That is, as shown in FIG. 2, a guide groove (not shown) is provided on the lower surface of the upper frame 35 of the mounting portion 31, and a convex portion 82 which extends along the longitudinal direction on the upper surface side of the slider 34 is in sliding contact with the guide groove and is inserted into the guide groove. Moreover, a guide groove 84 is provided on the upper surface of the lower frame 36 of the mounting portion 31, and a convex portion 83 (refer to FIGS. 5 and 23), which extends along the longitudinal direction in the lower surface side of the liquid storage body 33, engages with the guide groove 84. Accordingly, the slider 34 and the second storage body portion 38 are positioned in the short directions respectively due to the engagement between the convex portion and the guide groove. As a result, the slider 34 (and the circuit substrate holder 76 mounted on the slider 34) and the connection portion 43 included in the second storage body portion 38 are positioned in the short direction respectively. That is, in a state where the liquid storage container 21 is mounted to the printer 11 (mounting portion 31) (in a state where the ink is supplied from the liquid storage container 21 to the printer 11), the circuit substrate 75 and the circuit substrate holder 76 are positioned at the second portion.

Then, in the liquid storage container 21 of the embodiment, the circuit substrate holder 76 and the open-close cover 74 included in the slider 34 are detachably mounted to the slider 34. Moreover, in the state where the circuit substrate holder 76 and the open-close cover 74 are mounted to the slider 34, the slider 34 is configured to slide to the upper surface 39 of the liquid storage body 33. In other words, in the state where the liquid storage body 33 is fixed to the printer 11, the slider 34 is configured to be inserted into and extracted from the mounting portion 31.

Moreover, with reference to FIGS. 6A and 6B, the configuration of the slider 34 will be described in detail.

Figure 6A:
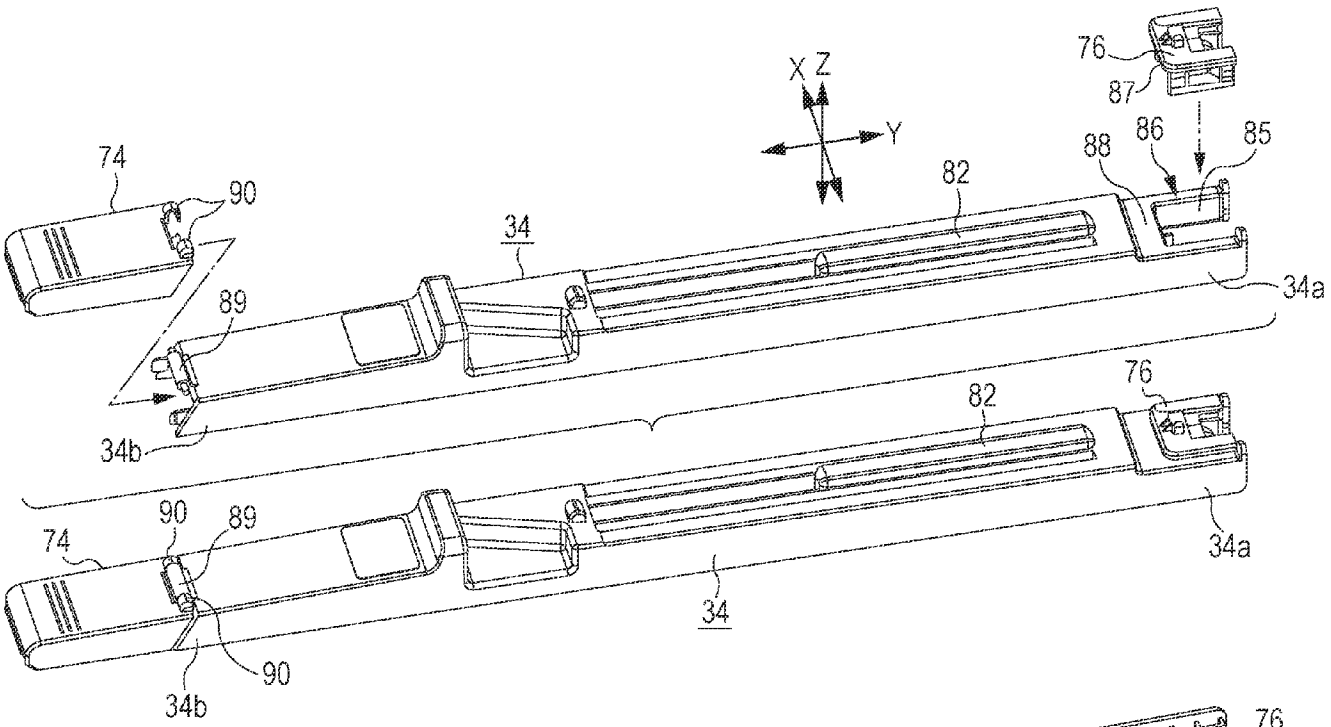
FIG. 6A is an exploded perspective view showing a configuration of the slider.

As shown in FIG. 6A, a holder mounting portion 86 is formed in the slider 34, and the holder mounting portion 86 includes an approximately U shaped opening 85 in which the inner side in the insertion direction is cut out in the end 34*a* of the inner side in the insertion direction to the mounting portion 31. Accordingly, the holder mounting portion 86 is positioned at the second position in the state where the liquid storage container 21 to which the slider 34 is mounted is mounted to the printer 11. The circuit substrate holder 76 can be inserted into and extracted from the opening 85 in the direction which intersects the insertion direction of the slider 34, that is, the sliding direction. In the embodiment, a collar shaped portion 87 provided on the upper side in the circuit substrate holder 76 is inserted and mounted to the opening 85 from the above, which is the side opposite to the liquid storage body 33 in the slider 34, so as to abut an approximately C shape of upper surface 88 which forms the opening 85 of the holder mounting portion 86. Moreover, the circuit substrate holder 76 is extracted from the holder mounting portion 86 to the above and is removed from the slider 34.

Meanwhile, a rotation axis 89 is formed in the end 34*b* of the front side in the insertion direction to the mounting portion 31 in the slider 34, bearing portions 90 formed in the open-close cover 74 are fitted to the rotation axis 89, and thus, the open-close cover 74 is mounted to be rotated (to be swung) to the slider 34.

In this way, in the state where the slider 34 of the embodiment, to which the circuit substrate holder 76 and the open-close cover 74 are mounted, is overlapped with the liquid storage body 33, the slider 34 can slide along the longitudinal direction (front-rear direction Y) of the liquid storage body 33 while abutting both end in the width direction which is the short direction (left-right direction X) of the liquid storage body 33 on the upper surface 39 of the liquid storage body 33.

Figure 6B:
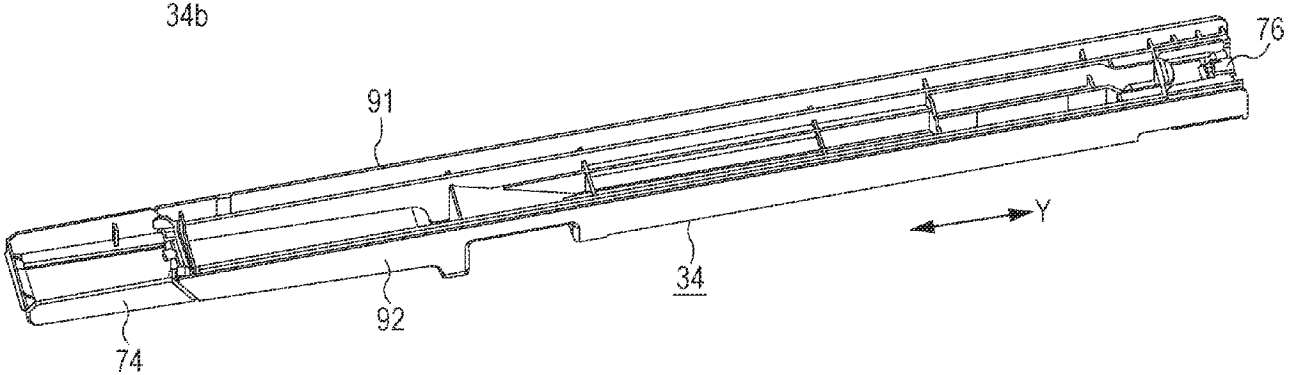
FIG. 6B is a perspective view showing a rear surface side of the slider.

Specifically, as shown in FIG. 6B, linear rib shaped side walls 91 and 92 are formed respectively on the lower surface side of the slider 34 overlapped with the upper surface 39 of the liquid storage body 33, and the side walls extend in the longitudinal direction in both ends in the width direction which intersects the longitudinal direction. On the other hand, linear flat surface portions 41 and 42 are formed on both side ends in the width direction which intersects the longitudinal direction on the upper surface 39 of the liquid storage body 33, and the flat surface portions are abutment surfaces which abut the side walls 91 and 92 respectively and extend along the longitudinal direction. Accordingly, the side walls 91 and 92 formed on the slider 34 can move(slide) along the longitudinal direction while abutting the flat surface portions 41 and 42, which are formed on the upper surface 39 of the liquid storage body 33, respectively.

That is, as shown in FIGS. 2 and 3, a plurality of convex portions 93 which are adjacent on the inner side with respect to the flat surface portions 41 and 42 are formed along the longitudinal direction on the upper surface 39 of the liquid storage body 33. Therefore, the movement in the width direction (left-right direction X) of the slider 34 is regulated by a plurality of convex portions 93, and thus, the slider 34 stably moves (slides) along the longitudinal direction (front-rear direction Y) with respect to the liquid storage body 33.

Then, in the printer 11 of the embodiment, a slide knob 94 provided to be slidable in the vertical direction is provided on the upper side of the liquid storage container 21 fixed to the printer 11 in the state where at least a portion of the second storage body portion 38 is positioned in the mounting portion 31. The slide knob 94 provided in the printer 11 is displaced from the upper side to the lower side, and thus, the slide knob 94 engages with a concave portion 95 provided on the upper surface of the slider 34, and the movement (sliding) of the slider 34 in the direction extracted from the mounting portion 31 along the longitudinal direction is regulated. Therefore, if a user moves the slide knob 94 from the lower side to the upper side, the engagement between the slide knob 94 and the concave portion 95 is released, and the slider 34 can be extracted from the mounting portion 31. Moreover, in this state, the user slides the slider 34 with respect to the liquid storage body 33, and the slider 34 can be inserted into and extracted from the mounting portion 31. In addition, in the embodiment, a finger hooking portion 96 which protrudes along the short direction is formed on the upper surface side of the slider 34, and due to the finger hooking portion 96, the user easily inserts and extracts the slider 34.

Moreover, in the present embodiment, the circuit substrate 75 placed on the circuit substrate holder 76 is placed so as to be replaceable. This configuration will be described with reference to FIGS. 7A and 7B. Moreover, FIGS. 7A and 7B show a state where the circuit substrate holder 76 is removed from the slider 34.

Figure 7A:
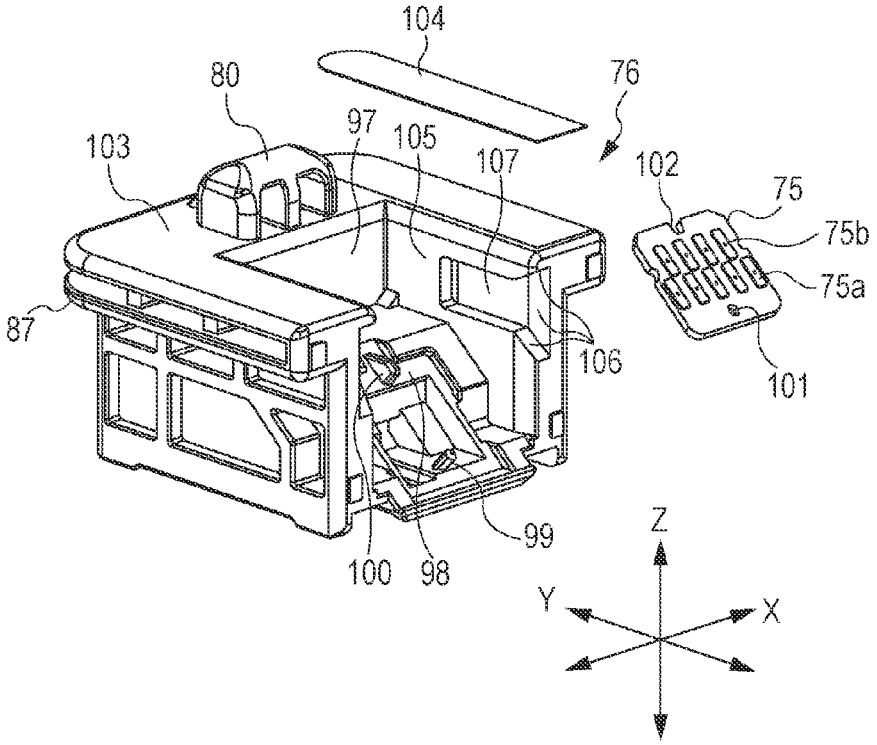
FIG. 7A is an exploded perspective view showing a configuration of a circuit substrate holder.

As shown in FIG. 7A, the circuit substrate holder 76 is configured of a plurality of walls. A concave portion 97 is provided in the circuit substrate holder 76, and in the concave portion 97, both of the inner side and the upper side in the insertion direction of the slider 34 are opened with respect the mounting portion 31 in the state where the circuit substrate holder is assembled to the slider 34, and an inclined surface 98 descending toward the insertion direction is provided in the concave portion 97. A plate shaped rib 100 in which the insertion direction with respect to the mounting portion 31 is the longitudinal direction is formed on the upper end side of the inclined surface 98 while a columnar boss 99 is formed on the lower end side of the inclined surface 98. All or any one of the inclined surface 98, the columnar boss 99, and the rib 100 are referred to as a support portion.

On the other hand, in the embodiment, the circuit substrate 75 placed on the circuit substrate holder 76 has an approximately rectangular shape, and a plurality of (here, nine) terminals (including the contact portion 75*b*) 75*a* in which the insertion directions are the longitudinal directions are provided on the surface of the circuit substrate 75. Moreover, in the circuit substrate 75, a round hole 101 is formed at one end which becomes the front and rear in the insertion direction of the plurality of terminals (including the contact portion 75*b*) 75*a*, and a slit 102 is formed at the other end. In addition, the boss 99 provided in the circuit substrate holder 76 is inserted into the round hole 101 formed on the circuit substrate 75, and according to this insertion, the rib 100 provided in the circuit substrate holder 76 is inserted into the slit 102 provided in the circuit substrate 75. Accordingly, the circuit substrate 75 is placed in the state where the circuit substrate is inclined in the horizontal direction on the inclined surface 98 of the circuit substrate holder 76. Moreover, even if the circuit substrate holder 76 is disposed on the plane with any posture (arbitrary posture), the circuit substrate 75 is supported by the circuit substrate holder 76 so that the walls further protrude in the gravity direction than the circuit substrate 75. An identification seal 104 (identification label) which identifies the placed circuit substrate 75 is attached to at least a portion of an upper surface 103 of the circuit substrate holder 76 of the embodiment. The color of the identification seal 104 is the same as either the color of the liquid stored in the liquid storage container 21 corresponding to the circuit substrate holder 76 or the color of the liquid stored in a liquid pouring source 126 described below.

Figure 7B:
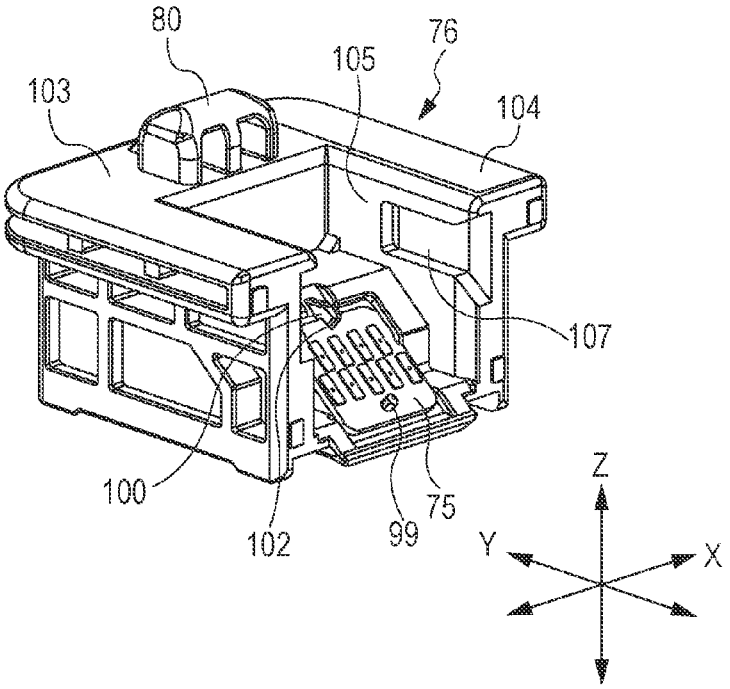
FIG. 7B is a perspective view of the circuit substrate holder on which a circuit substrate is placed.

As shown in FIG. 7B, in the state where the circuit substrate 75 is placed on the circuit substrate holder 76, the rotation of the circuit substrate 75 about the boss 99 in the inclined surface 98 is regulated by the rib 100. Moreover, slight gaps are provided between the round hole 101 and the boss 99 and between the slit 102 and the rib 100 respectively, and thus, the placed circuit substrate 75 can be removed from the circuit substrate holder 76.

Moreover, groove shaped portions 107 are provided in the circuit substrate holder 76, and in FIGS. 7A and 7B, only one groove shaped portion 107 is shown. The groove shaped portions 107 extend in the insertion direction on the side walls 105 formed respectively on both sides in the left-right direction X intersecting the insertion direction with respect to the mounting portion 31 in the concave portion 97, and chamfered portions 106 are formed on the insertion direction side ends of the groove shaped portions 176. Moreover, the protrusion portion 80, which abuts the plate spring 79 provided on the upper frame 35, is formed on the upper surface 103 of the circuit substrate holder 76.

Next, the configuration of the open-close cover 74 will be described with reference to FIGS. 8A to 8C. In the embodiment, the open-close cover 74 is detachably mounted to slider 34, a load is applied to the rotation about the rotation axis 89 in the closed cover position of the filler port 73, and thus, the rotation is suppressed.

Figure 8A:
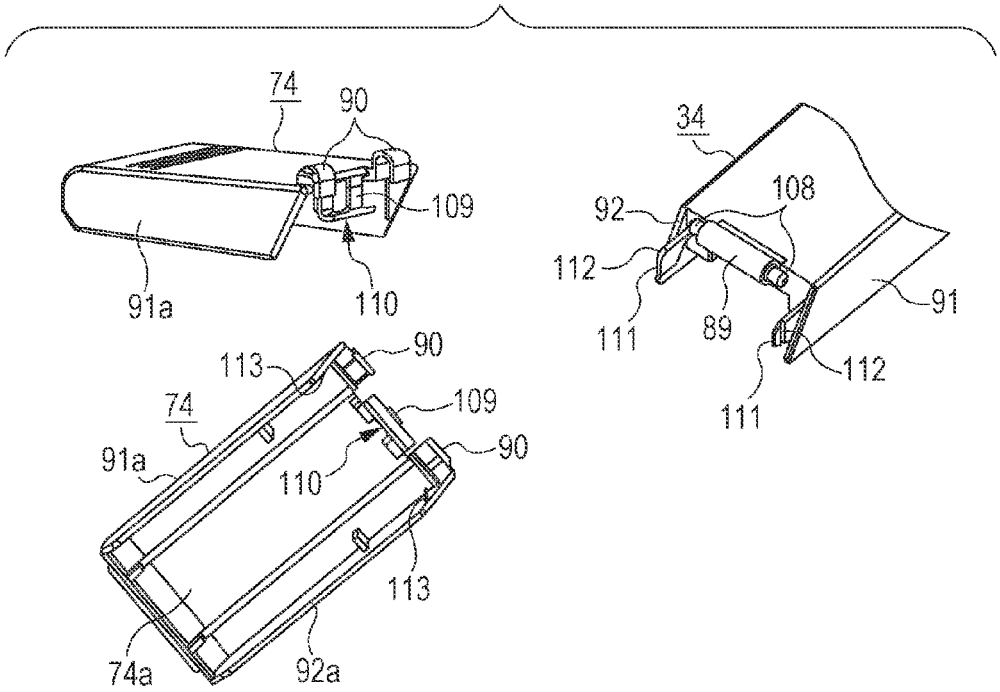
FIG. 8A is a perspective view showing a configuration of an open-close cover.

As shown in FIG. 8A, the open-close cover 74 includes two bearing portions 90 which engage with the axial ends 108 of both sides of the rotation axis 89 provided in the slider 34 and have an approximately semi cylindrical shape, and an abutment portion 109 which abuts an approximately center portion in the axial direction of the rotation axis 89 from the direction opposite to the bearing portions 90. A hook portion 110, which includes two plate shaped portions having flexibility which is formed to protrude from the inner surface (rear surface 74*a*) side opposite to the filler port 73 in the open-close cover 74 and has an approximately J shape when viewed in the short direction, is provided, and the abutment portion 109 is provided at the tip of the hook shape. Moreover, when two bearing portions 90 engage with the axial ends 108 of the rotation axis 89, after the abutment portion 109 is displaced according to bending displacement of the hook portion 110 due to the rotation axis 89, the abutment portion is engaged to approximately abut the rotation axis 89 by recovering of the bending displacement in the state where the bearing portions 90 engage with the axial ends 108 of the rotation axis 89. Accordingly, the open-close cover 74 is configured to be rotatably and pivotally supported to the rotation axis 89.

Moreover, extension portions 111, which extend in the longitudinal direction in the side walls 91 and 92 of the both sides in the short direction, are provided in the slider 34 respectively. Grooves 112 are formed along the vertical direction in the extension portions 111. Meanwhile, in cover side walls 91*a* and 92*a* which configure a portion of the side walls 91 and 92 of the slider 34 in the open-close cover 74, convex portions 113 capable of locking the grooves 112 are formed at positions corresponding to grooves 112 in the state where the open-close cover 74 mounted to the liquid storage body 33 covers the filler port 73.

Figure 8B:
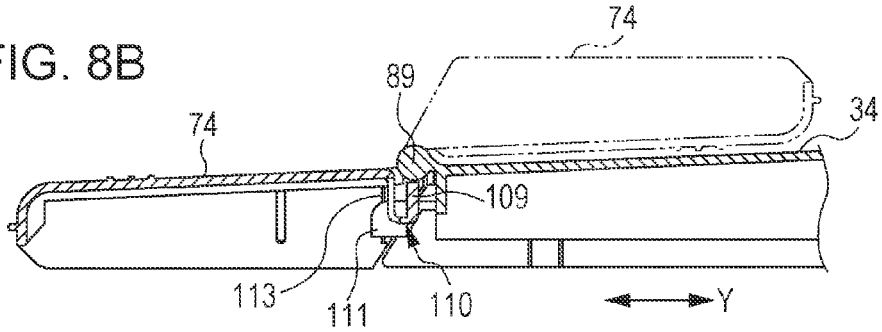
FIG. 8B is a cross-sectional view showing a state where the open-close cover is mounted on the slider.
Figure 8C:
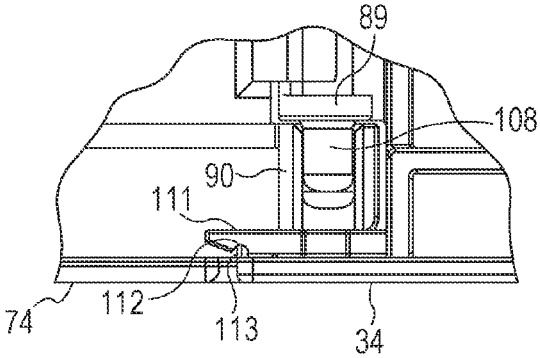
FIG. 8C is a partially enlarged view showing a configuration of an engagement portion.

That is, as shown FIGS. 8B and 8C, the open-close cover 74 is incorporated to the slider 34 in the state where the bearing portions 90 and the abutment portion 109 are engaged with the rotation axis 89 of the slider 34. When the incorporated open-close cover 74 is at a closed cover position which covers the filler port 73, the convex portions 113 formed on the cover side walls 91*a* and 92*a* overlap with the grooves 112 when viewed in the short direction and are engaged to enter the grooves 112. Accordingly, as shown in two-dot chain lines in FIG. 8B, when the open-close cover 74 is rotated about the rotation axis 89 and is displaced to the opened cover position of the filler port 73, a rotation load is generated with respect to the open-close cover 74. Due to the above-described matters, the grooves 112 of the slider 34 engage with the open-close cover 74, and serves as an example of the engagement portion which suppresses the displacement from the closed cover position to the open cover position.

Next, a peripheral configuration of the filler port 73 in the liquid storage container 21 will be described.

Figure 9A:
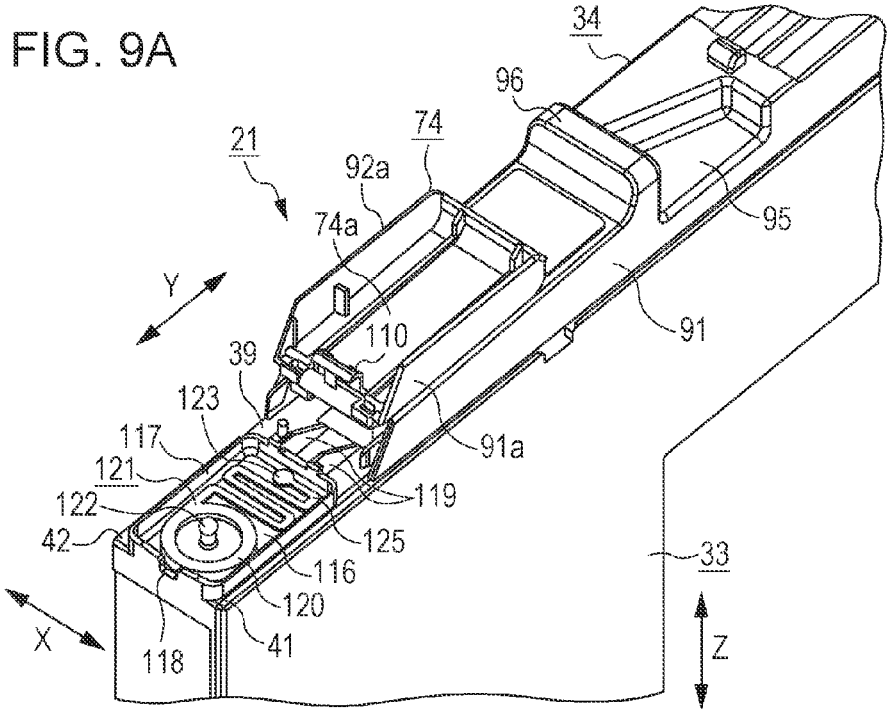
FIG. 9A is a perspective view showing a state where a filler port is covered by a covering body in the liquid storage container in which the open-close cover is positioned at an opened cover position.

As shown in FIG. 9A, a liquid receiving surface 116 is formed at the front side portion on the upper surface 39 of the liquid storage body 33, and the liquid receiving surface 116 is an example of the liquid receiving portion which extends in the directions intersecting the up-down direction Z. The liquid receiving surface 116 has an approximately rectangular shape in a plan view, and the width size of the liquid receiving surface in the left-right direction X is slightly smaller than the width size in the left-right direction X of the liquid storage body 33.

In addition, peripheral walls 117 are formed on the upper surface 39 of the liquid storage body 33 and protrude in the up direction (antigravity direction) intersecting the liquid receiving surface 116 so as to surround the periphery of the liquid receiving surface 116. Moreover, a cut out groove 118 which is further recessed downward than other portions of the peripheral walls 117 is formed on the front side wall portion of the peripheral walls 117 at an approximately center portion in the left-right direction X. That is, in the embodiment, the cut out groove 118 which is an example of the concave portion is formed on the peripheral walls 117 which is an example of the peripheral positions of the filler port 73. On the other hand, a pair of reinforced ribs 119 which intersect the wall portions and extend rearward are formed on the rear side wall portion of the peripheral walls 117.

Figure 9B:
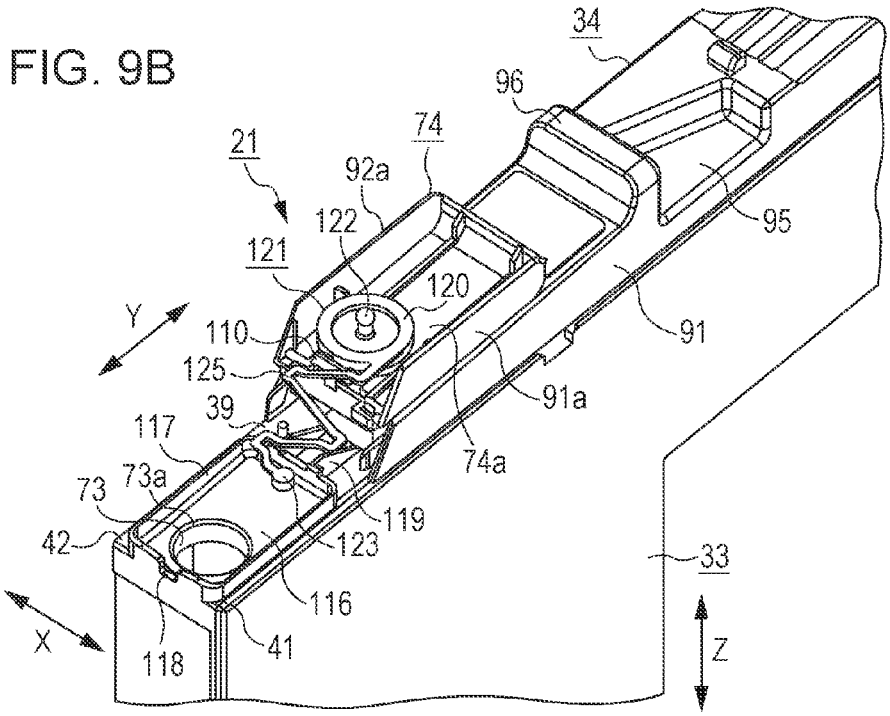
FIG. 9B is a perspective view showing a state where the covering body is removed from the filler port in the storage container in which the open-close cover is positioned at the opened cover position.

In addition, a covering member 121 is placed on the liquid receiving surface 116 and includes a covering body 120 which has an approximately cylindrical shape and can cover or open the filler port 73 (refer to FIG. 9B). A knob portion 122 having an approximately columnar shape, which protrudes upward from the upper surface of the covering body 120, is formed on the covering body 120. The knob portion 122 becomes a portion which is grasped when the user removes the covering body 120 from the filler port 73 or conversely covers the filler port 73 by the covering body 120.

Moreover, in the state shown in FIG. 9A, the covering member 121 includes a fixing portion 123 for fixing the covering member 121 to the liquid receiving surface 116 at the rear side opposite to the first side which includes the covering body 120. A fixing hole 124 (refer to FIG. 10) is formed to be opened to the liquid receiving surface 116, and the fixing portion 123 can rotate with the axis of the fixing hole 124 as the rotational center and is fixed so as not be detached from the liquid receiving surface 116. Accordingly, the covering member 121 can rotate to the liquid receiving surface 116 with the fixing portion 123 as the rotational center and is not easily removed from the liquid receiving surface 116. However, the covering member 121 can be exchanged with a new covering member 121 which includes the fixing portion 123.

Moreover, the covering member 121 includes a connecting portion 125 which connects the covering body 120 and the fixing portion 123 while being bent by a plurality of times (three times in the left-right direction X in the embodiment) in the direction intersecting the up-down direction Z in the state where the covering member 121 is placed on the liquid receiving surface 116. The cross-sectional shape in the extension direction of the connecting portion 125 is a rectangular shape, and in the rectangular cross-sectional shape, the length along the liquid receiving surface 116 is longer than the length in the direction (up-down direction Z) intersecting the liquid receiving surface 116. Accordingly, if the connecting portion 125 is placed on the liquid receiving surface 116, a contact area between the connecting portion 125 and the liquid receiving surface 116 is increased, and thus, the connecting portion 125 is stably placed on the liquid receiving surface 116.

Moreover, the covering body 120, the connecting portion 125, and the fixing portion 123 which configure the covering member 121 are formed of elastomer such as rubber or resin, or the like, and thus, can be elastically deformed. Accordingly, in the state shown in FIG. 9A, the covering body 120 is fitted to the filler port 73 in the state where the covering body 120 is elastically deformed, and thus, the filler port 73 is covered so that a gap is not generated between the covering body 120 and the filler port 73.

As shown in FIG. 9A, the covering body 120 removed from the filler port 73 can be replaced on the rear surface 74*a* (an example of a bottom surface) of the open-close cover 74 which is at the opened cover position. Moreover, since the area of the rear surface 74*a* of the open-close cover 74 is larger than a projected area if the covering body 120 is projected in the direction along the up-down direction Z, the covering body 120 can be more stably placed.

In addition, the rear surface 74*a* of the open-close cover 74 includes a surface which is inclined downward toward the front side at which the filler port 73 is positioned, in the state (the state shown in FIG. 9A) where the open-close cover 74 is positioned at the opened cover position. Moreover, the cover side walls 91*a* and 92*a* faces upward in both side ends of the rear surface 74*a* of the open-close cover 74 which is positioned at the opened cover position. Accordingly, when the covering body 120, in which the ink is attached to the rear surface 74*a* of the open-close cover 74 positioned at the opened cover position, is placed, the cover side walls 91*a* and 92*a* serve as an example of a shielding portion which suppresses the ink from being leaked from the open-close cover 74 to the outside.

FIG. 9B shows the liquid storage container 21 in a state where the covering body 120 is removed from the filler port 73 and the covering body 120 is placed on the rear surface 74*a* of the open-close cover 74. As shown in FIG. 9B, the filler port 73 which is formed to be opened at a portion of the liquid receiving surface 116 is exposed, and thus, the user can pour the ink to the inner portion (first ink chamber 151 (refer to FIG. 14)) of the liquid storage body 33 through the filler port 73. Moreover, an opening edge 73*a* which becomes the upper end edge of the filler port 73 is formed in an inclined shape by chamfering, and thus, the ink easily flows into the filler port 73 when the ink is poured.

In addition, as shown in FIG. 9B, the length of the connecting portion 125 of the covering member 121 becomes only the length capable of placing the covering body 120 into the rear surface 74*a* of the open-close cover 74 positioned at the opened cover position. Moreover, in the state shown in FIG. 9B, although the connecting portion 125 is slightly extended, the covering body 120 is placed on the rear surface 74*a* of the open-close cover 74 and abuts the hook portion 110 of the open-close cover 74.

Figure 10:
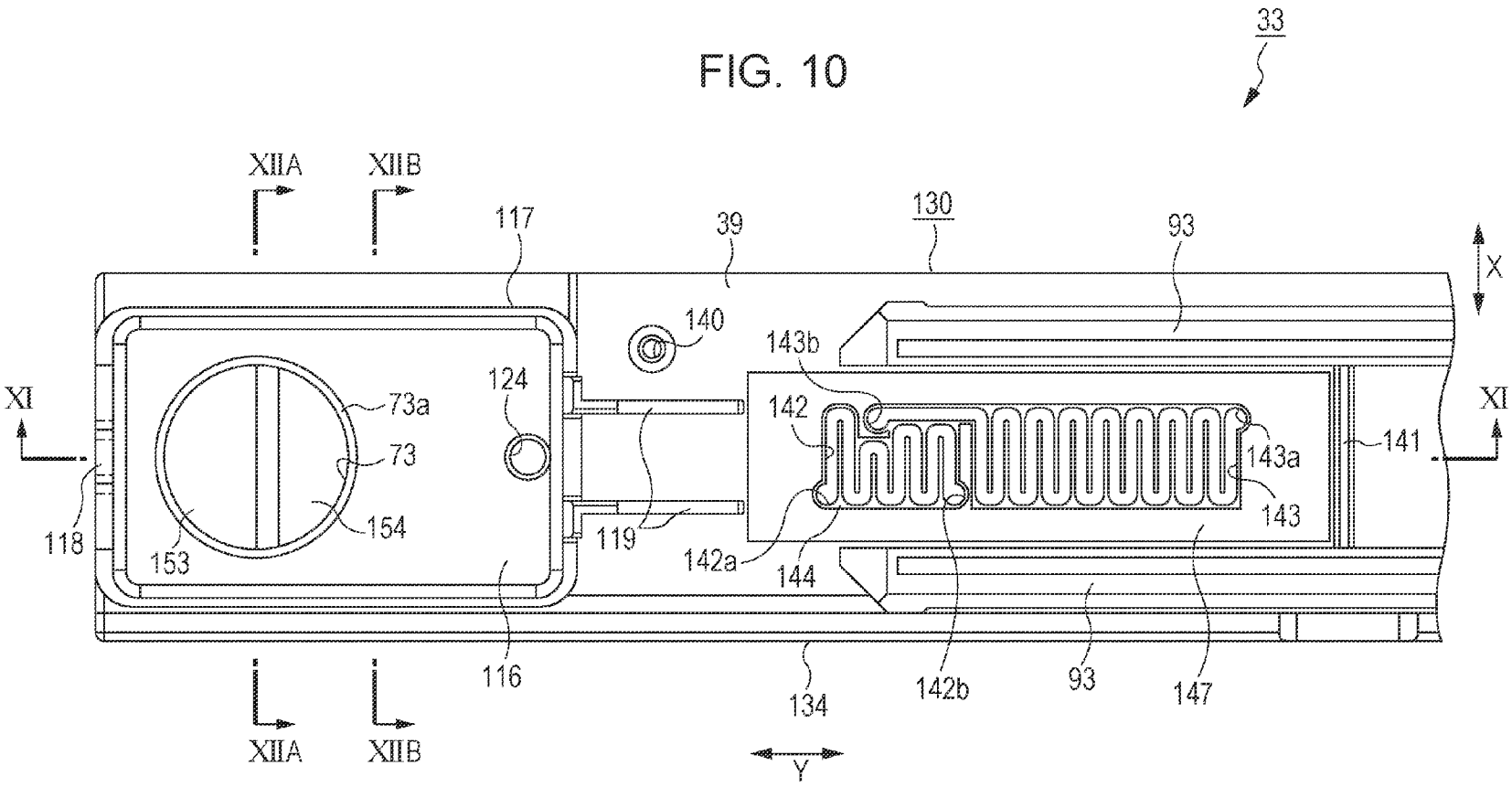
FIG. 10 is a plan view of a liquid storage body.

As shown in FIG. 10, in the vicinity of the wall portion of the rear side (right side in FIG. 10) of the peripheral walls 117 in the liquid receiving surface 116, the fixing hole 124 to which the fixing portion 123 of the covering member 121 is inserted and fixed is formed to be opened in the direction intersecting the liquid receiving surface 116. The fixing hole 124 is provided so that the center position in the left-right direction X of the fixing hole 124 approximately coincides with the center position in the left-right direction X of the filler port 73. In addition, similar to the filler port 73, the fixing hole 124 is formed to be opened on the liquid receiving surface 116. However, the fixing hole does not communicate with the first ink chamber 151.

Figure 11:
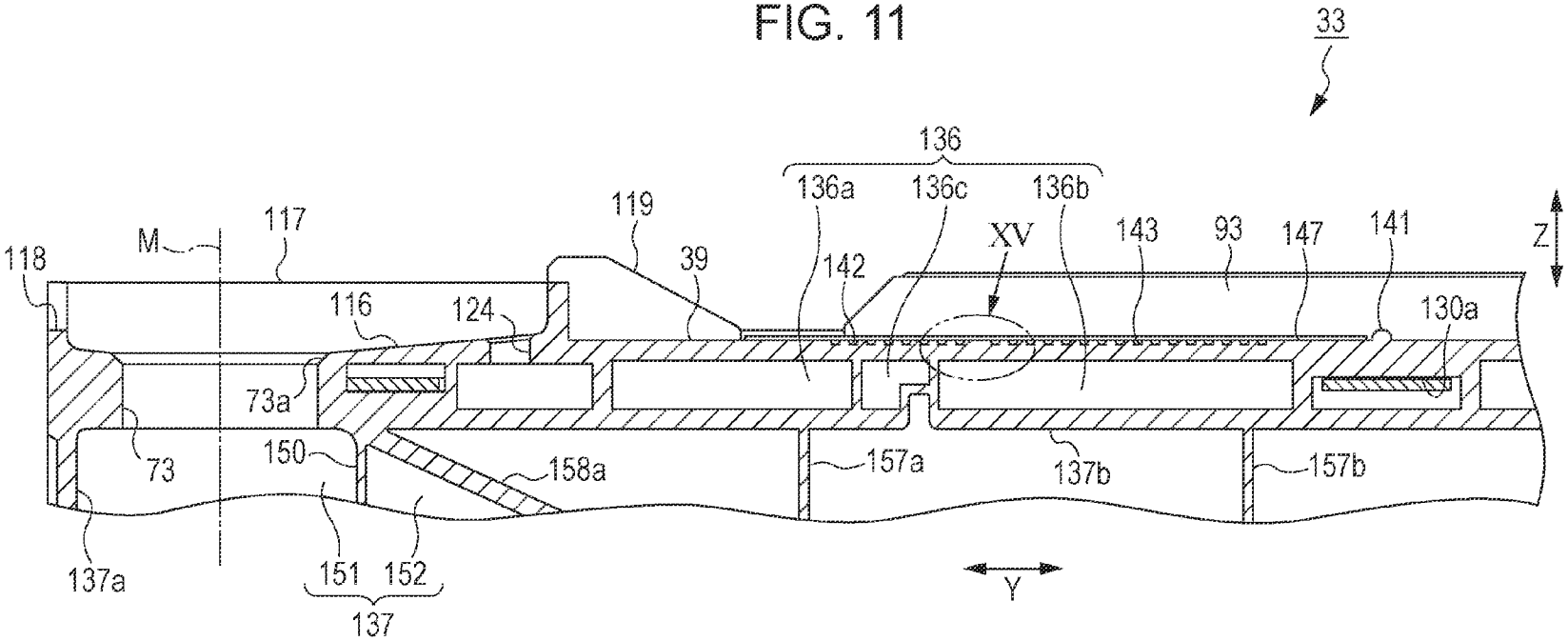
FIG. 11 shows a cross-sectional structure of the liquid storage body and is a cross-sectional view taken along line XI-XI of FIG. 10.

As shown in FIG. 11, the liquid receiving surface 116 is formed so as to be inclined downward (the gravity direction) toward the filler port 73 in the front-rear direction Y. Accordingly, the vicinity of the fixing hole 124, which is the position away from the filler port 73, becomes the highest position on the liquid receiving surface 116. That is, since the fixing portion 123 of the covering member 121 which is fixed to the fixing hole 124 is positioned at the higher position than the periphery of the filler port 73 in the liquid receiving surface 116, even though the ink flows onto the liquid receiving surface 116 when the ink is poured into the filler port 73 or the like, the ink is not easily attached to the liquid receiving surface 116.

Figure 12A:
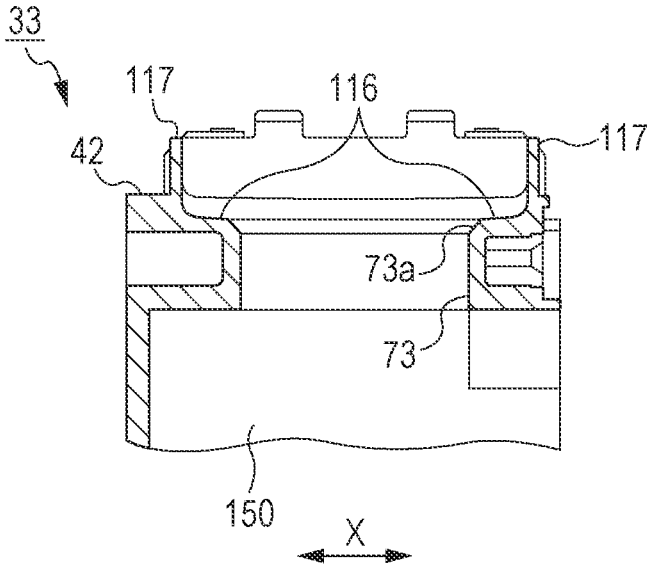
FIG. 12A shows the cross-sectional structure of the liquid storage body and is a cross-sectional view taken along line XIIA-XIIA of FIG. 10.
Figure 12B:
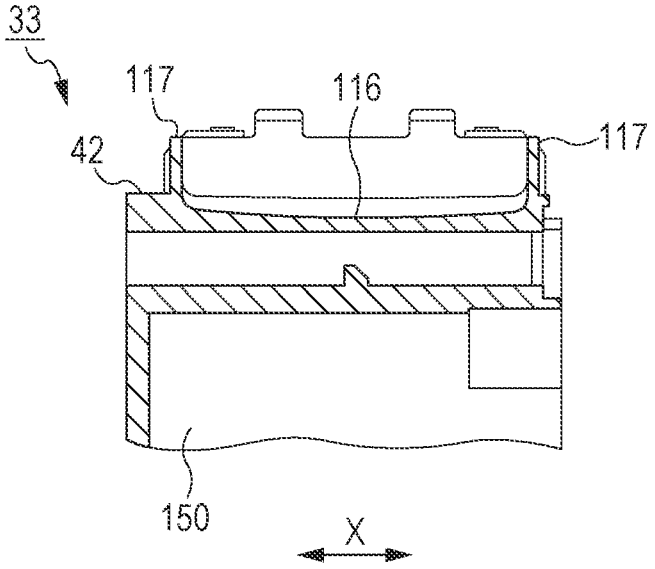
FIG. 12B shows the cross-sectional structure of the liquid storage body and is a cross-sectional view taken along line XIIB-XIIB of FIG. 10.

In addition, as shown in FIG. 12A, the liquid receiving surface 116 is formed so as to be inclined downward toward the filler port 73 also in the left-right direction X. Moreover, as shown in FIG. 12B, the liquid receiving surface 116 is formed so as to be inclined downward toward the center in the left-right direction X at the position close to the fixing hole 124 away from the filler port 73.

Next, the internal configuration of the liquid storage body 33 will be described.

Figure 13:
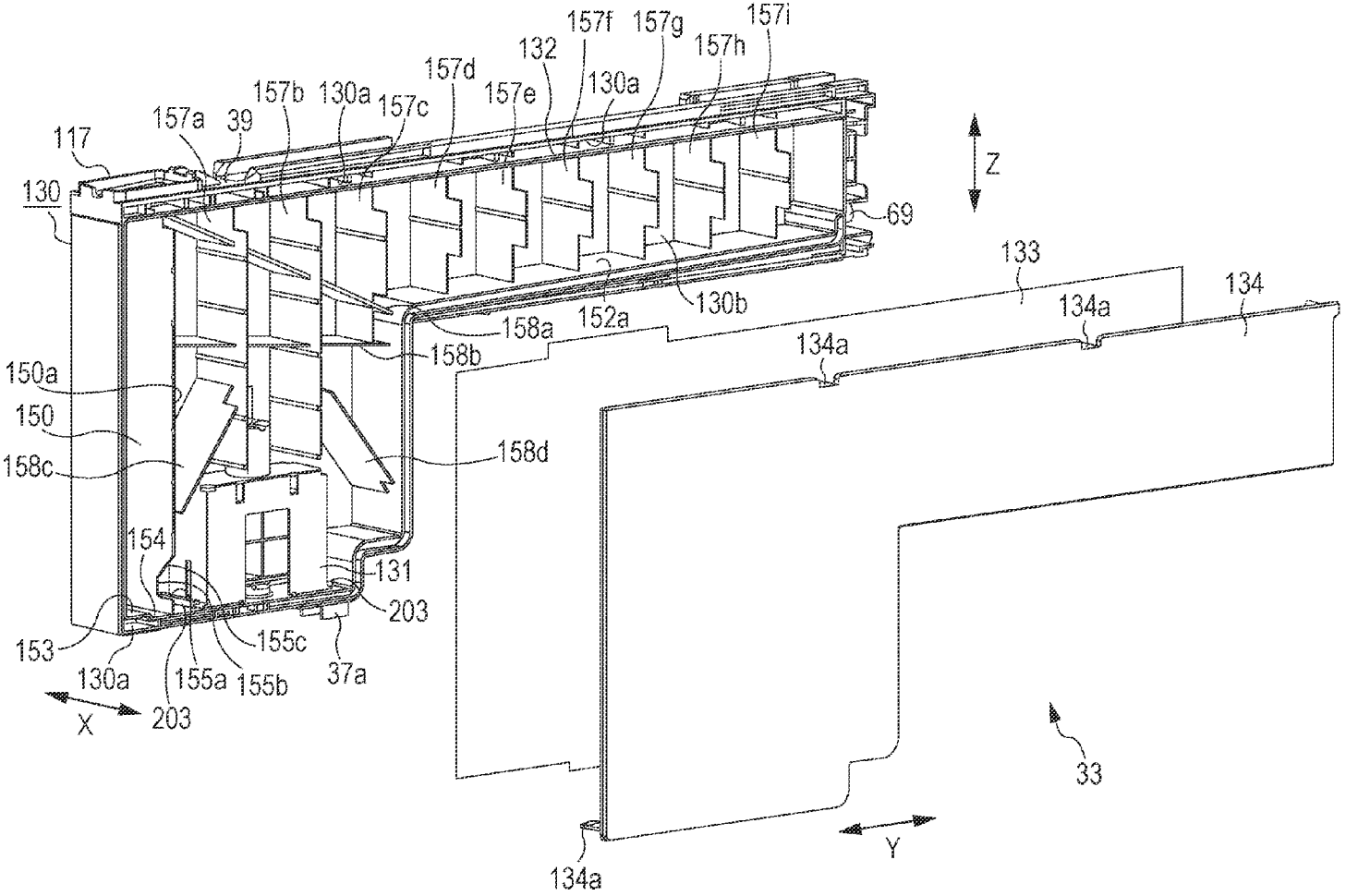
FIG. 13 is an exploded perspective view of the liquid storage body.

As shown in FIG. 13, the liquid storage body 33 includes the storage body case 130 which has an approximately L shape in a side view when is viewed in the left-right direction X, a float valve 131 which is one kind of valve mechanism accommodated in the storage body case 130, a film 133 which is adhered (for example, heat welded) to a case opening 132 of the storage body case 130, and a resin-made cover 134 which covers the case opening 132 over the film 133. Moreover, the storage body case 130 is integrally molded so that the left surface of the storage body case is opened, and locking portions 130*a* which lock pieces 134*a* formed on the cover 134 are formed outside the case opening 132 having an annular shape.

Figure 14:
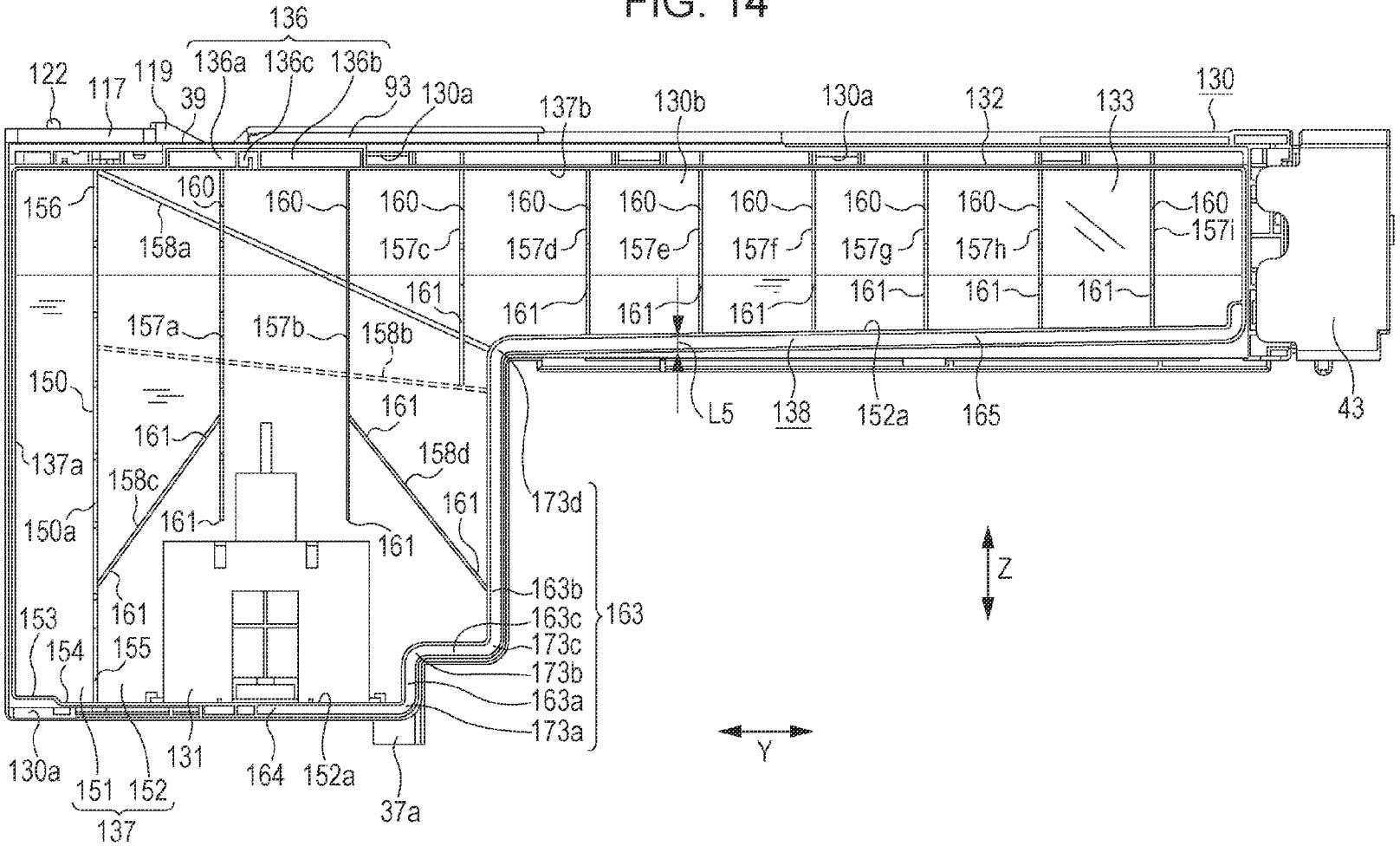
FIG. 14 is a side view of a storage body case to which a film is adhered.

As shown in FIG. 14, if the film 133 is adhered to the case opening 132 of the storage body case 130, a space area which is surrounded by the storage body case 130 and the film 133 serves as an air chamber 136 which communicate with the atmosphere, an ink chamber 137 which is an example of a liquid storage chamber storing the ink, and an outlet channel 138 which is an example of the liquid channel. Moreover, one end of the outlet channel 138 communicates with the ink chamber 137, and the lead-out port 69 (refer to FIGS. 4 and 5), which leads out the ink stored in the ink chamber 137 to the liquid ejecting head 24 (printer 11 side), is formed in the other end of outlet channel 138.

Next, a configuration of the air chamber 136 and a configuration which introduces air to the air chamber 136 will be described.

As shown in FIG. 10, an atmosphere communication hole 140 which communicates with the atmosphere, and a positioning protrusion 141 extends in the left-right direction X are formed on the upper surface 39 on which the filler port 73 of the storage body case 130 is formed. Moreover, at least one (two in the embodiment) of meander grooves 142 and 143 which are formed to meander, and a meandering convex portion 144 which surrounds the peripheries of the meander grooves 142 and 143 are formed between the above-described reinforced ribs 119 and the positioning protrusion 141.

Figure 15:
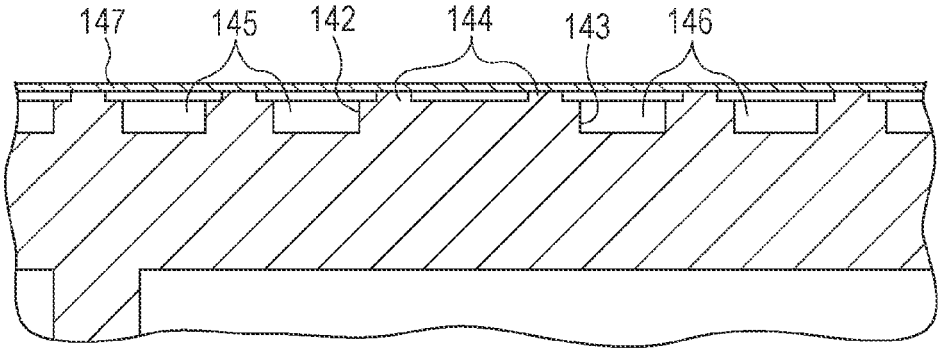
FIG. 15 is an enlarged view of a XV portion in FIG. 11.

Moreover, as shown in FIGS. 10 and 15, an air passage formation film 147, which covers the meander grooves 142 and 143 and forms air passages 145 and 146, is adhered (for example, heat welded) to the upper surface 39 of the storage body case 130. That is, if the air passage formation film 147 is adhered to the meandering convex portion 144 in a state where the air passage formation film is positioned by the reinforced ribs 119 and the positioning protrusion 141, the first air passage 145 is formed by the first meander groove 142 and the air passage formation film 147. In addition, the second air passage 146 is formed by the second meander groove 143 and the air passage formation film 147.

As shown in FIGS. 10 and 11, the atmosphere communication hole 140 is formed between the filler port 73 and the second portion in the first portion and communicates with the first air chamber 136*a*. Moreover, the other end 142*b* of the first meander groove 142 communicates with the second air chamber 136*b* while one end 142*a* of the first meander groove 142 communicates with the first air chamber 136*a*. In addition, the other end 143*b* of the second meander groove 143 communicates with the third air chamber 136*c* while one end 143*a* of the second meander groove 143 communicates with the second air chamber 136*b*.

Figure 16:
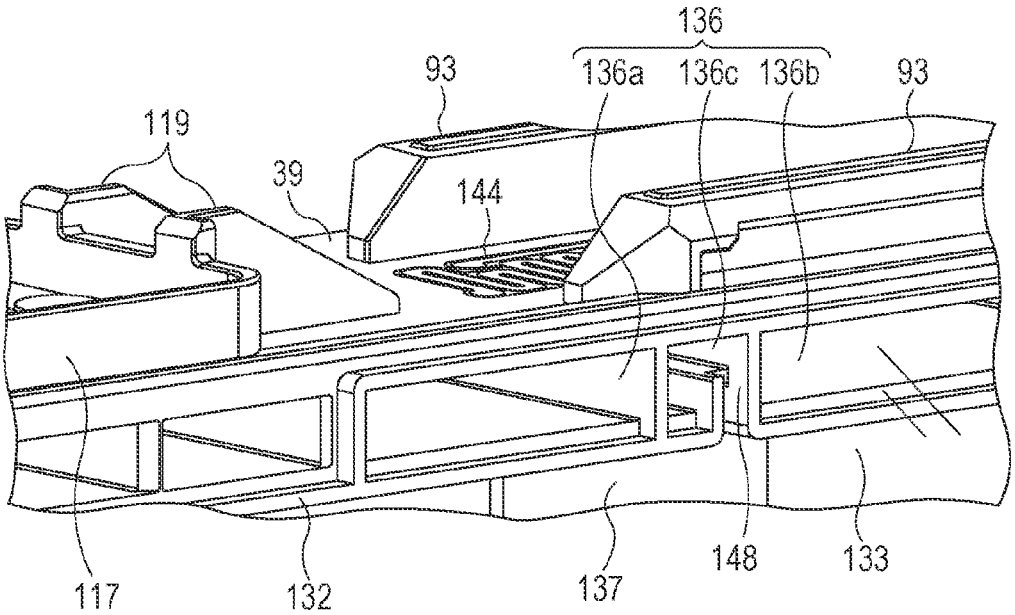
FIG. 16 is an enlarged view of the storage body case to which the film is adhered.

As shown in FIG. 16, an air intake 148 is formed in the third air chamber 136*c*, and the third air chamber 136*c* and the ink chamber 137 communicate with each other via the air intake 148. Accordingly, for example, if the ink stored in the ink chamber 137 is led out and the pressure in the ink chamber 137 is decreased, the outside air introduced from the atmosphere communication hole 140 is introduced to the ink chamber 137 via the first air chamber 136*a*, the first air passage 145, the second air chamber 136*b*, the second air passage 146, and the third air chamber 136*c*.

Next, the ink chamber 137 will be described.

As shown in FIG. 14, similar to the shape of the liquid storage body 33, in the shape of the ink chamber 137, the height in the up-down direction Z in the front side is larger than the height in the up-down direction Z in the rear side. Moreover, the ink chamber 137 is partitioned to a first ink chamber 151 which is an example of a first liquid storage chamber and a second ink chamber 152 which is an example of a second liquid storage chamber by a partition wall 150, and the partition wall 150 intersects a ceiling surface 137*b* which is an example of a filler port formation surface on which the filler port 73 is formed in the ink chamber 137.

In addition, the partition wall 150 is provided so as to extend along the up-down direction Z, and also intersects an surface (bottom surface) 153 which is opposite to the ceiling surface 137*b*. Moreover, the width of the partition wall 150 in the left-right direction X is approximately the same as the width from the left side wall 130*b* of the storage body case 130 to the case opening 132. In addition, the partition wall 150 is formed to be integrated with the storage body case 130 so as to be orthogonal to the side wall 130*b* of the storage body case 130 and to protrude from the side wall 130*b* toward the case opening 132 side (front side in FIG. 14) at the position close to the front side at which the height in the up-down direction Z in the ink chamber 137 is high. Accordingly, the height in the up-down direction Z of the second ink chamber 152 in the first ink chamber 151 side is approximately the same as the height in the up-down direction Z of the first ink chamber 151, and the height in the up-down direction Z of the second ink chamber 152 is larger than the height in the up-down direction Z of the first ink chamber 151 in the rear side away from the first ink chamber 151. Moreover, the volume of the first ink chamber 151 is smaller than the volume of the second ink chamber 152.

Specifically, as shown in FIG. 11, the partition wall 150 is formed so as to be an approximate line symmetry with respect to a front wall surface 137*a* in the first ink chamber 151 with an pouring virtual line M, which passes through the center of the opening of the filler port 73 and extends along the up-down direction Z, as the center. That is, the filler port 73 is formed on the ceiling surface 137*b* of the first ink chamber 151 which is positioned at the front side from the partition wall 150.

Figure 17:
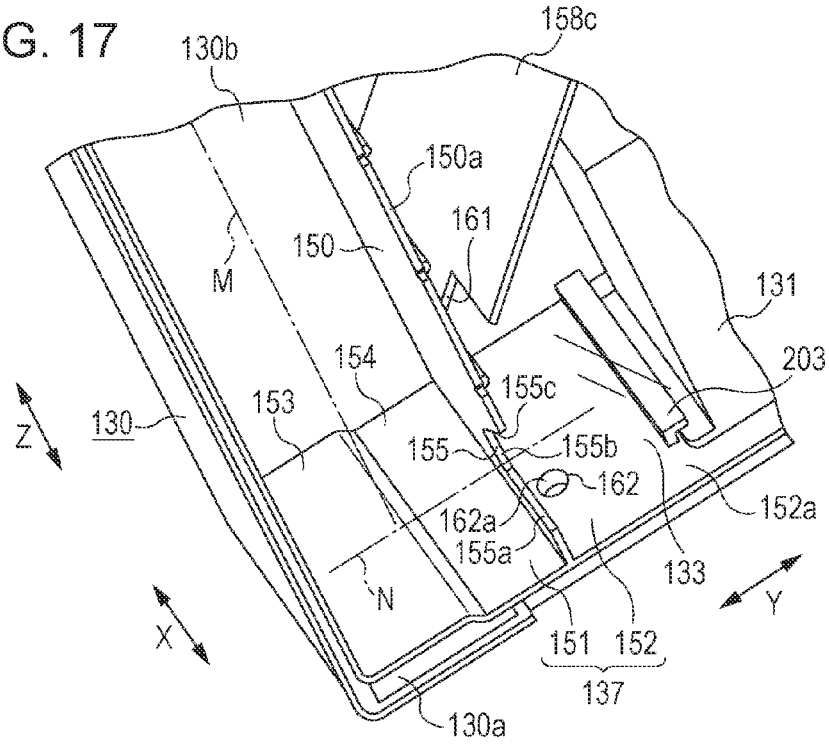
FIG. 17 is an enlarged view of the storage body case to which the film is adhered.

Moreover, as shown in FIG. 17, a concave portion 154 is provided at the position close to the partition wall 150 of the opposite surface 153 in the first ink chamber 151, and the concave portion 154 is recessed in the gravity direction away from the filler port 73 and is provided to be positionally shifted in the direction intersecting the gravity direction from the filler port 73. That is, the concave portion 154 is provided over the left-right direction X at the position deviated from the pouring virtual line M in the front-rear direction Y.

As shown in FIGS. 14 and 17, if the film 133 is adhered to the partition wall 150, a portion formed to be recessed to the side wall 130*b* side from an adhesion surface 150*a* serves as a wall communication opening (wall communication opening portion) 155 which is an example of a communication opening and serves as a wall ventilation opening (wall ventilation opening portion) 156 which is an example of a ventilation opening. That is, the first ink chamber 151 and the second ink chamber 152 communicate with each other via the wall communication opening 155 and the wall ventilation opening 156. Moreover, the wall ventilation opening 156 is formed at the upper end of the partition wall 150 so as to contact the ceiling surface 137*b*, and is positioned above the wall communication opening 155.

On the other hand, the wall communication opening 155 is positioned at the opposite surface 153 side lower than the wall ventilation opening 156, and is formed at a position away upward from the concave portion 154. Moreover, in the wall communication opening 155, an upper surface 155*c* positioned at the upper side (antigravity direction side) in the wall communication opening 155 is non-orthogonal to the inner surface 155*b* while a lower surface 155*a* positioned at the lower side in the wall communication opening 155 is formed so as to be approximately orthogonal to and to be approximately horizontal to a left inner surface 155*b*. That is, the upper surface 155*c* is inclined in the direction intersecting the horizontal direction, and is separated from the lower surface 155*a* with the distance from the inner surface 155*b*. Moreover, in the wall communication opening 155, a communication opening axis N, which passes through the center of the opening of the wall communication opening 155 and is orthogonal to an opening cross-section (extends along the front-rear direction Y in the embodiment), is non-parallel with the pouring virtual line M, and thus, the communication opening axis N does not intersect the pouring virtual line M due to the difference. That is, the wall communication opening 155 is formed at a position twisted to the filler port 73.

Moreover, the area of the wall communication opening 155 corresponds to the area of the portion formed to be recessed in the partition wall 150, is smaller than the area of the partition wall 150, and also is smaller than the area of the filler port 73. In addition, the area of the wall ventilation opening 156 is smaller than the area of the wall communication opening 155.

Moreover, as shown in FIG. 14, at least one (nine in the embodiment) of intersection rib portions 157*a* to 157*i* which intersect the ceiling surface 137*b* and extend along the up-down direction Z is provided in the second ink chamber 152, and the intersection rib portions 157*a* to 157*i* are formed with a gap in the front-rear direction Y. In addition, at least one (four in the embodiment) of horizontally inclined rib portions 158*a* to 158*d* which intersect in the up-down direction Z and the front-rear direction (horizontal direction) Y is formed in the second ink chamber 152, and the inclined rib portions are an example of an eaves. Moreover, the intersection rib portions 157*a* to 157*i* and the horizontally inclined rib portions 158*a* to 158*d* are orthogonal to the side wall 130*b* and the storage body case 130, and are integrally molded with the storage body case 130 so as to protrude from the side wall 130*b* toward the case opening 132 side (the front side in FIG. 14).

The widths of the intersection rib portions 157*a* to 157*i* in the left-right direction X are approximately the same as the width from the side wall 130*b* of the storage body case 130 to the case opening 132. In addition, the upper ends of the intersection rib portions 157*a* to 157*i* contacting the ceiling surface 137*b* are formed to be partially recessed toward the side wall 130*b* side. Accordingly, if the film 133 is adhered to the adhesion surfaces (right end surfaces) of the intersection rib portions 157*a* to 157*i*, the recessed portions serve as rib ventilation openings (rib ventilation opening portions) 160 which are an example of a ventilation opening. Moreover, the area of the rib ventilation opening 160 is larger than the area of the wall ventilation opening 156, and the size in the up-down direction Z of the rib ventilation opening 160 is larger than the size in the up-down direction Z of the wall ventilation opening 156. That is, a lower side opening end of the wall ventilation opening 156 is positioned at the position closer to the ceiling surface 137*b* than a lower side opening end of the rib ventilation opening 160. Accordingly, the wall ventilation opening 156 is formed so as to closer to the ceiling surface 137*b* than the rib ventilation opening 160.

The first intersection rib portion 157*a* nearest to the partition wall 150 and the second intersection rib portion 157*b* near in the second place to the partition wall 150 are formed with a gap to the bottom surface 152*a* at positions close to the front side in which the size in the up-down direction Z is large in the second ink chamber 152. Accordingly, if the film 133 is adhered to the adhesion surfaces of the first intersection rib portion 157*a* and the second intersection rib portion 157*b*, the lower ends of the first intersection rib portion 157*a* and the second intersection rib portion 157*b* serve as a rib communication opening (rib communication opening portion) 161 which is an example of the communication opening through the ink can pass. Moreover, the bottom surface 152*a* of the second ink chamber 152 is the surface positioned at the lower side in the up-down direction Z in the second ink chamber 152, and is partially bent and inclined in accordance with the shape of the second ink chamber 152. In addition, the float valve 131 is accommodated between the first intersection rib portion 157*a* and the second intersection rib portion 157*b*, and the bottom surface 152*a*.

The third intersection rib portion 157*c* to the ninth intersection rib portion 157*i* are formed at the position close to the rear side of the second ink chamber 152. Moreover, the lower ends of the third intersection rib portion 157*c* to the ninth intersection rib portion 157*i* are formed so as to be partially recessed toward the side wall 130*b* side. Accordingly, if the film 133 is adhered to the adhesion surfaces (right end surfaces) of the third intersection rib portion 157*c* to the ninth intersection rib portion 157*i*, the portions formed so as to be recessed to the side wall 130*b* side in the lower ends of the third intersection rib portion 157*c* to the ninth intersection rib portion 157*i* serve as the rib communication opening 161 which is an example of a communication opening through which the ink can pass. That is, in the second ink chamber 152, spaces separated by the intersection rib portions 157*a* to 157*i* communicate with one another via the rib communication openings 161, and the rib ventilation openings 160 which are formed to be closer to the ceiling surface 137*b* side than the rib communication openings 161.

As shown in FIGS. 13 and 14, the first horizontally inclined rib portion 158*a* positioned at the highest position is formed to be a surface inclined downward toward the rear side from an intersection point between the partition wall 150 and the ceiling surface 137*b*. Moreover, the second horizontally inclined rib portion 158*b* positioned at the second highest position is formed to be a surface inclined downward to be more gentle than the first horizontally inclined rib portion 158*a* from the position lower than the first horizontally inclined rib portion 158*a* in the partition wall 150 toward the rear side. That is, the first horizontally inclined rib portion 158*a* and the second horizontally inclined rib portion 158*b* are formed to intersect the partition wall 150 and the front-rear direction Y. Moreover, the widths in the left-right direction X of the first horizontally inclined rib portion 158*a* and the second horizontally inclined rib portion 158*b* are smaller than the widths of the partition wall 150 and the intersection rib portions 157*a* to 157*i*. Accordingly, when the film 133 is adhered to the case opening 132, a gap is formed between the first horizontally inclined rib portion 158*a* and the second horizontally inclined rib portion 158*b*, and the film 133. Therefore, the spaces divided by the first horizontally inclined rib portion 158*a* and the second horizontally inclined rib portion 158*b* communicate with one another via the gap.

Moreover, the third horizontally inclined rib portion 158*c* which is an example of the first eaves and the fourth horizontally inclined rib portion 158*d* which is an example of the second eaves are formed at a position which is positioned to be closer to the bottom surface 152*a* side than the second horizontally inclined rib portion 158*b* and is positioned above the float valve 131. The third horizontally inclined rib portion 158*c* is formed between the partition wall 150 and the first intersection rib portion 157*a*, and the fourth horizontally inclined rib portion 158*d* are formed at the rear side of the second intersection rib portion 157*b*. In addition, the third horizontally inclined rib portion 158*c* and the fourth horizontally inclined rib portion 158*d* are a line symmetry based on an axis (not shown) along the gravity direction passing through the center of the float valve 131, and are formed to be a surface inclined downward respectively from the center of the float valve 131 to the ends. That is, a distance between the upper end of the third horizontally inclined rib portion 158*c* and the upper end of the fourth horizontally inclined rib portion 158*d* is shorter than a distance between the lower end of the third horizontally inclined rib portion 158*c* and the lower end of the fourth horizontally inclined rib portion 158*d*.

Moreover, the widths in the left-right direction X of the third horizontally inclined rib portion 158*c* and the fourth horizontally inclined rib portion 158*d* are approximately the same as the width of the partition wall 150. In addition, both ends of the third horizontally inclined rib portion 158*c* and the fourth horizontally inclined rib portion 158*d* are formed to be recessed toward the side wall 130*b* side. Accordingly, if the film 133 is adhered to the adhesion surfaces (right end surfaces) of the third horizontally inclined rib portion 158*c* and the fourth horizontally inclined rib portion 158*d*, the portions formed to be recessed to the side wall 130*b* side serve as the rib communication opening 161 through which the ink can pass. Accordingly, the spaces divided by the third horizontally inclined rib portion 158*c* and the fourth horizontally inclined rib portion 158*d* communicate with one another via the rib communication openings 161.

Figure 18:
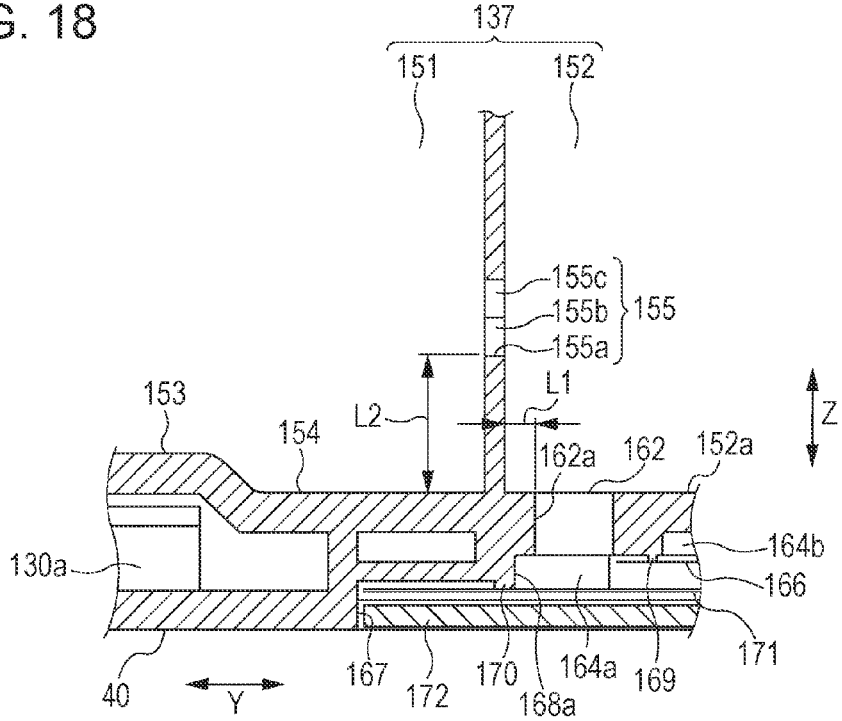
FIG. 18 is a partial cross-sectional view of the storage body case.

As shown in FIGS. 17 and 18, a channel opening (channel opening portion) 162 which communicates with the outlet channel 138 is formed on the bottom surface 152*a* of the second ink chamber 152. That is, the horizontally inclined rib portions 158*a* to 158*d* are positioned above the channel opening 162 and the float valve 131, and are provided so as to cover the channel opening 162 and the float valve 131 from the above. In addition, a distance L1 between the channel opening 162 and the partition wall 150 in the front-rear direction Y is shorter than a distance L2 between the opposite surface 153 and the wall communication opening 155 in the up-down direction Z. Moreover, the distance L2 in the embodiment corresponds to the distance between the upper end of the concave portion 154 formed on the opposite surface 153 and the lower end of the wall communication opening 155. That is, the channel opening 162 is formed at the position close to the partition wall 150 on the bottom surface 152*a* of the second ink chamber 152.

Next, the outlet channel 138 will be described.

As shown in FIG. 14, the outlet channel 138 is formed on the lower side of the second ink chamber 152 along the bottom surface 152*a* of the second ink chamber 152. Moreover, the outlet channel 138 includes a curved channel portion 163 which is formed to be bent in accordance with the shape of the liquid storage body 33 and makes the ink flow while changing the flow direction of the ink (hereinafter, referred to as a "flow direction"). Moreover, the outlet channel 138 includes a connection channel portion 164 which connects the channel opening 162 and the curved channel portion 163 and an inclination channel portion 165 which connects the curved channel portion 163 and the lead-out port 69.

Figure 19:
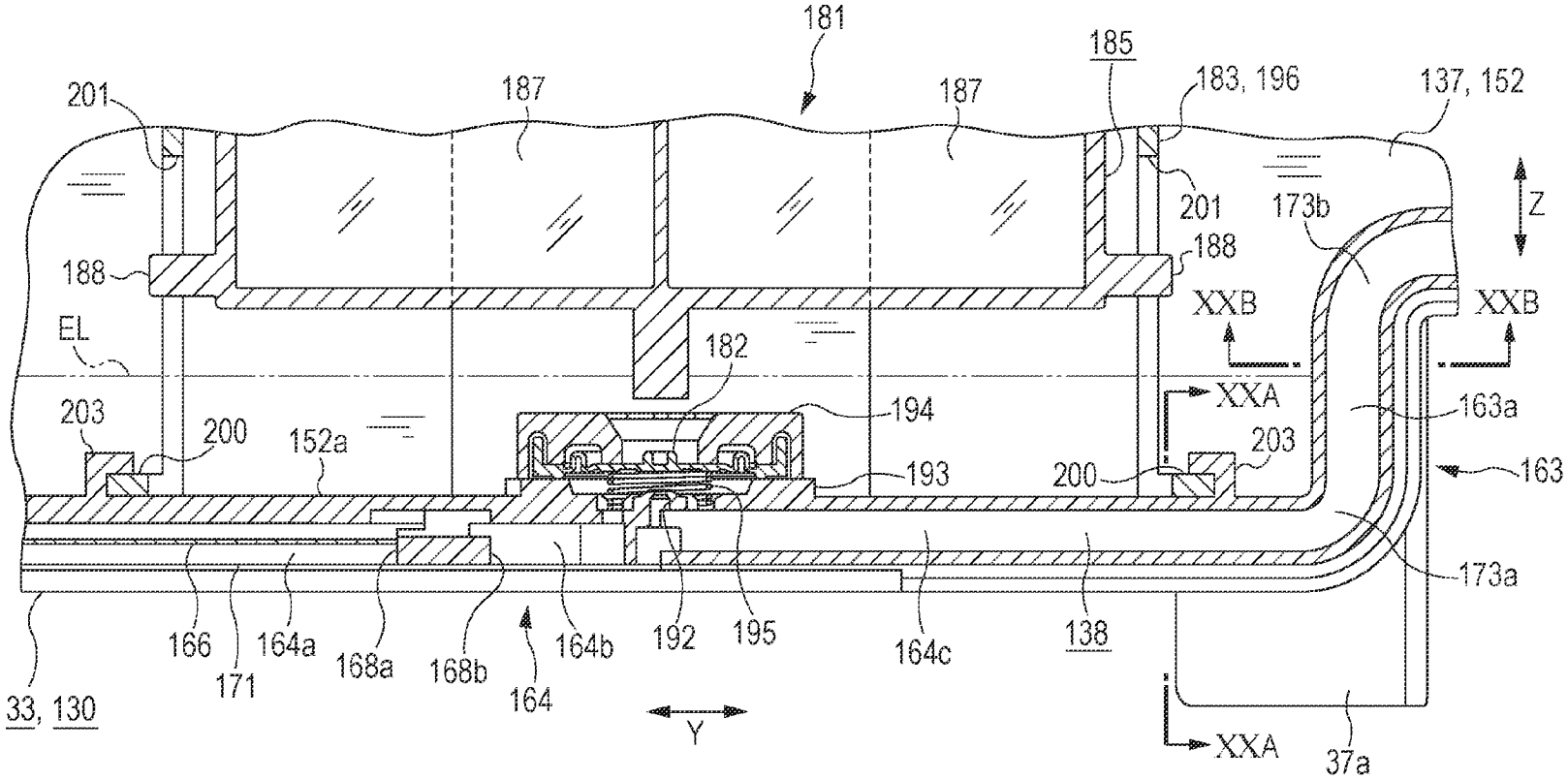
FIG. 19 is a partial cross-sectional view of the storage body case.

As shown in FIGS. 18 and 19, the connection channel portion 164 includes a filter 166 having an approximately rectangular shape in a bottom view from the lower side. That is, the connection channel portion 164 is divided into a first connection channel portion 164*a* of the channel opening 162 side and a second connection channel portion 164*b* positioned to be closer to the float valve 131 side than to the filter 166, by the filter 166. Moreover, the connection channel portion 164 includes a third connection channel portion 164*c* which is positioned to be closer to the lead-out port 69 side than to the float valve 131 and is connected to the curved channel portion 163.

Figure 20A:
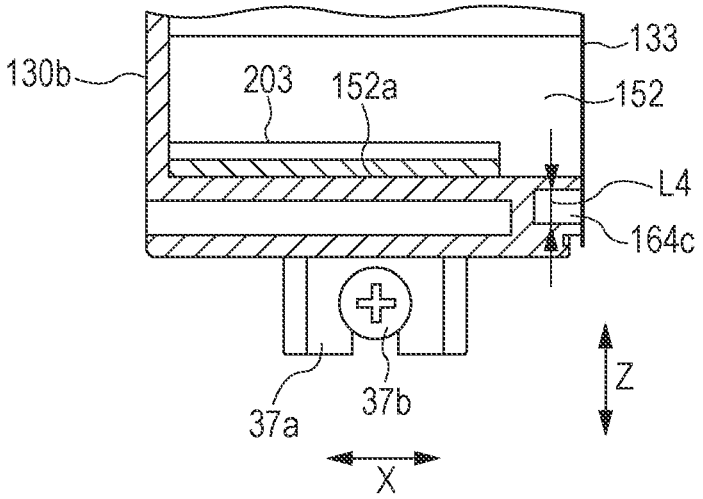
FIG. 20A is a cross-sectional view taken along line XXA-XXA of FIG. 19.
Figure 20B:
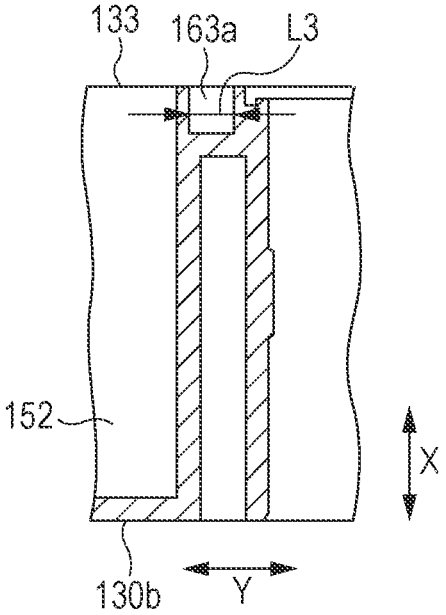
FIG. 20B is a cross-sectional view taken along line XXB-XXB of FIG. 19.

As shown in FIGS. 20A and 20B, the cross-sectional area of the curved channel portion 163 is larger than the cross-sectional area of the third connection channel portion 164*c*. Moreover, the width in the left-right direction X of the outlet channel 138 is approximately the same over the flow direction. Accordingly, a width L3 in the direction (the front-rear direction Y in a first vertical channel portion 163*a*) which is orthogonal to the flow direction of the curved channel portion 163 (the first vertical channel portion 163*a* in FIG. 20B) and is also orthogonal to the left-right direction X is wider than a width L4 in the direction (the up-down direction Z) which is orthogonal to the flow direction of the third connection channel portion 164*c* and is also orthogonal to the left-right direction X. In addition, the cross-sectional area of the inclination channel portion 165 is approximately the same as the cross-sectional area of the curved channel portion 163. Accordingly, a width L5 (FIG. 14) in the direction which is orthogonal to the flow direction of the inclination channel portion 165 and is also orthogonal to the left-right direction X is wider than the width L4 of the third connection channel portion 164*c*.

Figure 21:
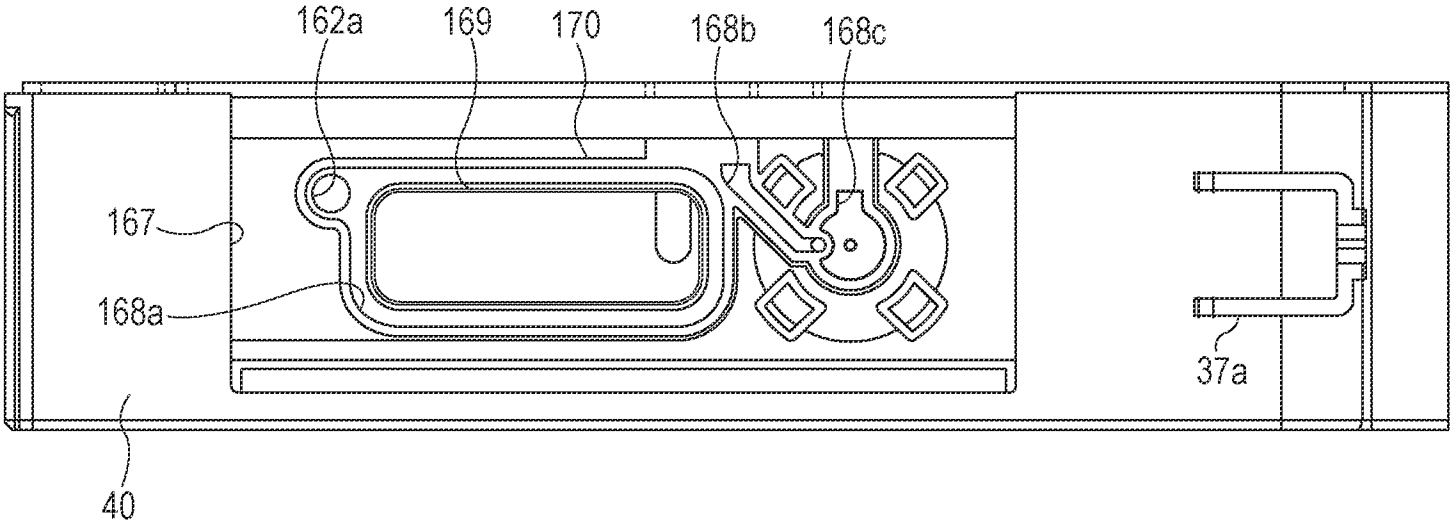
FIG. 21 is a bottom view of the storage body case.

As shown in FIGS. 18 and 21, a step portion 167 is formed on the lower surface 40 close to the front side in which the height in the up-down direction Z of the storage body case 130 is high, and the step portion 16 is recessed to the upper side, which becomes the ink chamber 137 side, and has an approximately rectangular shape. Moreover, in the step portion 167, first to third channel formation concave portions 168*a* to 168*c* are formed so as to be recessed toward the ink chamber 137 side. In the first channel formation concave portion 168*a*, a through hole 162*a* is formed to penetrate the bottom surface 152*a* of the second ink chamber 152, one end of the through hole 162*a* becomes the channel opening 162, and the other end is opened. Moreover, the first channel formation concave portion 168*a* is formed to be unleveled so that an inner side of an approximately rectangular shaped annular concave portion 169 in a bottom view to which the filter 166 is adhered is deeper than the outside. Moreover, a channel convex portion 170 is formed on the periphery of the first to third channel formation concave portions 168*a* to 168*c*. That is, the through hole 162*a* and the annular convex portion 169 are surrounded by the channel convex portion 170.

Accordingly, the filter 166 is adhered to the annular convex portion 169 and a channel formation film 171 is adhered (for example, heat welded) to the channel convex portion 170, and thus, the connection channel portion 164 is formed. That is, if the channel formation film 171 is adhered to the channel convex portion 170, the first channel formation concave portion 168*a* serves as the first connection channel portion 164*a* and the second connection channel portion 164*b*. Moreover, the second channel formation concave portion 168*b* serves as the second connection channel portion 164*b*. In addition, the third channel formation concave portion 168*c* serves as the third connection channel portion 164*c*. Moreover, an approximately rectangular protection member 172 which protects the channel formation film 171 is mounted to the step portion 167.

As shown in FIG. 14, the curved channel portion 163 includes at least one (two in the embodiment) of vertical channel portions 163*a* and 163*b* extending in the up-down direction Z, a plurality of (four in the embodiment) bending portions 173*a* to 173*d* which are formed at both ends of the vertical channel portions 163*a* and 163*b*, and a horizontal channel portion 163*c* which extends along the front-rear direction Y.

That is, the first bending portion 173*a* is positioned at the lowest side, and connects the rear end of the third connection channel portion 164*c* and the lower end of the first vertical channel portion 163*a*. The second bending portion 173*b* is positioned above the first bending portion 173*a*, and connects the upper end of the first vertical channel portion 163*a* and the front end of the horizontal channel portion 163*c*. The third bending portion 173*c* connects the rear end of the horizontal channel portion 163*c* and the lower end of the second vertical channel portion 163*b*. The fourth bending portion 173*d* connects the upper end of the second vertical channel portion 163*b* and the front end of the inclination channel portion 165. Accordingly, the ink flow direction of the curved channel portion 163 is different from that of the inclination channel portion 165, and the curved channel portion 163 is bent with respect to the inclination channel portion 165.

The inclination channel portion 165 is formed so as to extend along the direction intersecting the front-rear direction (horizontal direction) Y so that the end of the rear side which becomes the lead-out port 69 side is positioned above the end of the front side (antigravity direction) which becomes the channel opening 162 side continuous to the fourth bending portion 173*d*. That is, the inclination channel portion 165 becomes a continuous surface inclined upward toward the lead-out port 69 side from the channel opening 162 side. Moreover, the rear end side of the inclination channel portion 165 is bent upward and communicates with the lead-out port 69.

Moreover, the outlet channel 138 is positioned at the gravity direction side of the second ink chamber 152 and extends along the bottom surface 152*a*. Accordingly, the portion of the bottom surface 152*a* of the second ink chamber 152 corresponding to the inclination channel portion 165 becomes a surface inclined downward toward the channel opening 162 side while the portion of the bottom surface 152*a* of the second ink chamber 152 corresponding to the connection channel portion 164 and the horizontal channel portion 163*c* is approximately horizontal.

Next, the float valve 131 will be described.

Figure 22:
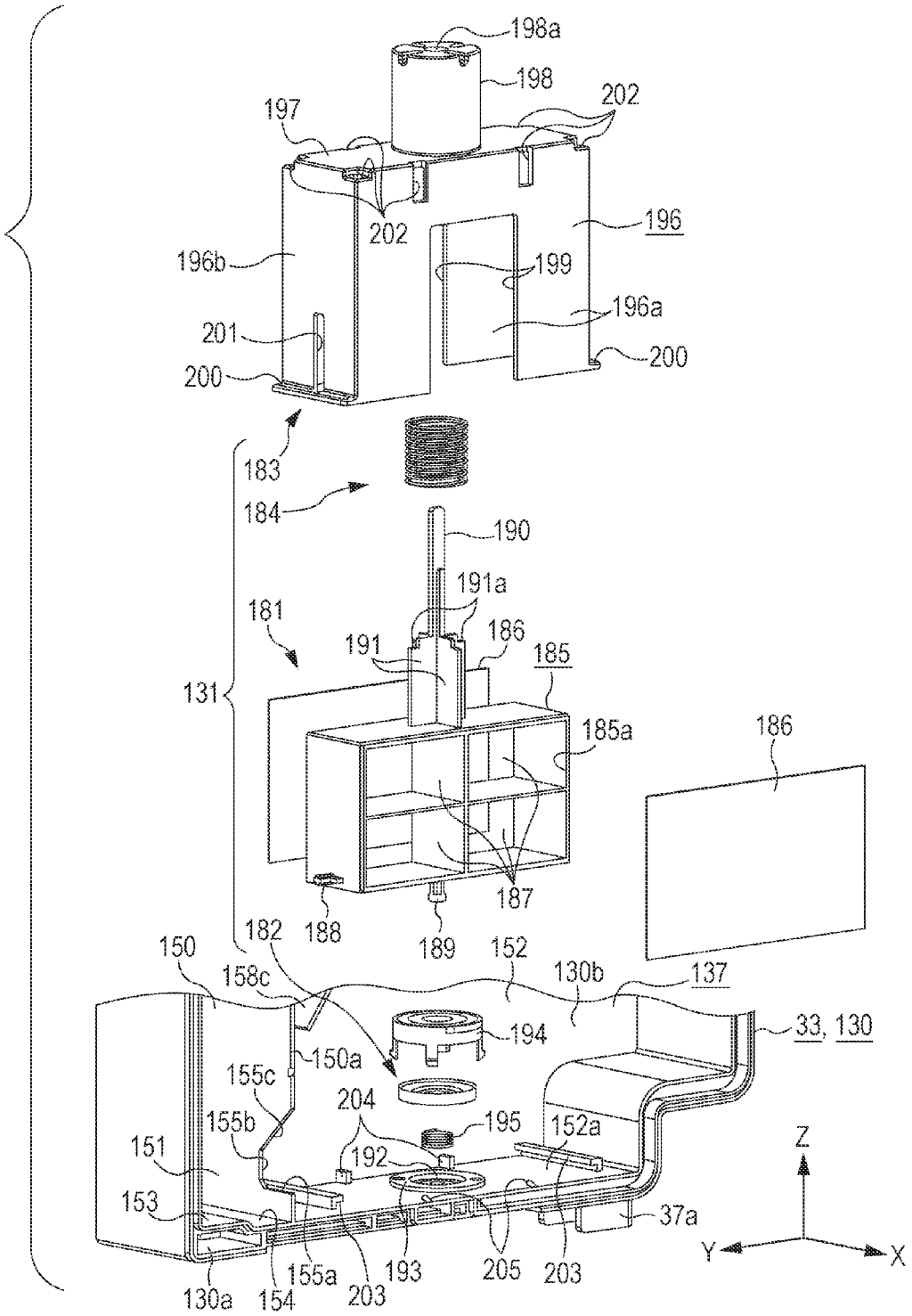
FIG. 22 is an exploded perspective view showing a portion of the storage body case and each component of a float valve.

As shown in FIG. 22, the float valve 131 includes a float member 181 which is disposed in the ink chamber 137, a valve body 182 which is disposed below the float member 181, a regulation case 183 which is an example of the regulation member disposed above the float member 181, and a coil spring 184 which is an example of a biasing member disposed between the float member 181 and the regulation case 183. Moreover, in FIG. 22, in order to simply show the mounting structure of the float valve 131 in the ink chamber 137, a portion of the storage body case 130, in which the ink chamber 137 is formed, is shown along with the components which configure the float valve 131.

Hereinafter, each component of the float valve 131 will be described.

First, the float member 181 includes a rectangular frame body 185, and a plurality of (four in the embodiment) space areas are partitioned in the inner side of the rectangular frame body 185. For example, a thin film member 186 formed of a transparent film or the like is adhered to an opening portion 185*a* of both left and right surfaces along the front-rear direction Y in the frame body 185. Accordingly, in the float member 181, the opening portion 185*a* of the frame body 185 is closed by the thin film member 186, and thus, a plurality of (four in the embodiment) closed air chambers 187 are formed inside the thin film member 186. Therefore, the float member 181 can float in the up-down direction Z according to a change of the remaining amount of the ink in the ink chamber 137 by buoyancy generated by the air chamber 187.

On the other hand, convex portions 188, which protrude in the front-rear direction Y, are formed respectively at the lower portions of both front and rear surfaces along the left-right direction X in which the opening portion 185*a* is not formed in the frame body 185. In addition, a pressing portion 189 having an approximately columnar shape protrudes vertically downward from the center position of the lower surface in the frame body 185. Moreover, a rod shaped portion 190, which is positioned to be coaxial with the pressing portion 189 of the lower surface, protrude so as to extend vertically upward from the center position of the upper surface in the frame body 185.

Moreover, in the upper surface of the frame body 185, a plate shaped portion 191, which has a cross shape in a plan view from the above with the rod shaped portion 190 as the center, is formed around the rod shaped portion 190, and the length of the plate shaped portion 191 protruded from the upper surface of the frame body 185 is approximately half of the protruded length of the rod shaped portion 190. The size of the cross-shaped cross section of the plate shaped portion 191 is formed so as to be larger than the size of the outer diameter of the coil spring 184. Moreover, spring seats 191*a* for placing and supporting the coil spring 184 is formed to be cut out in a rectangular shape at the tip end in the radial direction from the rod shaped portion 190 in the upper end of the plate shaped portion 191 having a cross-shaped cross section.

Next, the valve body 182 is a diaphragm valve which is formed of elastomer having flexibility or the like and has an approximately disk shape, and is disposed above the valve opening 192 (refer to FIG. 19 or the like) formed to be opened to the bottom surface 152*a* of the second ink chamber 152 so that the valve body is positioned at a boundary between the second connection channel portion 164*b* and the third connection channel portion 164*c* in the outlet channel 138. That is, an annular mounting seat 193 which surrounds the valve opening 192 is formed on the bottom surface 152*a* of the second ink chamber 152, a fixture 194 having the same annular shape as the mounting seat 193 is locked to the mounting seat 193, and the valve body 182 is disposed above the valve opening 192 in a state where the valve body 182 is interposed between the mounting seat 193 and the fixture 194.

Moreover, in the inner side of the mounting seat 193, if the above-described coil spring 184 is set to a first biasing member having a first biasing force, the coil spring 195 which serves as a second biasing member having a second biasing force is disposed to always abut the valve body 182 from the lower portion. In addition, the valve body 182 is separated from the valve opening 192 to the above by the coil spring 195, and is always biased toward an opened valve position (a position shown in FIGS. 19 and 28) at which the outlet channel 138 is opened.

Moreover, a force relationship between the first biasing force of the coil spring 184 and the second biasing force of the coil spring 195 is set to the following force relationship based on the assumption that the first biasing force of the coil spring 184 is larger than the second biasing force of the coil spring 195.

Figure 28:
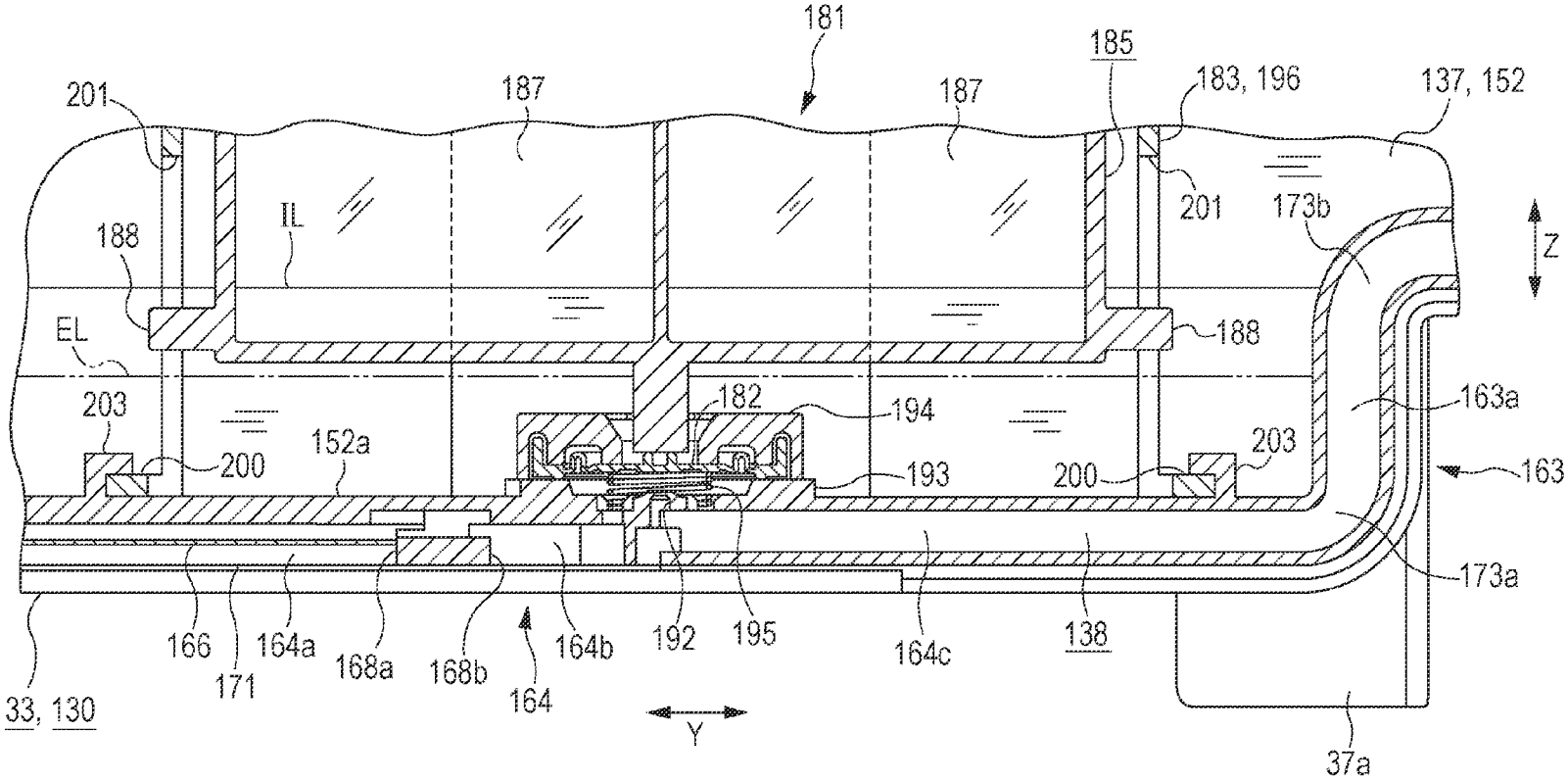
FIG. 28 is a partial cross-sectional view showing a state of the float valve when a remaining amount of the ink approaches a threshold remaining amount.
Figure 29:
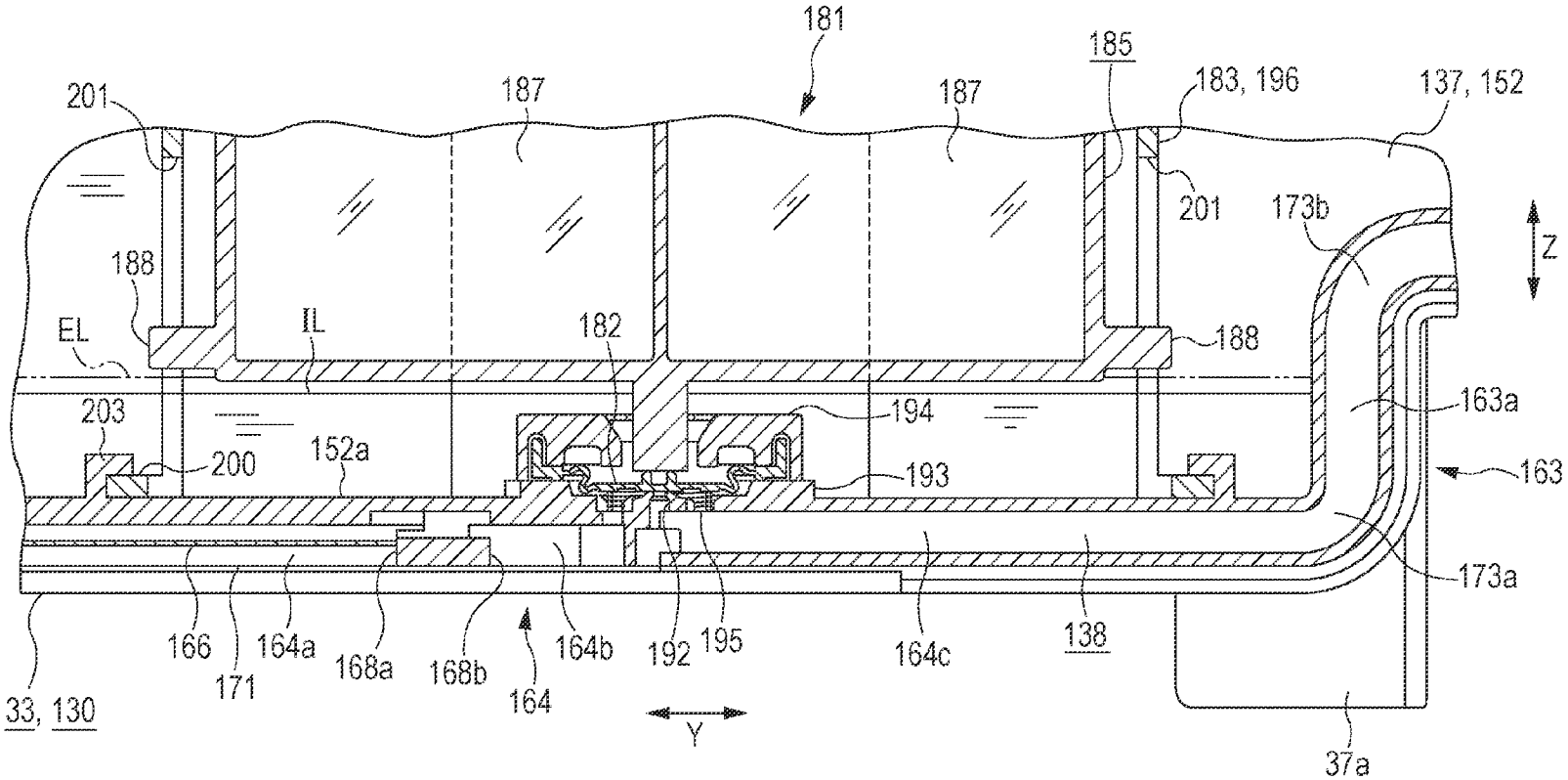
FIG. 29 is a partial cross-sectional view showing a state of the float valve when the remaining amount of the ink is less than the threshold remaining amount.

That is, for example, as shown in FIG. 29, if the remaining amount of the ink in the ink chamber 137 is less than a threshold remaining amount which is a preset slight remaining amount, the sum of buoyancy of the float member 181 floating in the remaining ink at that time and the second biasing force of the coil spring 195 is set to be smaller than the first biasing force of the coil spring 184. On the other hand, for example, as shown in FIGS. 19 and 28, if the remaining amount of the ink in the ink chamber 137 is equal to or more than the threshold remaining amount, the sum of buoyancy of the float member 181 floating in the remaining ink at that time and the second biasing force of the coil spring 195 is set to be equal to or more than the first biasing force of the coil spring 184.

Next, the regulation case 183 is formed in a box shape having an opened lower portion, and the regulation case 183 includes an annular wall portion 196 which can insert and extract the float member 181 in a up-down direction Z and has a square annular shape, and an upper wall portion 197 which closes the upper opening of the annular wall portion 196. That is, the annular wall portion 196 is formed in an annular shape which can surround the periphery of a floating region with a gap between the periphery of the floating region in the up-down direction Z in the float member 181 and the side surface of the float member 181.

Moreover, a cylindrical portion 198 having a closed upper opening is formed in the center position of the upper wall portion 197 so as to communicate with the inner space of the annular wall portion 196 via the lower opening of the cylindrical portion 198. Moreover, an insertion hole 198*a* is formed through the upper wall portion of the cylindrical portion 198, and the rod shaped portion 190 protruding upward from the upper surface of the float member 181 can insert to the insertion hole 198*a*. Moreover, spring seats (not shown), which are opposite to the spring seats 191*a* formed to be cut out in the plate shaped portion 191 of the float member 181 side in the up-down direction Z, are formed to be enlarged downward in the portion which has a cross shape in a plan view from the above with the insertion hole 198*a* as the center in the upper wall portion of the cylindrical portion 198.

In addition, in the annular wall portion 196 of the regulation case 183, each of left and right side walls 196 along the front-rear direction Y is a portion opposite to the thin film member 186 of the float member 181 in a state where each component of the float valve 131 is assembled. Moreover, a rectangular cut out portion 199 extending along the up-down direction Z, in which the float member 181 floats, is formed to be cut out upward from the lower end edge of each side wall 196*a* at an approximately center portion in the front-rear direction Y in each of left and right side walls 196. The width size in the front-rear direction Y of the cut out portion 199 is larger than the outer diameter size of the cylindrical portion 198 of the upper wall portion 197, and the height in the up-down direction Z of the cut out portion 199 is formed to be larger than the height in the up-down direction Z of the frame body 185 in the float member 181.

Moreover, belt-shaped collars 200 having a predetermined width in the front-rear direction Y are formed to horizontally protrude forward and rearward respectively from the lower ends of each of the front and rear side walls 196*b* along the left-right direction X in the annular wall portion 196 of the regulation case 183. In addition, long guide holes 201, through which the convex portions 188 of the float member 181 side can insert, are formed along the up-down direction Z from a position which is approximately center in the left-right direction X of the collar 200 and is approximately center in the front-rear direction Y up to a position which is slightly lower than the approximately center in the up-down direction Z of each side wall 196*b*. Moreover, in the regulation case 183, through holes 202, which make the inner portion and the outer portion of the regulation case 183 communicate with each other and allow the flow of the ink, are formed respectively at portions from each of two places of both left and right long sides of the upper wall portion 197 to the upper ends of each of the left and right side walls 196*a* of the annular wall portion 196, and at portions which are four corners of the upper end of the annular wall portion 196.

Next, the coil spring 184 is disposed so as to be shrinkable in the up-down direction Z between the float member 181 and the regulation case 183. That is, the rod shaped portion 190 of the float member 181 is inserted into the inner side of the coil spring 184 from the lower side, and thus, the coil spring 184 is placed on the spring seats 191*a* formed on the upper end of the plate shaped portion 191 around the rod shaped portion 190. In addition, if the float member 181 is inserted into the regulation case 183 from the above state, that is, if the frame body 185 is inserted into the annular wall portion 196 from the lower side while the rod shaped portion 190 is inserted into the insertion hole 198*a* of the cylindrical portion 198, the upper end of the coil spring 184 abuts spring seats (not shown) which are formed to be enlarged downward from the upper wall of the cylindrical portion 198 of the regulation case 183.

Moreover, in order to further shrink the coil spring 184, the regulation case 183 into which the float member 181 is inserted is mounted on the bottom surface 152*a* of the second ink chamber 152 of the ink chamber 137 while the state where the float member 181 is pushed into the regulation case 183 is maintained, and thus, the float valve 131 is accommodated in the storage body case 130.

Next, the mounting structure of the float valve 131 in the storage body case 130 will be described.

As shown in FIG. 22, in the bottom surface 152*a* of the second ink chamber 152 in the storage body case 130, lock rail portions 203, which can insert each of the front and rear collars 200 of the regulation case 183 in a slidable manner along the left-right direction X and have a reverse L shaped cross-section, are formed at two positions of the front side and the rear side between which the mounting seat 193 of the valve body 182 is interposed with a distance corresponding to the size in the front-rear direction Y of the regulation case 183. In addition, positioning portions 204 are formed at two positions of the front side and the rear side which become the inner side of the storage body case 130 between each lock rail portion 203 and the mounting seat 193, and the positioning portions 204 can abut the side wall 196*a* the inner side of both left and right side walls 196*a* along the front-rear direction Y of the regulation case 183 sliding toward the inner side of the storage body case 130 in the state where the collars 200 are inserted into the lock rail portions 203.

Moreover, in the bottom surface 152*a* of the second ink chamber 152, protrusions 205 are formed at two positions of the front side corresponding to the positioning portions 204 of the inner side in the left-right direction X, and the protrusions 205 can lock the regulation case 183, which abuts the side wall 196*a* of the inner side to the positioning portions 204, from the front side which becomes the opening side of the storage body case 130 in the lower end of the side wall 196*a* of the front side. The protrusion 205 is an elastically deformable structure which is inclined inwardly and extends upward in the storage body case 130, and the protrusions 205 are provided to be inclined so that the lower end edges of each side wall 196*a* can get over the protrusions 205 while sliding from the front side to the inner side when the collars 200 of the regulation case 183 are inserted into the lock rail portions 203 and slide to the inner side. Moreover, after the side wall 196*a* of the front side gets over the protrusions 205, the protrusions 205 are elastically returned to the original inclined posture and are locked to the front side surface of the side wall 196*a*, and thus, the regulation case 183 is not extracted from the inner side of the storage body case 130 to the front side.

Next, an operation of the liquid storage container 21 of the embodiment will be described. Moreover, in FIGS. 24A, 24B, and 24C, the slider 34 and the liquid storage body 33 are omitted.

Figure 23:
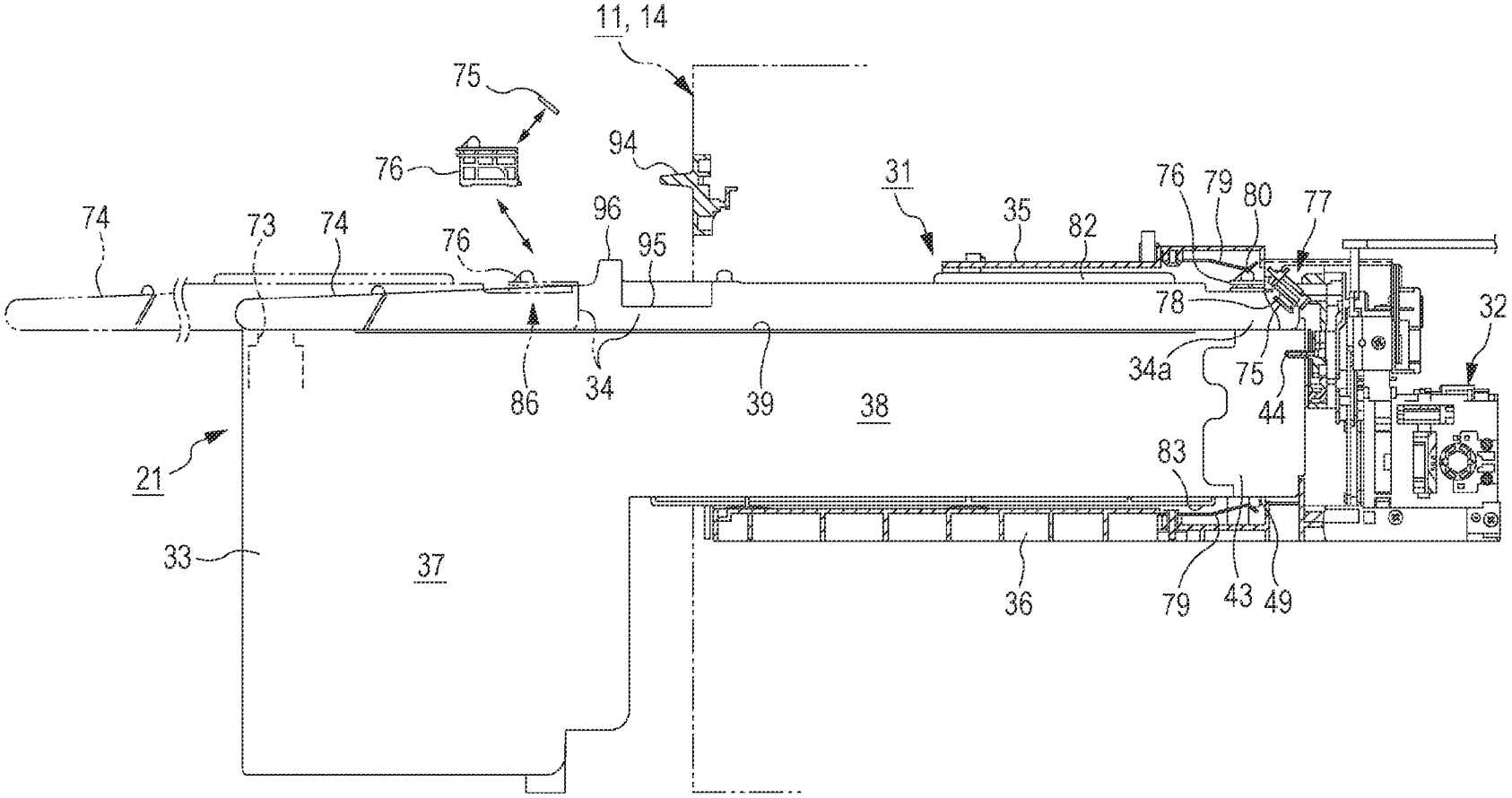
FIG. 23 is an operational explanation view of the slider in the liquid storage container which is mounted to the holder.

As shown in FIG. 23, in the liquid storage container 21 in which the second storage body portion 38 is positioned in the mounting portion 31 and is fixed so as not to move with respect to the printer 11, if the slide knob 94 is displaced upward, the engagement between the slide knob 94 and the concave portion 95 of the slider 34 is released. If so, the user slides the slider 34 in the direction opposite to the insertion direction along the longitudinal direction, and thus, can extract the slider 34 from the printer 11 (mounting portion 31).

By the extracting of the slider 34, the portion in which the slider 34 is positioned in the printer 11, that is, the portion in which the slider 34 overlaps with the portion (second portion) positioned in the printer 11 in the second storage body portion 38 including the connection portion 43 in the upper surface 39 of the liquid storage body 33 moves outside the printer 11. In the embodiment, as shown in two-dot chain lines in FIG. 23, the slider 34 moves the circuit substrate holder 76 mounted at the inner side end 34*a* in the insertion direction of the slider 34 up to a position at which the user can extract the circuit substrate holder 76 from the holder mounting portion 86 of the slider 34 outside the printer 11. Accordingly, the portion of the slider 34, which overlaps with the portion (second portion) positioned in the printer 11 in the second storage body portion 38 including the connection portion 43 in the upper surface 39 of the liquid storage body 33, serves as a moving portion which moves between inside and outside the printer 11.

As a result, the user extracts and removes the circuit substrate holder 76, which is moved outside the printer 11, from the slider 34 (holder mounting portion 86). Moreover, for example, when the circuit substrate 75 previously placed is present in the circuit substrate holder 76, the circuit substrate 75 is exchanged with a circuit substrate 75 in which relevant information (for example, hue, chroma, and brightness of the ink, viscosity of the ink, kind of solute of the ink, or the like) related to the ink poured from the filler port 73 is recorded with respect to the liquid storage body 33. Moreover, after the user inserts and mounts the circuit substrate holder 76, at which the exchanged circuit substrate 75 is placed, into the slider 34 (holder mounting portion 86) again, the user inserts the slider 34 into the printer 11 (mounting portion 31) along the upper surface 39 of the liquid storage body 33.

By the insertion of the slider 34, in the circuit substrate holder 76, the terminal 75*a* or the contact portion 75*b* of the circuit substrate 75 placed so as to be inclined in the insertion direction contacts the electric terminal 78 of the communication portion 77 included in the supply portion 32 and is electrically connected to the electric terminal 78, and thus, the relevant information recorded in the circuit substrate 75 is transferred to the printer 11 side. When the circuit substrate 75 and the electric terminal 78 are connected to each other, the circuit substrate 75 is positioned to the electric terminal 78. In a state where the relevant information recorded in the circuit substrate 75 is transferred (is read) to the printer 11 side, the circuit substrate holder 76 is positioned in the inner portion of the printer 11, and a portion (the first portion) of the slider 34 is positioned outside the printer 11. In other words, in the state where the relevant information recorded in the circuit substrate 75 is read to the printer 11 side, the circuit substrate 75 and the circuit substrate holder 76 are positioned at the position in which the user cannot touch the circuit substrate 75 and the circuit substrate holder 76.

Figure 24A:
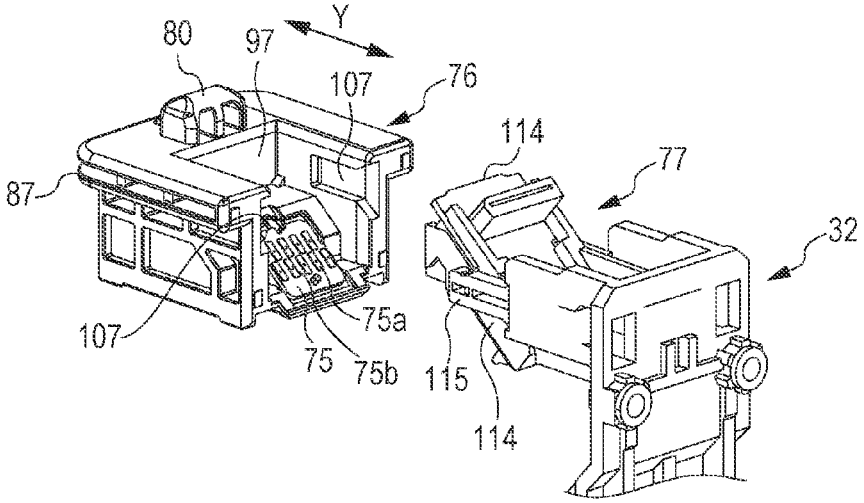
FIG. 24A is a perspective view showing the circuit substrate holder and a communication portion before engagement.

That is, as shown in FIG. 24A, the communication portion 77 provided in the supply portion 32 includes a terminal portion 114 which has the electric terminal 78 contacting the plurality of terminals (including the contact portion 75*b*) 75*a* formed on the circuit substrate 75, and a protrusion-shaped portions 115 which protrude in the short direction and extend in the insertion direction in both sides in the short direction. The terminal portion 114 engages with the concave portion (engagement portion) 97 of the circuit substrate holder 76, and the protrusion-shaped portions 115 engage with the groove shaped portions 107 of the circuit substrate holder 76. The concave portion 97 is the surface of the wall configuring the circuit substrate holder 76 and is formed on the surface of the circuit substrate 75 side.

Figure 24B:
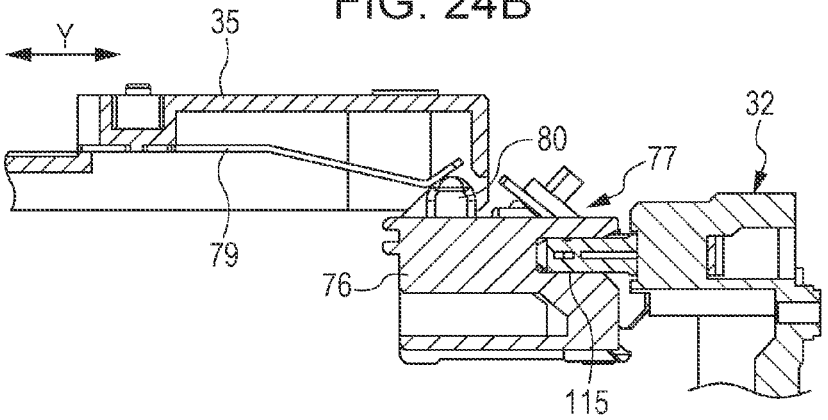
FIG. 24B is a side view in which an engagement state between the circuit substrate holder and the communication portion is shown in a partial cross-section.

At this time, as shown in FIG. 24B, when the slider 34 is inserted into the mounting portion 31, the circuit substrate holder 76 moves toward the communication portion 77 while the protrusion portion 80 of the circuit substrate holder 76 is pushed downward by the plate spring 79 fixed to the upper frame 35 so as not to be away from the slider 34. In this movement, in the circuit substrate holder 76, the protrusion-shaped portions 115 of the communication portion 77 is introduced to the chamfered portions 106 and is inserted into and engages with the groove shaped portions 107, and thus, the circuit substrate holder 76 is positioned to the communication portion 77. At this point, the groove shaped portions 107 of the circuit substrate holder 76 serve as an example of a positioning shape portion which is positioned in the printer 11.

Figure 24C:
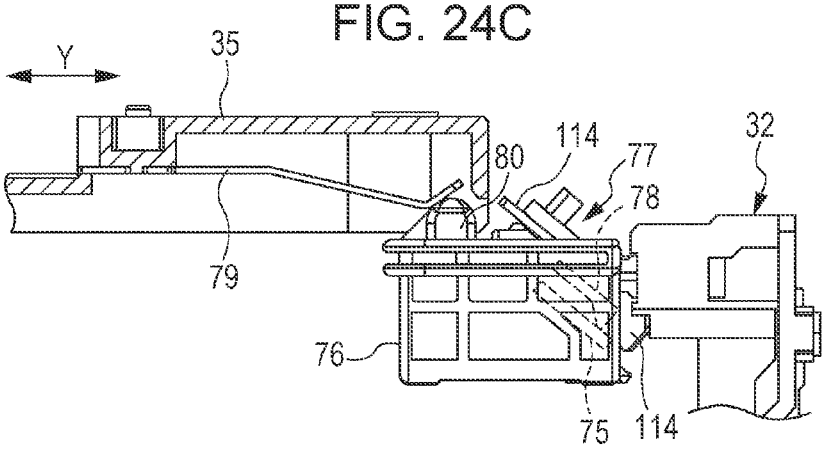
FIG. 24C is a side view showing the circuit substrate holder and the communication portion after the engagement.

As a result, as shown in FIGS. 24A and 24C, the circuit substrate 75 placed on the circuit substrate holder 76 is positioned to the terminal portion 114 of the communication portion 77, and the plurality of electric terminals 78 included in the terminal portion 114 appropriately contact the plurality of (nine in the embodiment) terminals (including the contact portion 75*b*) 75*a* of the circuit substrate 75. Moreover, when the electric terminals 78 contact the terminals (including the contact portion 75*b*) 75*a*, since the terminals (including the contact portion 75*b*) 75*a* of the circuit substrate 75 is inclined downward toward the insertion direction, the electric terminals 78 contact the surfaces of the terminals (including the contact portion 75*b*) 75*a* while rubbing the surfaces.

Next, an operation related to the ink pouring in the liquid storage container 21 will be described.

When the ink is poured into the liquid storage body 33, as shown in FIG. 9A, the open-close cover 74 is displaced to the opened cover position, and as shown in FIG. 9B, the covering body 120 is placed on the rear surface 74*a* of the open-close cover 74, and the filler port 73 is exposed.

At this time, after the user removes the covering body 120 from the filler port 73, the user rotates the covering member 121 with respect to the liquid receiving surface 116 by an arbitrary angle (180° in the embodiment) with the fixing portion 123 as the rotational center and places the covering body 120 on the rear surface 74*a* of the open-close cover 74. Moreover, in the state shown in FIG. 9B, since the rear surface 74*a* of the open-close cover 74 is positioned at the higher position than the liquid receiving surface 116 in the up-down direction Z, the connecting portion 125 slightly extends in the state where the covering body 120 is placed on the rear surface 74*a* of the open-close cover 74. If so, the restoring force according to the elastic deformation (extension) of the connecting portion 125 causes the covering body 120 to act toward the front side from the open-close cover 74. With respect to this, in the embodiment, since the covering body 120 abuts the hook portion 110 of the open-close cover 74, the covering body 120 is suppressed from falling from the open-close cover 74. Moreover, since the side in which the hook portion 110 is formed is positioned at the lowest position in the rear surface 74*a* of the open-close cover 74 positioned at the opened cover position, for example, even if the covering body 120 to which the ink is attached is placed on the rear surface 74*a* of the open-close cover 74, the ink is suppressed from being spread on the entire surface (particularly, the rear surface area) of the open-close cover 74.

Figure 25:
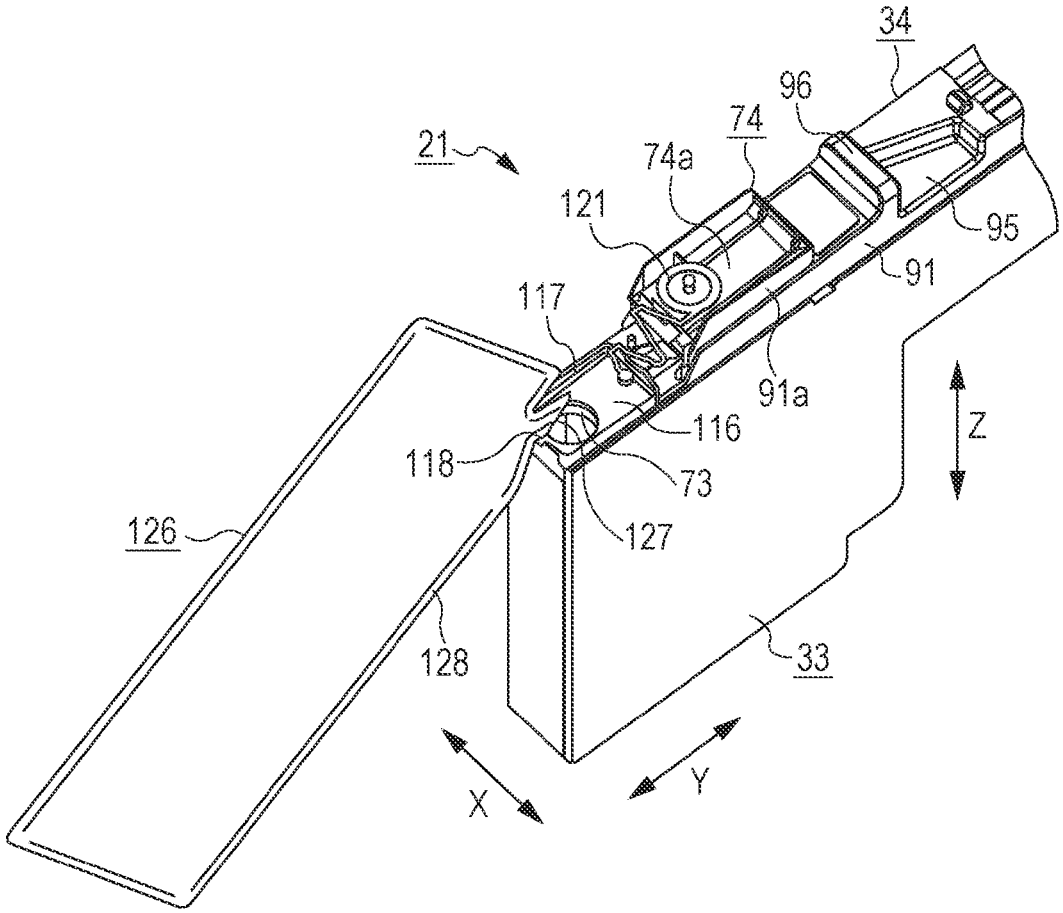
FIG. 25 is a perspective view showing a positional relationship between the liquid storage container and a liquid storage source when ink is poured.
Figure 26:
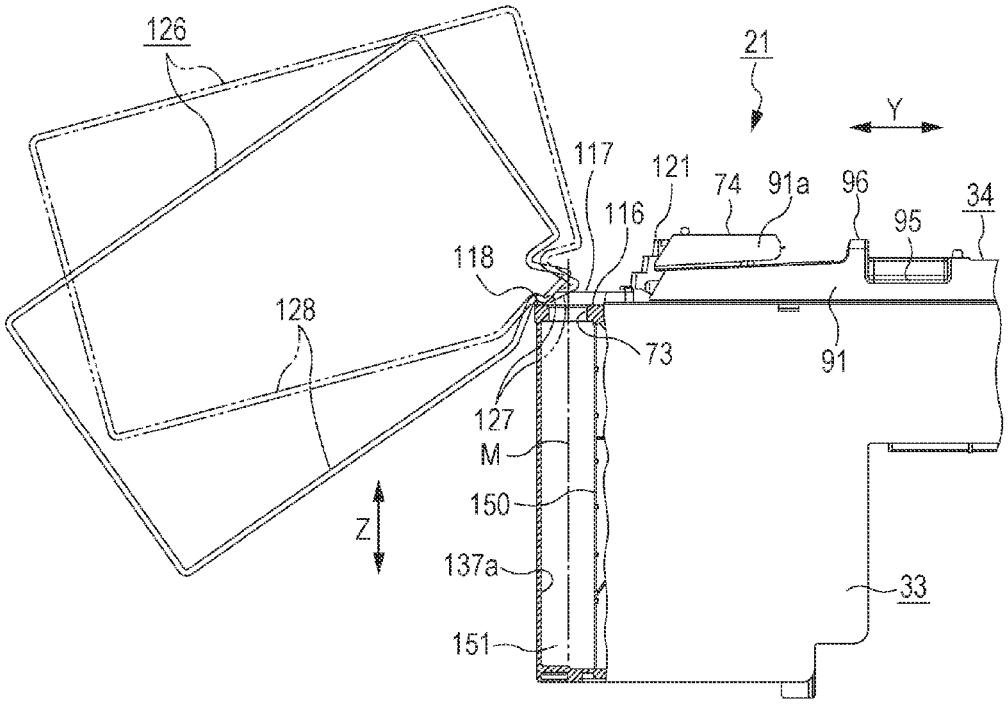
FIG. 26 is a partial cross-sectional side view showing a positional relationship between the liquid storage container and the liquid storage source when the ink is poured.

Moreover, as shown in FIGS. 25 and 26, the ink is poured into the liquid storage body 33 from the liquid pouring source 126 in which an edge portion 128 such as an overlapped film is welded and the spout 127 is formed. When the ink is poured, the edge portion 128 in the vicinity of the spout 127 of the liquid pouring source 126 is inserted to the cut out groove 118 formed on the peripheral wall 117 of the liquid storage body 33 and abut the cut out groove 118, and thus, the liquid pouring source 126 is positioned to the liquid storage body 33. Moreover, as shown in FIG. 26, the liquid pouring source 126 is inclined with the point at which the liquid pouring source 126 and the liquid storage body 33 abut each other as the tilting center so that the spout 127 of the liquid pouring source 126 is toward the lower side, and thus, the ink in the liquid pouring source 126 is poured into the first ink chamber 151 via the filler port 73 of the liquid storage body 33.

At this time, if the user vigorously inclines the liquid pouring source 126, the ink flowed out from the spout 127 of the liquid pouring source 126 is off from the filler port 73, and thus, the ink may be poured into the periphery of the filler port 73 in the liquid receiving surface 116. Even in this case, the peripheral walls 117 surrounding the periphery of the liquid receiving surface 116 retain the ink poured into the liquid receiving surface 116, and thus, the ink is suppressed from flowing the outside from the liquid receiving surface 116. Moreover since the liquid receiving surface 116 is inclined downward toward the filler port 73 in the left-right direction X and the front-rear direction Y, the ink attached to the liquid receiving surface 116 is guided up to the filler port 73 along the inclination of the liquid receiving surface 116.

If the pouring of the ink ends, as shown in FIG. 9A, the filler port 73 of the liquid storage body 33 is covered by the covering body 120 placed on the rear surface 74*a* of the open-close cover 74, and as shown in FIG. 2, the open-close cover 74 is displaced to the closed cover position, and the pouring operation ends.

Figure 27:
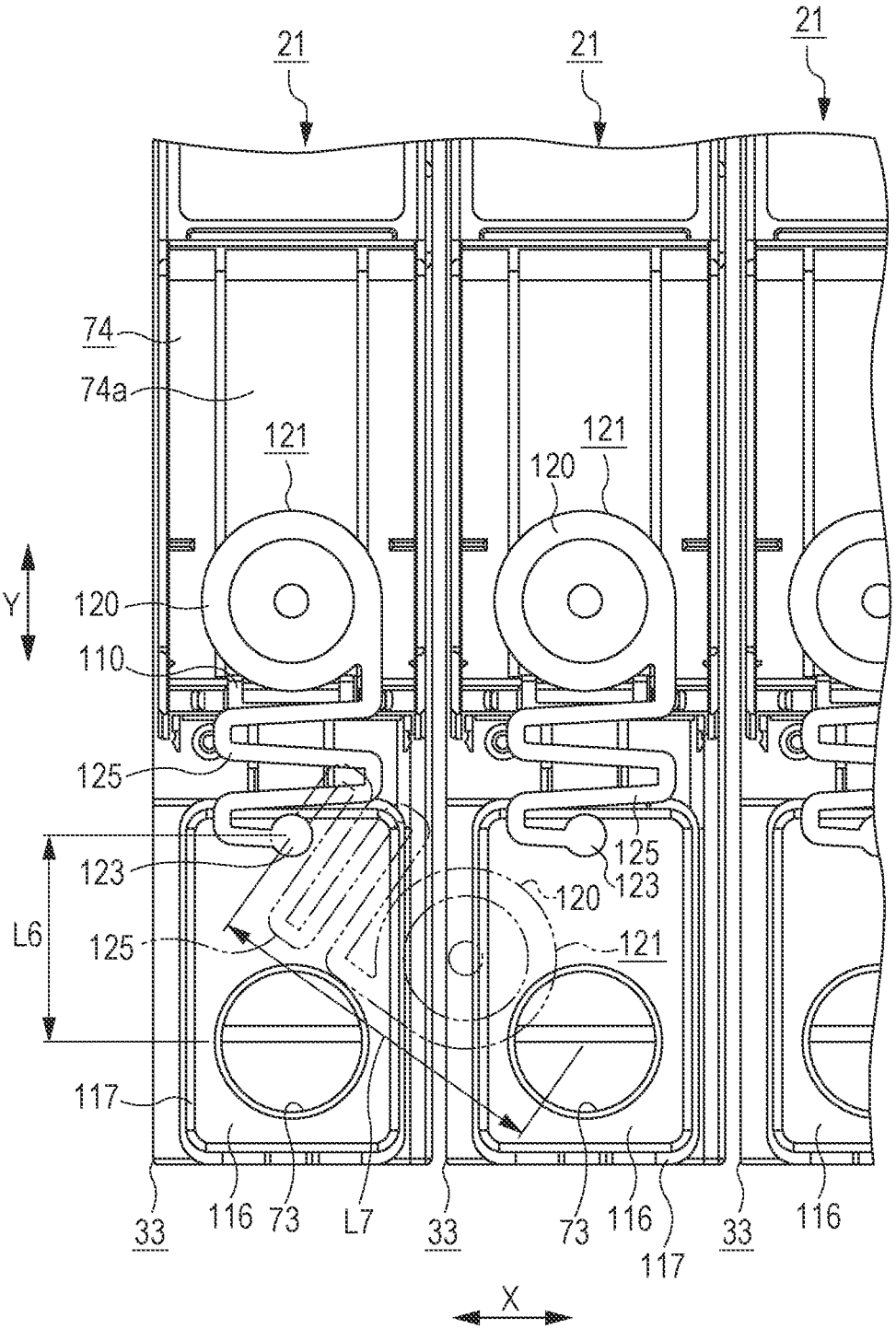
FIG. 27 is a plan view showing a rotation range about a fixing portion of a covering member which is included in the liquid storage container.

In addition, as shown in FIG. 27, in a state where a plurality of liquid storage containers 21 are juxtaposed and used, a distance L6 from the fixing portion 123 (fixing hole 124) of the covering member 121 in one liquid storage container 21 (for example, in the left end) to the filler port 73 is shorter than a distance L7 from the fixing portion 123 in the one liquid storage container 21 to the filler port 73 in the other liquid storage container 21 juxtaposed to the one liquid storage container 21. In this way, as shown in FIG. 27, even if the covering body 120 of the covering member 121 provided to correspond to the liquid storage body 33 positioned at the left end is toward (shown by two-dot chain lines in FIG. 27) the filler port 73 of the juxtaposed liquid storage body 33 with the fixing portion 123 as the rotational center, the covering body 120 cannot cover the filler port 73. Moreover, in a plan view shown in FIG. 27, the distances L6 and L7 indicate a distance which connects the center positions of the fixing portion 123 (fixing hole 124) and the filler port 73.

Next, the operation in the liquid storage body 33 when the ink is poured from the filler port 73 will be described.

As shown in FIG. 14, if the ink is poured from the filler port 73, a liquid surface of the first ink chamber 151 is raised, and the ink flows into the second ink chamber 152 via the wall communication opening 155. Moreover, since the concave portion 154 formed in the first ink chamber 151 is formed so as to be positionally shifted to the filler port 73 in the front-rear direction Y, even if foreign substances are accumulated in the concave portion 154, scattering of the foreign substances is suppressed.

Moreover, the first ink chamber 151 and the second ink chamber 152 communicate with each other via the wall ventilation opening 156. Accordingly, the pressure in the first ink chamber 151 is approximately the same as the pressure in the second ink chamber 152, and thus, the liquid surfaces of the ink in the first ink chamber 151 and the second ink chamber 152 are raised so as to be the approximately same height as each other in the up-down direction Z.

Since the rib communication openings 161 are formed in the both ends of each of the third horizontally inclined rib portion 158*c* and the fourth horizontally inclined rib portion 158*d*, the ink passes through the rib communication openings 161, and the liquid surfaces of the ink are positioned at the position which is approximately the same as each other at both of the third horizontally inclined rib portion 158*c* and the fourth horizontally inclined rib portion 158*d*. In addition, the ink passes through the gap formed between the first horizontally inclined rib portion 158*a* and the second horizontally inclined rib portion 158*b*, and the film 133, and the liquid surface of the ink moves up to the position above the first horizontally inclined rib portion 158*a* and the second horizontally inclined rib portion 158*b*. Moreover, the liquid surface of the ink is further raised, the ink is spread to go up the inclined bottom surface 152*a*, and the ink passes through the rib communication opening 161 of the rib communication openings 161 of the fourth to the ninth intersection rib portions 157*d* to 157*i*, and the liquid surface is raised.

Moreover, rib ventilation openings 160 are formed in the intersection rib portions 157*a* to 157*i* respectively. Accordingly, the pressure of spaces of both sides of the intersection rib portions 157*a* to 157*i* in the second ink chamber 152 is approximately the same as each other. Therefore, the liquid surface of the ink in the second ink chamber 152 is also raised so as to be approximately the same as each other in the up-down direction Z.

However, in the liquid storage body 33 including the filler port 73, foreign substances such as dust are mixed to the filler port 73, the foreign substances themselves are accumulated, the ink is dried at a gas-liquid interface, or the like, and thus, the ink itself may be the foreign substances. In addition, in the first ink chamber 151, the foreign substances are accumulated in the opposite surface 153 and the concave portion 154. Moreover, since the wall communication opening 155 is formed to be away from the concave portion 154, entering of the foreign substances is suppressed compared to the inflow of the ink to the second ink chamber 152. That is, among foreign substances entering the filler port 73, foreign substances having particularly large sizes or foreign substances having a large weight easily stay in the first ink chamber 151.

Moreover, in the second ink chamber 152, according to lapse of time, the foreign substances are accumulated in the horizontally inclined rib portions 158*a* to 158*d* in the front side region, and the foreign substances are accumulated on the bottom surface 152*a* in the rear side region. In addition, since the horizontally inclined rib portions 158*a* to 158*d* and the bottom surface 152*a*, in which the foreign substances are accumulated, are inclined to be intersected in the front-rear direction Y, if the ink is led out from the lead-out port 69 and the liquid surface of the ink is lowered, the foreign substances move in one direction (downward direction) according to the movement of the liquid surface.

Moreover, if the ink is poured from the filler port 73, bubbles may enter according to the pouring of the ink. Moreover, if the bubbles penetrate the second ink chamber 152 and dissolved gas becomes bubble in the second ink chamber 152, the bubbles moves upward and reaches the horizontally inclined rib portions 158*a* to 158*d*. With respect to this, in the embodiment, since the horizontally inclined rib portions 158*a* to 158*d* are intersected with respect to the front-rear direction Y, the bubbles move along the horizontally inclined rib portions 158*a* to 158*d* and are introduced to the liquid surface.

Moreover, the ink in the second ink chamber 152 flows from the channel opening 162 to the outlet channel 138 and is lead out from the lead-out port 69. That is, first, in the ink which is led out from the channel opening 162, the foreign substances or bubbles are trapped, by the filter 166. Thereafter, the ink flows to the curved channel portion 163 via the second connection channel portion 164*b* and the third connection channel portion 164*c*.

Moreover, since the flow direction of the ink is changed in the curved channel portion 163, the dissolved gas in the ink is easily grown to bubbles. With respect to this, in the configuration, since the cross-sectional area of the curved channel portion 163 is larger than the cross-sectional area of the third connection channel portion 164*c*, the generated bubbles move to the inclination channel portion 165 side according to the flow of the ink. Moreover, the cross-sectional area of the inclination channel portion 165 is larger than the cross-sectional area of the third connection channel portion 164*c* and the inclination channel portion 165 become the surface inclined upward toward the lead-out port 69 side. Accordingly, the bubbles generated in the curved channel portion 163 move to the lead-out port 69 side through the inclination channel portion 165, and led out from the lead-out port 69 along with the ink.

Next, an operation of the float valve 131 will be described.

The state shown in FIG. 19 shows a state where a liquid surface line IL of the ink in the ink chamber 137 is considerably above a line EL at the time of the threshold remaining amount, that is, a state where the remaining amount of the ink in the ink chamber 137 is sufficient to continue the printing by ejecting the ink from the liquid ejecting head 24 with respect to the paper S. Accordingly, in the state shown in FIG. 19, since the sum of the second biasing force of the coil spring 195 and the buoyancy of the float member 181 is equal to or more than the first biasing force of the coil spring 184, the float member 181 is not pushed downward by the first biasing force of the coil spring 184, and thus, the valve body 182 does not abut the valve opening 192.

That is, in this case, as shown in FIG. 19, the sum of the buoyancy generated from each air chamber 187 of the float member 181 is larger than the first biasing force of the coil spring 184, and the float member 181 floats at the position separated upward from the valve body 182. On the other hand, since the valve body 182 is not pressed downward from the coil spring 184 via the float member 181, the valve body 182 receives only the second biasing force which acts upward from the coil spring 195, is separated upward from the valve opening 192, and is positioned at the opened valve position at which the outlet channel 138 is opened.

Moreover, if the printing is continued from the state of FIG. 19, the remaining amount of the ink in the ink chamber 137 is gradually decreased. Accordingly, if the liquid surface line IL of the ink approaches the line EL at the time of the threshold remaining amount, as shown in FIG. 28, the sum of the buoyancy of the float member 181 and the second biasing force of the coil spring 195 and the first biasing force of the coil spring 184 balance each other. Therefore, the float member 181 is pressed downward by the first biasing force of the coil spring 184, and the pressing portion 189 of the lower surface of the float member 181 abuts the valve body 182, which is positioned at the opened valve position, from the above. In addition, at this time, the float member 181 abuts the valve body 182 from the above. However, the float member 181 does not reach until the float member causes the valve body 182 to displace toward the closed valve position of the lower side.

Moreover, if the printing is further continued from the state shown in FIG. 28, the remaining amount of the ink in the ink chamber 137 is further decreased. Accordingly, if the liquid surface line IL of the ink is below the line EL at the time of the threshold remaining amount, as shown in FIG. 29, the sum of the buoyancy of the float member 181 and the second biasing force of the coil spring 195 is smaller than the first biasing force of the coil spring 184. Therefore, the float member 181 is further pressed downward by the first biasing force of the coil spring 184, and presses the valve body 182, which is positioned at the opened valve position, downward by the pressing portion 189 of the lower surface of the float member 181. As a result, the valve body 182 is displaced to the closed valve position at which the valve opening 192 is closed.

Accordingly, the valve opening 192 is closed, the outlet channel 138 is closed, and the ink does not flow to the downstream side of the valve opening 192. Therefore, the ink does not flow into the liquid chamber 53 disposed at the downstream side of the outlet channel 138, and as a result, the remaining amount detection rod 45 moves, and the state where the remaining amount detection rod 45 blocks the light between the light emitting portion and the light receiving portion of the sensor 68 is maintained. Accordingly, the sensor 68 detects that the remaining amount of the ink is less than the threshold remaining amount. Moreover, if new ink is poured into the ink chamber 137 from the filler port 73 according to the detected results, the liquid surface line IL of the ink in the ink chamber 137 is above the line EL at the time of the threshold remaining amount. Accordingly, the buoyancy of the float member 181 is larger than the first biasing force of the coil spring 184, and the float member 181 floats to be separated upward from the valve body 182.

At this time, in the valve body 182 which is pressed downward by the pressing portion 189 of the float member 181 biased downward by the first biasing force of the coil spring 184 and is positioned at the closed valve position in which the valve opening 192 is closed, if the state of the closed valve position is lengthened, even after the pressing from the above due to the float member 181 is released, the valve body 182 may be stuck to the valve opening 192. With respect to this, in the case of the embodiment, since the second biasing force of the coil spring 195 biases the valve body 182, which is positioned at the closed valve position, toward the opened valve position of the upper side, even if the valve body 182 is temporarily stuck to the valve opening 192, the valve body 182 is separated from the valve opening 192 and is released from the stuck state.

Moreover, if the ink is strongly poured from the filler port 73 into the ink chamber 137, the inflow pressure of the ink in the ink chamber 137 at the time of the pouring may be increased. Accordingly, if the thin film member 186, which forms the air chamber 187 by closing the opening portion 185*a* of the frame body 185 in the float valve 131, directly receives the strong inflow pressure, there is a concern that the thin film member 186 may be damaged. With respect to this, in the case of the embodiment, the float valve 131 is disposed in the second ink chamber 152 which is partitioned by the partition wall 150 to the first ink chamber 151 in which the filler port 73 is formed. Accordingly, the ink poured from the filler port 73 is prevented from directly falling on float valve 131 from the above.

Moreover, even if the ink strongly flows from the first ink chamber 151 side to the second ink chamber 152 side via the wall communication opening 155 formed in the partition wall 150, there is a concern that the thin film member 186 of the float member 181 in the float valve 131 may be damaged by the inflow pressure. With respect to this, in the embodiment, the float member 181 is disposed in the second ink chamber 152 so that the thin film member 186 is disposed to be non-opposite to the front-rear direction Y which is the inflow direction of the ink into the second ink chamber 152 via the wall communication opening 155, that is, the thin film member 186 is disposed along the front-rear direction Y. Accordingly, the inflow pressure of the ink, which flows into the second ink chamber 152 from the wall communication opening 155, acts on the thin film member 186 of the float member 181 so that the ink flows in the front-rear direction Y along the film surface with respect to the thin film member 186 of the float member 181.

Moreover, the thin film member 186 in the float member 181 is partially damaged due to deterioration over time, or the like, and thus, some of the plurality of (four in the embodiment) air chambers 187 may not be closed. In addition, in this case, since the entire buoyancy of the float member 181 is decreased, the valve function of the float valve 131 may be damaged. However, in the embodiment, even if only one air chamber 187 functions, the sum of the buoyancy generated by the one air chamber 187 and the second biasing force of the coil spring 195 is set to be equal to or more than the first biasing force of the coil spring 184 when the remaining amount of the ink is equal to or more than the threshold remaining amount. Accordingly, even if only air chamber 187 functions, the valve function of the float valve 131 is surely exerted without damage.

In addition, if the float member 181 floats in the up-down direction Z according to the change of the remaining amount of the ink in the ink chamber 137, the rod shaped portion 190 is inserted into the insertion hole 198*a* of the cylindrical portion 198, and thus, the float member 181 is positioned in the front-rear direction Y and the left-right direction X. Moreover, since the convex portions 188 which protrude from both the front and rear surfaces of the frame body 185 are inserted into the long guide holes 201 of the regulation case 183, the rotation of the float member 181 with the rod shaped portion 190 as the center is regulated. In addition, the float member 181, in the state where the coil spring 184 is placed, floating to the position above the opened valve position of the valve body 182 is regulated by the upper surface of the cylindrical portion 198 in the regulation case 183.

Moreover, if the float member 181 floats in the front-rear direction Y and the left-right direction X in the ink chamber 137, for example, the thin film member 186 coming into surface contact with the opposite side walls 196*a* of the regulation case 183 is regulated by abutting the cross shaped plate shaped portion 191 and the inner side surface of the cylindrical portion 198 each other in the horizontal direction. That is, in the state where the rod shaped portion 190 is inserted into the insertion hole 198*a* of the cylindrical portion 198, the float member 181 is set so that a gap distance between the tip edge in the radiation direction of the plate shaped portion 191 and the inner side surface of the cylindrical portion 198 is shorter than a gap distance between the thin film member 186 and the inner surface of each of the left and right side walls 196*a* of the regulation case 183. Accordingly, the thin film member 186 of the float member 181 coming into surface contact with both side walls 196*a* of the regulation case 183 opposite to the thin film member 186 is regulated. In this point, the plate shaped portion 191 severs as an example of a regulation abutment portion which regulates the surface contact between surfaces which are opposite to each other in the horizontal direction of the regulation case 183 and the float member 181.

In addition, in this case, in the side walls 196*a* of the regulation case 183 and the thin film member 186 of the float member 181 opposite to each other in the left-right direction X, since the rectangular cut out portions 199 are formed in the side walls 196*a* of the regulation case 183, the thin film member 186 sliding on the inner surface of the side wall 196*a* of the regulation case 183 and being damaged is also suppressed.

Moreover, particularly, if the float member 181 floats upward in the regulation case 183, the ink in the regulation case 183 is pressed from downward by the float member 181, and thus, there is a concern that the ink pressure may be increased. With respect to the increase of the ink pressure, in the embodiment, flowing out of the ink from the through holes 202 and the cut out portions 199 formed in the plurality of places of the regulation case 183 is allowed, and thus, the ink pressure is suppressed from being increased unnecessarily.

According to the embodiment, the following effects can be obtained.

(1) In the liquid storage container 21, since the filler port 73 is formed in the first portion (first storage body portion 37) of the liquid storage body 33 positioned outside the printer 11, the pouring of the ink can be performed in the state where the liquid storage body 33 is fixed to the printer 11. Accordingly, damage at the time of the ink pouring or spill of the liquid remaining in the inner portion can be suppressed. Moreover, there is a high probability that the liquid storage body 33 is held to the printer 11 without falling due to the second portion (second storage body portion 38) of the liquid storage body 33, which is positioned inside the printer 11, when the fixed state is released.

(2) In the liquid storage container 21, the circuit substrate 75, which records the relevant information of the ink poured into the liquid storage body 33 fixed so as to be unmovable, can move from outside the printer 11 to inside the printer 11 using the slider 34 which slides with respect to the liquid storage body 33. Accordingly, when the circuit substrate 75 moves into the printer 11, for example, if the circuit substrate 75 is designed to contact the electric terminal 78 or the like provided in the printer 11, the relevant information of the ink poured into the liquid storage body 33 can be correctly transferred to the printer 11. In addition, after the circuit substrate 75 is placed on the circuit substrate holder 76, which is included in the moving portion of the slider 34, from outside the printer 11, the placed circuit substrate 75 can be easily inserted into the printer 11 by the sliding of the slider 34.

(3) Since the filler port 73 is covered by the slider 34, entering of the foreign substances to the filler port 73 can be suppressed without a separate cover for the filler port 73.

(4) In the state where the filler port 73 is covered by the slider 34, the filler port 73 can be covered or exposed by the displacement of the provided open-close cover 74 without sliding the slider.

(5) In the state where the open-close cover 74 is displaced from the closed cover position to the opened cover position, the open-close cover 74 is positioned at the printer 11 side with respect to the filler port 73. Accordingly, the open-close cover 74 does not hinder the pouring of the ink to the filler port 73.

(6) Since the open-close cover 74 can be stably maintained at the closed cover position, careless opening of the open-close cover 74 and exposure of the filler port 73 can be suppressed.

(7) Since the circuit substrate holder 76 is positioned in the direction intersecting the movement direction of the moving portion of the circuit substrate holder 76 in the printer 11, the circuit substrate 75 placed on the circuit substrate holder 76 is accurately positioned in the printer 11. Accordingly, since the electric terminal 78 included in the printer 11 contacts the circuit substrate 75 in the state where the positional displacement is suppressed, the transfer of the relevant information recorded in the circuit substrate 75 to the printer 11 is performed with high probability.

(8) Since the movement of the circuit substrate holder 76 in the sliding direction of the slider 34 is suppressed, the circuit substrate holder 76 is accurately positioned in the sliding direction of the slider 34 in the printer 11. Moreover, since the circuit substrate 75 placed on the circuit substrate holder 76 is inclined in the sliding direction of the slider 34, for example, the electric terminal 78 included in the printer 11 moves while rubbing the circuit substrate 75 (terminals (including the contact portion 75*b*) 75*a*) and is electrically connected to the circuit substrate. Accordingly, the reliability of electrical conduction is increased.

(9) If the user pours the ink to the first ink chamber 151 (ink chamber 137) of the liquid storage body 33 via the filler port 73, even if the ink drops to the periphery of the filler port 73, the ink can be received by the liquid receiving surface 116. Moreover, since the liquid receiving surface 116 is inclined downward (in the gravity direction) toward the filler port 73, the ink received by the liquid receiving surface 116 is guided up to the filler port 73 along on the inclined liquid receiving surface 116. Accordingly, if the ink is poured into the filler port 73 of the liquid storage container 21, even though the ink drops to the periphery of the filler port 73, contamination of the ink in the periphery along the outer surface of the liquid storage container 21 from the periphery of the filler port 73 can be suppressed.

(10) If the ink is poured into the first ink chamber 151 of the liquid storage body 33, the ink can be suppressed from overflowing the outside of the liquid receiving surface 116 due to the peripheral walls 117 which surround the periphery of the liquid receiving surface 116.

(11) If the user pours the ink to the first ink chamber 151 via the filler port 73 from the liquid pouring source 126, the liquid pouring source 126 can be positioned by abutting the liquid pouring source 126 to the cut out groove 118 of the peripheral wall 117. According to this, the user can stably pour the ink if the ink is poured from the liquid pouring source 126 to the first ink chamber 151.

(12) The covering body 120 which covers the filler port 73 is fixed to the liquid storage body 33 via the connecting portion 125 and the fixing portion 123. Accordingly, if the covering body 120 is removed from the filler port 73, there can be a less concern that the covering body 120 may be lost. Moreover, the filler port 73 is covered by the covering body 120, and thus, evaporation of the ink from the first ink chamber 151 or mixing of foreign substances to the first ink chamber 151 can be suppressed.

(13) If the ink is poured, the covering body 120 can be placed on the rear surface 74*a* of the open-close cover 74 which is positioned at the opened cover position. Accordingly, if the user pours the ink to the first ink chamber 151, for example, performing the pouring of the ink in a state where the covering body 120 is held by one hand and the hand is not usable can be suppressed.

(14) If the covering body 120 is placed on the open-close cover 74 positioned at the opened cover position, even if the ink is attached to the covering body 120, the ink can be suppressed from being leaked to the outside of the open-close cover 74 by the shielding portion.

(15) The covering body 120 can be placed so as to enter the region of the rear surface 74*a* of the open-close cover 74 which is positioned at the opened cover position. Moreover, even if the ink is attached to the placed covering body 120, since the rear surface 74*a* of the open-close cover 74 is inclined downward (gravity direction) toward the filler port 73, the ink is suppressed from spreading over the entire region of the rear surface 74*a*.

(16) Since the connecting portion 125 of the covering member is bent, the covering body 120 can be placed on the liquid receiving surface 116 with improved storing ability. Moreover, compared to a case where the connecting portion 125 is linearly formed, in the case where the ink is attached to the covering body 120 if the covering body 120 is removed from the filler port 73, the ink cannot be easily transmitted to the connecting portion 125.

(17) Since the fixing portion 123 is fixed at a higher place than the filler port 73 on the liquid receiving surface 116, if the ink is poured into the liquid storage body 33, the ink flowing the liquid receiving surface 116 cannot be easily attached to the fixing portion 123 of the covering member 121. Accordingly, for example, influence of the fixing state of the fixing portion 123 due to attachment of the ink to fixing portion 123 and solidification of the ink can be suppressed.

(18) If the user pours the ink having a plurality of kinds to the plurality of liquid storage containers 21 (ink chamber 137), the covering body 120 provided to correspond to one liquid storage container 21 can be suppressed from covering the filler port 73 of other liquid storage containers 21 juxtaposed to the one liquid storage container 21. According to this, the covering body 120 provided to correspond to the one liquid storage container 21 covering the filler ports 73 of other liquid storage containers 21 and the ink being mixed into the ink chambers 137 of other liquid storage containers 21 via the covering body 120 can be suppressed.

(19) The wall communication opening 155 is positioned at the position twisted to the filler port 73 and at the position away from the opposite surface 153. Accordingly, if the ink poured from the filler port 73 flows into the second ink chamber 152 via the wall communication opening 155, compared to the ink, the foreign substances mixed from the filler port 73 or the foreign substances generated in the first ink chamber 151 do not easily pass through the wall communication opening 155. That is, since the foreign substances can easily stay in the first ink chamber 151, the ink in which the mixing of the foreign substances is suppressed flows into the second ink chamber 152. Accordingly, even if the foreign substances are mixed from the filler port 73 or the foreign substances are generated in the inner portion, there is a less concern that the mixed foreign substances may be led out from the lead-out port 69, and improved ink can be led out.

(20) Since the concave portion 154 recessed in the gravity direction is formed on the opposite surface 153, even if the foreign substances staying in the first ink chamber 151 are settled with time, the foreign substances can be accumulated in the concave portion 154. That is, if the ink is poured from the filler port 73 in the state where the foreign substances are accumulated in the concave portion 154, the accumulated foreign substances can be suppressed from being scattered from the inner portion of the concave portion 154 to the outside of the concave portion 154.

(21) The mixed or the generated foreign substances can be accumulated in the concave portion 154. Moreover, since the concave portion 154 is provided so as to be positionally shifted to the filler port 73 in the direction intersecting the gravity direction, the scattering of the foreign substances accumulated in the concave portion 154 can be further suppressed if the ink is poured from the filler port 73.

(22) The distance L1 between the channel opening 162 and the partition wall 150 is shorter than the distance L2 between the upper end of the concave portion 154 and the lower end of the wall communication opening 155, and thus, the channel opening 162 can be formed at the position close to the partition wall 150. Accordingly, there can be a less concern that the foreign substances passing through the wall communication opening 155 along the ink from the first ink chamber 151 side to the second ink chamber 152 side may be settled in the channel opening 162 and may enter the outlet channel 138.

(23) Even if the foreign substances enter the second ink chamber 152 or the foreign substances are generated in the second ink chamber 152, the foreign substances settled in the second ink chamber 152 can be accumulated on the horizontally inclined rib portions 158*a* to 158*d*. Accordingly, the foreign substances can be suppressed from being mixed into the ink which is led out from the channel opening 162, which is positioned to the gravity direction side from the horizontally inclined rib portions 158*a* to 158*d*, to the outlet channel 138.

(24) Since the horizontally inclined rib portions 158*a* to 158*d* extend along the direction intersecting with respect to the up-down direction Z and the front-rear direction Y, the foreign substances accumulated in the horizontally inclined rib portions 158*a* to 158*d* can be collected in one direction according to the decrease of the ink stored in the second ink chamber 152.

(25) For example, if the foreign substances are accumulated in the float member 181, there is a concern that malfunction of the float valve 131, which displaces the valve body 182 using the float member 181 which floats according to the change of the remaining amount of the ink, may occur due to the weight of the accumulated foreign substance. With respect to this, since the foreign substances can be accumulated in the horizontally inclined rib portions 158*a* to 158*d* which are provided to the antigravity direction side from the float valve 131, the foreign substances settled in the second ink chamber 152 can be suppressed from being accumulated in the float member 181.

(26) Even if the foreign substances accumulated in the third horizontally inclined rib portion 158*c* and the fourth horizontally inclined rib portion 158*d* move according to the change of the remaining amount of the ink stored in the second ink chamber 152, and fall from the third horizontally inclined rib portion 158*c* and the fourth horizontally inclined rib portion 158*d*, the foreign substances can fall so as to avoid the float valve 131.

(27) After the ink led out from the channel opening 162 passes through the filter 166, the ink can flow to the float valve 131 side. That is, for example, the foreign substances, which have relatively large sizes among the foreign substances mixed into the ink in the first ink chamber 151 from the filler port 73, stay in the first ink chamber 151, and are accumulated in the horizontally inclined rib portions 158*a* to 158*d* in the second ink chamber 152. Accordingly, since the foreign substances, which is mixed to the ink led out to the outlet channel 138 from the channel opening 162, have relatively small sizes, compared to the case where large foreign substances enter, even in a case where the foreign substances enter from the channel opening 162, clogging of the outlet channel 138 is suppressed. Moreover, since the ink passes through the filter 166 provided in the outlet channel 138, the foreign substances, which are mixed into the ink led out from the lead-out port 69, can be further decreased.

(28) Since the area of the wall communication opening 155 is smaller than the area of the filler port 73, if foreign substances having large sizes are mixed from the filler port 73, there can be a less concern that the foreign substances may enter the second ink chamber 152 over the wall communication opening 155.

(29) Bubbles in the ink easily stay at the bent portions in the outlet channel 138. With respect to this, the bubbles positioned at the curved channel portion 163 are introduced to the lead-out port 69 side via the inclination channel portion 165. Accordingly, for example, there can be a less concern that bubbles staying in the curved channel portion 163 may be grown and may block the outlet channel 138, and thus, the ink can be led out while influence of the bubbles is decreased.

(30) Before the ink flows up to the curved channel portion 163 in which bubbles easily stay, the ink passes through the filter 166, and thus, bubbles, which previously occur, can be trapped in advance.

(31) Since bubbles generated in the ink chamber 137 move upward the gravity direction, the channel opening 162 is opened to the bottom surface 152*a*, and thus, there can be a less concern that the bubbles may enter the outlet channel 138 from the channel opening 162.

(32) The horizontally inclined rib portions 158*a* to 158*d* are formed, and thus, the ink chamber 137 can be reinforced. Moreover, since the horizontally inclined rib portions 158*a* to 158*d* extend along the direction intersecting the horizontal direction, if bubbles are generated in the ink stored in the ink chamber 137, the bubbles can move along the horizontally inclined rib portions 158*a* to 158*d*. That is, there can be a less concern that the bubbles may be trapped by the horizontally inclined rib portions 158*a* to 158*d*.

(33) The bottom surface 152*a* of the ink chamber 137 can be inclined along the inclination channel portion 165. That is, in the inclination channel portion 165, since the channel opening 162 side is formed to be lower, the ink in the ink chamber 137 can collected at the channel opening 162 side.

(34) Since the cross-sectional area of the inclination channel portion 165 is large, there can be a less concern that the inclination channel portion 165 may be blocked by the bubbles generated in the curved channel portion 163.

(35) Even if bubbles are generated in the wall communication opening 155, since the upper surface 155*c* of the anti-gravity direction side is inclined, there can be a less concern that bubbles may stay at the wall communication opening 155.

(36) Due to the wall ventilation opening 156 formed in the partition wall 150, the pressure difference between the first ink chamber 151 and the second ink chamber 152 can be decreased. In addition, since the wall ventilation opening 156 formed in the partition wall 150 is formed to be closer to the ceiling surface 137*b* than the rib ventilation openings 160 formed in the intersection rib portions 157*a* to 157*i*, there can be a less concern that the ink in the second ink chamber 152 may enter the first ink chamber 151 from the wall ventilation opening 156.

(37) The positioning protrusion 141 is formed, and thus, deviation of the air passage formation film 147 is suppressed, and the air passage formation film 147 can be easily adhered to the meander grooves 142 and 143.

(38) Since the filter 166 is mounted on the first channel formation concave portion 168*a* formed on the lower surface 40 of the storage body case 130, the filter 166 can be easily exchanged.

(39) In the float valve 131 which is disposed in the second ink chamber 152 of the liquid storage body 33, the thin film member 186 which closes the opening portion 185*a* of the air chamber 187 does not directly receive the inflow pressure of the ink which flows into the second ink chamber 152 by the pouring of the filler port 73. That is, the inflow pressure of the ink acts along the film surface of the thin film member 186. Accordingly, even if the ink is strongly poured from the outside into the first ink chamber 151 of the ink chamber 137 through the filler port 73, the inflow pressure of the ink can be suppressed from strongly acting on the thin film member 186 of the float member 181 in the second ink chamber 152 via the first ink chamber 151 in the direction in which the thin film member 186 is pressed. Therefore, the float valve 131 disposed inside the second ink chamber 152 is not damaged by the inflow pressure of the ink poured from the outside, and an appropriate valve operation can be maintained.

(40) Since the float valve 131 is disposed in the second ink chamber 152 which is partitioned by the partition wall 150 to the first ink chamber 151 in which the filler port 73 is formed, the ink poured from the outside via the filler port 73 directly falling on the float valve 131 can be avoided, and thus, there may be a decreased concern for the float valve 131 being damaged.

(41) Even if one air chamber 187 of the plurality of (four in the embodiment) air chambers 187 is damaged and the sealed state fails, if the volume of the air chambers 187 is designed so that the total of the volume of other residual air chambers 187 generates the desired buoyancy in the float member 181, the function of the float valve 131 can be favorably maintained.

(42) Particularly, if the remaining amount of the ink is equal to or more than the threshold remaining amount by the pouring of the ink via the filler port 73 from the state where the remaining amount of the ink is less than the threshold remaining amount for long time and the valve body 182 is positioned at the closed valve position, the valve body 182 can be suppressed from being the stuck state at the closed valve position, and the valve body 182 can be rapidly displaced from the closed valve position to the opened valve position.

(43) The inflow pressure of the ink flowing into the second ink chamber 152 directly applying to the float member 181 is suppressed by the annular wall portion 196 of the regulation case 183, and if the float member 181 floats in the up-down direction Z, there can be a less concern that the float member 181 slides the annular wall portion 196 of the regulation case 183 in a surface contact state and a movement resistance may be generated.

(44) If the float member 181 floats in the vertical direction, there can be a less concern that the thin film member 186 slides the annular wall portion 196 of the regulation case 183 and may be damaged.

(45) If the float member 181 floats in the up-down direction Z, since the ink flowing between the inner side and the outer side of the annular wall portion 196 of the regulation case 183 via the through holes 202 is allowed, a smooth floating state of the float member 181 can be maintained according to the change of the remaining amount of the ink.

(46) Since there can be a less concern that the surfaces opposite to each other in the horizontal direction of the regulation case 183 and the float member 181, that is, the thin film member 186 and the side wall 196*a* may be fixed to each other by surface tension of the ink, an appropriate valve operation of the float valve 131 can be maintained.

(47) Since the valve body 182 can be displaced between the opened valve position and the closed valve position only by pressing the float member 181 to the valve body 182 with a small stroke, compactification of the float valve 131 can be achieved.

(48) Since the liquid storage container 21 includes the first portion positioned outside the printer 11 and the second portion inserted to the printer 11, and the lower portion of the first portion in which the filler port 73 is formed is configured to be lower than the lower portion of the second portion, for example, compared to a configuration in which the height of the lower surface of the first portion is the same as the height of the lower surface of the second portion and the first portion extends in the horizontal direction, the disadvantage that the entire size in the horizontal direction of the printer 11 including the liquid storage container 21 is increased can be prevented. Moreover, for example, if the first portion positioned outside the printer 11 extends in the horizontal direction, compared to the case where the lower portion of the first portion is lower than the lower portion of the second portion (the case where the first portion extends in the gravity direction), a force applied to the second portion is increased as the distance from the second portion inserted into the printer 11 is long, and thus, damage or the like of the second portion may occur. In addition, for example, due to similar reasons, the printer 11 may be inclined to the first portion side. With respect to this, the lower portion of the first portion is lower than the lower portion of the second portion, and thus, it is possible to decrease the probability of disadvantages such as the damage of the second portion or the inclination of the printer 11.

(49) Since the first portion having the larger capacity than that of the second portion is positioned outside the printer 11, compared to a case where the second portion having the smaller capacity than that of the first portion is positioned outside the printer 11, the user easily understands the remaining amount of the ink in the liquid storage container 21, and thus, it is possible to decrease the probability of disadvantages such as the ink being overflowed from the liquid storage container 21 due to excessive pouring of the ink or the printing being continued although the remaining amount of the ink is small.

(50) Since the height of the top face of the first portion is the same as the top face of the second portion, capacity enlargement of the liquid storage container 21 is achieved, and rising of the position of the filler port according to the capacity enlargement of the liquid storage container 21 can be prevented. If the height of the filler port 73 becomes high, when the user pours the ink, the disadvantage that the user should raise the container storing the ink for pouring up to the height of the filler port 73 can be prevented.

(51) Since the lengths in the short direction of the first portion and the second portion are the same as each other, when inserted into the printer 11, the user easily suppose the remaining amount in the second portion at which the remaining amount of the ink of the inner portion is not easily understood by the user, and thus, it is possible to decrease the probability of disadvantages such as the ink being overflowed from the liquid storage container 21 due to excessive pouring of the ink or the printing being continued although the remaining amount of the ink is small.

(52) Since the outlet 52 connected to the printer 11 is provided in the second portion which is inserted to the printer 11, compared to a case where the outlet 52 is provided at the first portion positioned outside the printer 11, it is possible to decrease the probability of the disadvantage such as the printer 11 and the outlet 52 not being connected to each other. Specifically, since the first portion is positioned outside the printer 11, the user may place materials on the upper portion of the first portion, or impact may be directly applied to the first portion due to accidental collision or the like. In this case, if the outlet 52 is provided in the first portion, the printer 11 and the outlet 52 may be disconnected from each other due to the impact. On the other hand, if the outlet 52 is provided in the second portion, the impact is also indirectly applied to the second portion. However, compared to the case where the outlet 52 is provided in the first portion, the received impact can be decreased.

(53) Since the fixed portion 37*a* engaging with the printer 11 is provided on the first surface of the insertion direction side of the liquid storage container 21 in the first portion, compared to a case where the fixed portion 37*a* is provided on the second surface opposite to the first surface, an increase in the size of the printer 11 can be prevented. Moreover, since the first surface is positioned at the insertion direction side, it is possible to decrease the probability of the disadvantage such as observation of the user with respect to the remaining amount in the liquid storage container 21 being hindered due to the fixed portion 37*a*.

(54) Since the filler port 73 is formed at the position closer to the second surface opposite to the first surface than the first surface of the second portion side, in the first portion, although the ink is overflowed outside the filler port 73 by mistake when the user pours the ink, it is possible to decrease the probability of the disadvantage such as contamination due to attachment of the ink to printer 11. Moreover, since the first surface is the surface closer to the liquid consumption apparatus than the second surface, the filler port 73 is provided at the position closer to the second surface, and thus, it is possible to decrease the probability of the disadvantage such as the user being not able to visually recognize the state of the pouring being not capable of being visually recognized due to the printer 11.

(55) Since the atmosphere communication hole 140 is formed between the filler port 73 and the second portion in the first portion, it is possible to decrease the probability of the disadvantage such as the ink, which hangs down along a portion of an ink supplement container which is positioned in a blind spot of the user when the user pours the ink from the ink supplement container in which the ink for pouring is stored, entering the atmosphere communication hole 140 and blocking atmosphere communication hole 140.

(56) Since the second portion of the liquid storage container 21 and the printer 11 are connected to each other to be swung, even if a force is applied to the first portion when the ink is poured, the connection can be maintained, and thus, it is possible to decrease the probability of the disadvantage such as disconnection between the liquid storage container and the printer.

Moreover, the embodiment may be modified to other embodiments as follows.

In the embodiment, the second portion (a portion of the liquid storage container 21 positioned inside the apparatus main body 14) may be the portion which contacts the guide groove 84 provided in the mounting portion 31 in the liquid storage container 21. Accordingly, the first portion (a portion of the liquid storage container 21 positioned outside the apparatus main body 14) may be a portion other than the second portion in the liquid storage container 21 or a portion which does not contact the guide groove 84 provided in the mounting portion 31 in the liquid storage container 21.

In the embodiment, the mounted member 50 can be swung to the liquid storage body 33. However, the embodiment is not limited to the mounted member 50, and the material corresponding to the mounted member is not necessarily limited to the mounted member 50 if the liquid storage body 33 and the printer 11 are connected to each other to be swung.

In the embodiment, the circuit substrate holder 76 may be provided in the slider 34 to be inserted into the slider 34 in the direction along the sliding direction of the slider 34 with respect to the liquid storage body 33, that is, the direction along the longitudinal direction. Moreover, the circuit substrate 75 mounted to the circuit substrate holder 76 is not necessarily inclined in the sliding direction of the slider 34, and for example, may be placed on the circuit substrate holder 76 in a state where the circuit substrate 75 is parallel in the sliding direction and in a state where the circuit substrate 75 is orthogonal to the sliding direction.

In the embodiment, when the moving portion of the slider 34 moves in the printer 11, the groove shaped portion 107, which is an example of the positioning shape portion positioned in the printer 11, may not necessarily be provided in the circuit substrate holder 76. For example, when the slider 34 is inserted into the mounting portion 31 in a state where the slider 34 is positioned to the communication portion 77, the positioning shape portion is not needed.

In the embodiment, the engagement portion (groove 112) between the slider 34 and the open-close cover 74 may not necessarily be provided in the slider 34. For example, if the open-close cover 74 is engaged in a state where the bearing portion 90 of the open-close cover 74 is interference-fitted to the rotation axis 89 of the slider 34, since the rotation load can be obtained by the interference-fit, the engagement portion is not needed.

In the embodiment, the open-close cover 74 may not have necessarily a configuration in which the open-close cover 74 rotates with the axis extending along the short direction of the liquid storage body 33 as the rotational center. For example, a configuration, in which the open-close cover 74 move to be parallel to the slider 34 in the longitudinal direction and is displaced from the closed cover position to the opened cover position, may be adopted.

In the embodiment, the open-close cover 74 may not necessarily be provided in the slider 34 which is provided to cover the filler port 73. In this case, the filler port 73 of the ink may be exposed by extracting the slider 34 from the printer 11 (mounting portion 31).

In the embodiment, the filler port 73 may not necessarily be provided on the upper surface 39 which becomes the anti-gravity direction side in the liquid storage body 33. For example, the filler port 73 may be provided on the side surface which is positioned at the horizontal direction side. Moreover, the slider 34 may not necessarily be provided in the state where the slider 34 covers the filler port 73. In this case, the filler port 73 may be covered by a member different from the slider 34.

In the embodiment, the circuit substrate holder 76 is not necessarily mounted to the holder mounting portion 86 of the slider 34. For example, the circuit substrate holder 76 may be integrally formed to a portion of the slider 34. Moreover, the circuit substrate 75 supported by the holder 76 may be a flexible circuit substrate. In addition, the circuit substrate 75 may be configured of combination of a flexible material and a substrate. That is, the circuit substrate 75 means both a substrate in which circuits, terminals, memory, or the like configuring the circuit substrate 75 are provided in the substrate structurally different from each other or a substrate in which circuits, terminals, memory, or the like are integrally provided. Accordingly, the circuit substrate 75 being inclined means a state where at least one of the above-described configurations is inclined. Moreover, in the embodiment, the circuit substrate 75 is inclined. However, the circuit substrate 75 may be inclined in a state where at least the terminal 75*a* or the contact portion 75*b* provided in the circuit substrate 75 is electrically connected to the electric terminal 78 included in the communication portion 77. In addition, as described above, the circuit substrate 75 is an example of the memory unit, and the circuit substrate holder 76 is an example of the memory unit holding member. However, the circuit substrate 75 may be the same as the memory unit, and the circuit substrate holder 76 may be the same as the memory unit holding member.

In the embodiment, the medium is not limited to the paper S, and may be a plate shaped member which has a metal plate, a resin plate, cloth, or the like as the material. That is, if the material is a member which can be recorded (printed) by the liquid ejected from the liquid ejecting head 24, the material can be adopted as the medium.

In the embodiment, the liquid consumption apparatus is not limited to the serial type printer 11 in which the liquid ejecting head 24 reciprocates according to the carriage 25, and may be a line head type printer in which the printing of the maximum width range of the paper can be performed in a state where the liquid ejecting head 24 is fixed.

In the embodiment, the covering member 121 may include at least the covering body 120.

In the embodiment, an absorbent material which can absorb the ink may be disposed on the rear surface 74*a* of the open-close cover 74.

In the embodiment, the connecting portion 125 may not be the shape in which the connecting portion 125 is folded in plural on the liquid receiving surface 116. For example, the connecting portion 125 may be formed in a L shape in a plan view by being bent only once at a portion of the connecting portion 125. Moreover, the connecting portion 125 may be formed of metal chains or the like and be placed on the liquid receiving surface 116.

In the embodiment, the rear surface 74*a* of the open-close cover 74 may not be the surface inclined downward toward the filler port 73 if the open-close cover 74 is positioned at the opened cover position. In this case, in the rear surface 74*a* of the open-close cover 74, it is preferable that the above-described ink absorbent material be disposed in the portion on which the covering body 120 is placed.

In the embodiment, the covering body 120 of the covering member 121 may not be placed on the rear surface 74*a* of the open-close cover 74.

In the embodiment, the cut out groove 118 may be provided at the peripheral position of the filler port 73 except for the peripheral walls 117. For example, the cut out groove 118 may be formed at the opening edge 73*a* of the filler port 73. Moreover, instead of the cut out groove 118 which is a concave portion, a convex portion which protrudes upward from the peripheral walls 117 may be provided. In addition, in this case, it is preferable that two convex portions be provided to position the liquid pouring source 126 from both sides.

In the embodiment, the area of the wall communication opening 155 may be the same as the area of the filler port 73. Moreover, the area of the wall communication opening 155 may be larger than the area of the filler port 73.

In the embodiment, the filter 166 may not be provided. In addition, the filter 166 may be provided to cover the channel opening 162 in the second ink chamber 152.

In the embodiment, the float valve 131 may not be provided.

In the embodiment, the horizontally inclined rib portions 158*a* to 158*d* may not be provided. Moreover, the horizontally inclined rib portions 158*a* to 158*d* may be provided individually, and the provided rib portions among the horizontally inclined rib portions 158*a* to 158*d* may be arbitrarily selected. For example, any one of the horizontally inclined rib portions 158*a* to 158*d* may be provided. In addition, for example, any two horizontally inclined rib portions such as the third horizontally inclined rib portion 158*c* and the fourth horizontally inclined rib portion 158*d*, or any three horizontally inclined rib portions such as the first to the third horizontally inclined rib portions 158*a* to 158*c* may be provided.

In the embodiment, the horizontally inclined rib portions 158*a* to 158*d* not only extend in one direction, but the rib portions 158*a* to 158*d* may also be partially bent or be partially curved. That is, for example, the horizontally inclined rib portions 158*a* to 158*d* may include both of the portion which extends along the gravity direction and the portion which intersects the gravity direction.

In the embodiment, the third horizontally inclined rib portion 158*c* and the fourth horizontally inclined rib portion 158*d* may not be a line symmetry. That is, for example, the third horizontally inclined rib portion 158*c* and the fourth horizontally inclined rib portion 158*d* may be formed to shift one of the inclined rib portions in the up-down direction Z. Moreover, the axis, which becomes the reference of the line symmetry of the third horizontally inclined rib portion 158*c* and the fourth horizontally inclined rib portion 158*d*, may pass through any position of the float valve 131 if the axis is along the gravity direction. In addition, the third horizontally inclined rib portion 158*c* and the fourth horizontally inclined rib portion 158*d* may be a partial line symmetry with the axis as the reference.

In the embodiment, the horizontally inclined rib portions 158*a* to 158*d* may be formed to extend along the front-rear direction Y. Moreover, the horizontally inclined rib portions 158*a* to 158*d* may be formed to extend in the direction which intersects the left-right direction X.

In the embodiment, the horizontally inclined rib portions 158*a* to 158*d* may be provided to be positionally shifted in the channel opening 162 and the up-down direction Z.

In the embodiment, the channel opening 162 may be formed at a position different from the bottom surface 152*a*. For example, the channel opening may be formed on the side wall 130*b*. Moreover, the channel opening 162 may be formed at a position away from the partition wall 150. That is, the distance L1 may be longer than the distance L2.

In the embodiment, the concave portion 154 may not be provided on the opposite surface 153. In addition, the concave portion 154 may be formed to be recessed toward the direction intersecting the gravity direction. Moreover, the concave portion 154 may be formed to coincide with the pouring virtual line M. That is, the concave portion 154 may be formed at the position of the gravity direction side of the filler port 73. Moreover, the shapes of the concave portion 154 and the filler port 73 are different from each other in a top view, and the size of the concave portion 154 is larger than the size of the filler port 73 in the left-right direction X. Accordingly, even if the concave portion 154 is formed at the position of the gravity direction side of the filler port 73, a portion of the concave portion 154 is positioned at the position which is shifted to the filler port 73 in the direction intersecting the gravity direction. Therefore, the concave portion 154 may be formed to be smaller than the filler port 73 in a top view, and the filler port 73 and the concave portion 154 may be formed to be the same shape as each other.

In the embodiment, the liquid storage container 21 may not include the slider 34. That is, the liquid storage container 21 may be configured of only the liquid storage body 33.

In the embodiment, the partition wall 150 may be provided to intersect the up-down direction Z.

In the embodiment, the storage body case 130 may not include the intersection rib portions 157*a* to 157*i*.

In the embodiment, the storage body case 130 may not include the partition wall 150.

In the embodiment, the upper surface 155*c* of the wall communication opening 155 may be formed along the horizontal direction.

In the embodiment, the cross-sectional area of the inclination channel portion 165 may be the same as the cross-sectional area of the connection channel portion 164. Moreover, the cross-sectional area of the inclination channel portion 165 may be larger than the cross-sectional area of the curved channel portion 163. In addition, the cross-sectional area of the inclination channel portion 165 may be smaller than the cross-sectional area of the connection channel portion 164 and the cross-sectional area of the curved channel portion 163.

In the embodiment, the inclination channel portion 165 may be provided at the position which is shifted to the lower side position in the gravity direction of the ink chamber 137. That is, for example, the inclination channel portion 165 may be provided to be adjacent to the ink chamber 137 via the side wall 130*b*.

In the embodiment, the valve body 182 fixed to the bottom surface 152*a* of the second ink chamber 152 may be omitted, and the valve opening 192 may be provided to have a function of a valve body to be closed if the pressing portion 189 protruding downward in the vertical direction from the lower surface of the float member 181 moves downward.

In the embodiment, the plate shaped portion 191 which, serves as an example of the regulation abutment portion with respect to the regulation case 183 in the float member 181, may have shapes different from the cross shape in the cross-sectional shape. In brief, if the gap distance between the portion configuring the regulation abutment portion and the inner surface of the cylindrical portion 198 is smaller than the gap distance between the thin film member 186 and the inner surface of the annular wall portion 196, the shape of the plate shaped portion 191 may be arbitrary changed.

In the embodiment, the shape of the through hole 202 in the regulation case 183 is not limited to the rectangular shape, and may be a round shape, a triangular shape, or a cut out shape. In brief, if the shape of the through hole is a shape which allows the ink flow when the float member 181 floats, the shape may be arbitrary changed.

In the embodiment, the cut out portion 199, which is formed on the side wall 196*a* along the front-rear direction Y of the regulation case 183, may be omitted. Alternatively, the cut out portion 199 may be formed on the side wall 196*b* along the left-right direction X. Also in this case, the cut out portion 199 makes the inner portion and the outer portion of the regulation case 183 communicate with each other and allows the ink flow, and can decrease a concern that the float member 181 may slide against the regulation case 183 when the float member 181 floats.

In the embodiment, the coil spring 195, which has the second biasing force biasing the valve body 182 toward the opened valve position of the upper side, may be omitted.

In the embodiment, at least one air chamber 187 may be provided in the float member 181. That is, the number of the air chambers 187 is not necessarily limited to four, and may be at least one or more such as two, three, five.

In the embodiment, the partition wall 150, which partitions the ink chamber 137 into the first ink chamber 151 and the second ink chamber 152, may not be provided. That is, only a single ink chamber 137 of the liquid storage body 33 may be provided, and the float valve 131 may be disposed in the single ink chamber 137.

In the embodiment, the shape of the regulation case 183 is not limited to a box shape. That is, the shape of the regulation case 183 may be arbitrary changed if the regulation case 183 has the annular wall portion 196 which surrounds the float member 181 to prevent the float member 181 with respect to the inflow pressure of the ink flowing into the second ink chamber 152.

In the embodiment, the regulation member may not be the box shape like the regulation case 183, and may be a frame shape. In brief, when the float member 181 floats upward according to the increase of the liquid surface of the ink, if the regulation member has a structure which abuts to stop the upward floating at the position below the ceiling of the ink chamber 137 and regulates the floating, the shape of the regulation member may be arbitrary changed.

In the embodiment, for example, the thin film member 186 which forms the air chamber 187 by closing the opening portion 185*a* of the float member 181 may be a thin resin sheet, a plate, or the like different from the film.

In the embodiment, as the posture when the liquid storage container 21 is used, in addition to the state where the liquid storage container 21 is mounted to the mounting portion 31 of the printer 11 and fixed unmovable to the printer 11, a state where the liquid storage container 21 is placed on the side of the printer 11 and is connected to supply the liquid by a tube may be adopted.

In the embodiment, although the liquid container and the liquid pouring source are described, both may be represented by a liquid container.

In the embodiment, the liquid consumption apparatus may be a liquid ejecting apparatus which ejects or discharges other liquids in addition to the ink. Moreover, the state of the liquid, which is discharged to be liquid droplets of a minute amount from the liquid ejecting apparatus, include granular, tear-shaped, threadlike trailed droplets. In addition, here, the liquid may be any material as long as it can be ejected from the liquid ejecting apparatus. For example, it is preferable if the material is a liquid phase, however, examples of the liquid may include not only a liquid body having high or low viscosity, but also a fluidal body such as sol, gel water, other inorganic solvent, organic solvent, solution, liquid resin, and liquid metal (molten metal). Moreover, the material is not limited to the liquid which is one state of a material, and may include a material in which particles of functional material consisting of solid material such as pigments or metal particles are dissolved, distributed or mixed in solvent. Further, as a representative example of the liquid, as described above in the embodiments, there is ink, liquid crystal, or the like. Here, the ink may include general water-based ink and oil-based ink, and various liquid compositions such as gel ink or hot melt ink. For example, as a specific example of the liquid ejecting apparatus, there is a liquid ejecting apparatus for ejecting the liquid obtained by distributing and dissolving electrode materials, color materials, or the like which are used for manufacturing a liquid crystal display, EL (electroluminescence) display, a surface light emitting display, a color filter, and the like. In addition, the liquid ejecting apparatus may include a liquid ejecting apparatus for ejecting bioorganic materials used in the manufacture of bio circuit substrates, a liquid ejecting apparatus for ejecting liquid including samples used as a precision pipette, an apparatus for printing, a micro-dispenser, or the like. In addition, the liquid ejecting apparatus may include a liquid ejecting apparatus for ejecting lubricating oil by pin points in precision machines such as watches or cameras, or a liquid ejecting apparatus for ejecting transparent resins such as ultraviolet-curable resin for forming micro-hemispherical lens (optical lens) used in optical communication elements or the like to the substrate. Moreover, the liquid ejecting apparatus may include a liquid ejecting apparatus for ejecting etching solutions of acid, alkaline, or the like for etching substrates or the like.

In the embodiment, the memory unit records the relevant information related to the liquid. However, the memory unit may not actually store the information, but may just store the information.

What is claimed is:

1. A liquid ejecting apparatus adapted to eject liquid onto a medium, the liquid ejecting apparatus comprising:

a housing section;

a medium discharge port configured and arranged to discharge the medium, the medium discharge port being disposed on a front side of the housing section and defining an opening of the front side of the housing section through which the medium is discharged outside of the housing section;

an operation panel disposed on the housing section; and a liquid holding body disposed on the front side of the housing section, wherein:

the liquid holding body includes an inlet port section configured and arranged to introduce the liquid from outside the liquid holding body into the liquid holding body, and at least a part of the inlet port section is disposed at a position lower than a position of the operation panel.

2. The liquid ejecting apparatus according to claim 1, further comprising a cover member configured and arranged to cover the inlet port section, the cover member being openable and closable relative to the inlet port section.

3. The liquid ejecting apparatus according to claim 2, wherein the cover member is further configured and arranged to freely rotate such that an axis which extends along a short side direction of the liquid holding body is the center of rotation.

4. The liquid ejecting apparatus according to claim 2, wherein the cover member is further configured and arranged to be displaced from a closed lid position to an open lid position by moving in parallel with regard to the liquid holding body in a longitudinal direction.

5. The liquid ejecting apparatus according to claim 2, further comprising:

a covering body configured to contact and cover the inlet port section and arranged detachably to the inlet port section;

wherein the cover member is configured and arranged to cover the inlet port section and the cover body when the cover body contacts and covers the inlet port section.

6. A liquid ejecting apparatus adapted to eject liquid onto a medium, the liquid ejecting apparatus comprising:

a housing section;

a medium discharge port configured and arranged to discharge the medium, the medium discharge port being disposed on a front side of the housing section and defining an opening of the front side of the housing section through which the medium is discharged outside of the housing section;

an operation panel disposed on the housing section; and a liquid holding body disposed on the front side of the housing section;

wherein:

the liquid holding body includes an inlet port section configured and arranged to introduce the liquid from outside the liquid holding body into the liquid holding body, and at least a part of the inlet port section is disposed at a position more forward than a position of the operation panel.

7. The liquid ejecting apparatus according to claim 6, further comprising a cover member configured and arranged to cover the inlet port section, the cover member being openable and closable relative to the inlet port section.

8. The liquid ejecting apparatus according to claim 7, wherein the cover member is further configured and arranged to freely rotate such that an axis which extends along the short side direction of the liquid holding body is the center of rotation.

9. The liquid ejecting apparatus according to claim 7, wherein the cover member is further configured and arranged to be displaced from a closed lid position to an open lid position by moving in parallel with regard to the liquid holding body in a longitudinal direction.

10. The liquid ejecting apparatus according to claim 7, further comprising a covering body configured to contact and cover the inlet port section and arranged detachably to the inlet port section;

wherein the cover member is configured and arranged to cover the inlet port section and the cover body when the cover body contacts and covers the inlet port section.

11. A liquid ejecting apparatus adapted to eject liquid onto a medium, the liquid ejecting apparatus comprising:

a housing section;

a medium discharge port configured and arranged to discharge the medium, the medium discharge port being disposed on a front side of the housing section and defining an opening of the front side of the housing section through which the medium is discharged outside of the housing section; and a liquid holding body disposed on the front side of the housing section;

wherein:

the liquid holding body includes an inlet port section configured and arranged to introduce the liquid from outside the liquid holding body into the liquid holding body, and at least a part of the inlet port section is disposed at a position more forward than a position of the medium discharge port.

12. The liquid ejecting apparatus according to claim 11, further comprising a cover member configured and arranged to cover the inlet port section, the cover member being openable and closable relative to the inlet port section.

13. The liquid ejecting apparatus according to claim 12, wherein the cover member is further configured and arranged to freely rotate such that an axis which extends along the short side direction of the liquid holding body is the center of rotation.

14. The liquid ejecting apparatus according to claim 12, wherein the cover member is further configured and arranged to be displaced from a closed lid position to an open lid position by moving in parallel with regard to the liquid holding body in the longitudinal direction.

15. The liquid ejecting apparatus according to claim 12, further comprising a covering body configured to contact and cover the inlet port section and arranged detachably to the inlet port section;

wherein the cover member is configured and arranged to cover the inlet port section and the cover body when the cover body contacts and covers the inlet port section.

16. A liquid ejecting apparatus adapted to eject liquid onto a medium, the liquid ejecting apparatus comprising:

a housing section;

a medium discharge port configured and arranged to discharge the medium, the medium discharge port being disposed on a front side of the housing section and defining an opening of the front side of the housing section through which the medium is discharged outside of the housing section; and a liquid holding body disposed on the front side of the housing section, wherein:

the liquid holding body includes an inlet port section configured and arranged to introduce the liquid from outside the liquid holding body into the liquid holding body, and at least a part of the inlet port section is disposed in a lower section of the housing at one end side which is an outer side of a transport path of the medium.

17. The liquid ejecting apparatus according to claim 16, further comprising a cover member configured and arranged to cover the inlet port section, the cover member being openable and closable relative to the inlet port section.

18. The liquid ejecting apparatus according to claim 17, wherein the cover member is further configured and arranged to freely rotate such that an axis which extends along the short side direction of the liquid holding body is the center of rotation.

19. The liquid ejecting apparatus according to claim 17, wherein the cover member is further configured and arranged to be displaced from a closed lid position to an open lid position by moving in parallel with regard to the liquid holding body in the longitudinal direction.

20. The liquid ejecting apparatus according to claim 17, further comprising a covering body configured to contact and cover the inlet port section and arranged detachably to the inlet port section;

wherein the cover member is configured and arranged to cover the inlet port section and the cover body when the cover body contacts and covers the inlet port section.

* * * * *